US007975999B2

(12) United States Patent
Fukasawa et al.

(10) Patent No.: US 7,975,999 B2
(45) Date of Patent: Jul. 12, 2011

(54) SHEET POST-PROCESSING APPARATUS AND IMAGE FORMING SYSTEM COMPRISING THE SAME

(75) Inventors: Eiji Fukasawa, Yamanashi (JP); Ichitaro Kubota, Koufu (JP); Kenichi Matsuno, Koufu (JP); Takahisa Kazuno, Kai (JP)

(73) Assignee: Nisca Corporation, Yamanashi (JP)

( * ) Notice: Subject to any disclaimer, the term of this patent is extended or adjusted under 35 U.S.C. 154(b) by 669 days.

(21) Appl. No.: 12/010,951

(22) Filed: Jan. 31, 2008

(65) Prior Publication Data

US 2008/0211158 A1 Sep. 4, 2008

(30) Foreign Application Priority Data

Jan. 31, 2007 (JP) ..... 2007-022039
Feb. 28, 2007 (JP) ..... 2007-050495
Feb. 28, 2007 (JP) ..... 2007-050496
May 30, 2007 (JP) ..... 2007-144039

(51) Int. Cl.
*B65H 37/04* (2006.01)
*B31F 1/08* (2006.01)

(52) U.S. Cl. ..... 270/37; 270/32; 270/45; 270/58.07; 270/58.08; 270/58.11; 270/58.12

(58) Field of Classification Search ..... 270/32, 270/37, 45, 51, 58.07, 58.08, 58.09, 58.11, 270/58.12, 58.13, 58.17, 58.28, 58.1
See application file for complete search history.

(56) References Cited

U.S. PATENT DOCUMENTS 5,382,011 A * 1/1995 Tani ..... 270/37
7,165,764 B2 * 1/2007 Nakamura et al. ..... 270/58.11
7,306,214 B2 * 12/2007 Iida et al. ..... 270/58.11
7,726,648 B2 * 6/2010 Tamura et al. ..... 271/176
2005/0067777 A1 * 3/2005 IIda et al. ..... 271/303
2006/0017209 A1 * 1/2006 Kushida et al. ..... 270/37
2006/0261544 A1 * 11/2006 Tamura et al. ..... 271/303
2007/0120308 A1 * 5/2007 Takemoto et al. ..... 270/37
2007/0126167 A1 * 6/2007 Kushida ..... 270/58.12
2007/0138726 A1 * 6/2007 Tamura et al. ..... 270/37
2009/0152788 A1 * 6/2009 Kawaguchi ..... 270/37

FOREIGN PATENT DOCUMENTS

| | | |
|---|---|---|
| JP | 2000-063031 | 2/2000 |
| JP | 2000-169028 | 6/2000 |
| JP | 2001-058739 | 3/2001 |
| JP | 2003-267622 | 9/2003 |
| JP | 2004-269249 | 9/2004 |
| JP | 2005-041660 | 2/2005 |
| JP | 2006-001659 A | 1/2006 |
| JP | 2006-008384 | 1/2006 |

* cited by examiner

*Primary Examiner* — Leslie A Nicholson, III
(74) *Attorney, Agent, or Firm* — Manabu Kanesaka

(57) ABSTRACT

A post-processing apparatus includes a sheet carry-in path along which sheets from a carry-in port are fed through a sheet discharging port to a downstream post-processing position, and a collecting guide, for setting and collecting the sheets into a bunch. The collecting guide is located downstream of the sheet discharging port with a difference in level between the sheet discharging port and the collecting guide, is provided. A post-processing apparatus is provided for executing a stapling process and/or a folding process on the sheet bunch collected on the collecting guide. A sheet leading end regulating device is provided for regulating a position of leading ends of the sheets collected on the collecting guide device. The sheet leading end regulating device is movable according to a sheet size so that trailing ends of the sheet ends are placed at a predetermined position below the sheet discharging port.

19 Claims, 75 Drawing Sheets

Image formation in stapling finish mode

Image formation in sheet bunch folding finisih mode

SHEET POST-PROCESSING APPARATUS AND IMAGE FORMING SYSTEM COMPRISING THE SAME

BACKGROUND OF THE INVENTION AND RELATED ART STATEMENT

The present invention relates to a sheet post-processing apparatus that sets sheets carried out from an image forming apparatus such as a printer, into a bunch and then staples or folds the sheet bunch, as well as an image forming system comprising the sheet post-processing apparatus. More particularly, the present invention relates to improvements in a sheet stapling mechanism and a sheet folding mechanism.

In general, post-processing apparatuses which set sheets carried out from an image forming apparatus or the like and then staple and fold the sheets into a booklet or fold the sheets without performing a stapling operation are well known. Such a post-processing apparatus is used as, for example, a system apparatus for a bookbinding process or the like which is connected to a sheet discharging port in an image forming apparatus.

For example, Patent Document 1 [Japanese Patent Laid-Open No. 2006-008384] discloses an apparatus that collects sheets from an image forming apparatus in a conveying path, staples the resultant sheet bunch at a central part thereof, folds the sheet bunch at a fold line position corresponding to the center of the sheet bunch, and then houses the folded sheet bunch in a stacker. Patent Document 1 [Japanese Patent Laid-Open No. 2006-008384] discloses the apparatus having a stopper member that regulates the leading end of sheets so as to move the sheets collected in the path between a staple position and a fold position, the stopper member being configured to elevate and lower in the path.

Patent Document 2 [Japanese Patent Laid-Open No. 2005-041660] discloses an apparatus configuration having a flapper member at a sheet carry-in port in order to prevent, when sheets are loaded and collected in a path, a succeeding sheet from advancing between preceding sheets to cause incorrect collating. The flapper member guides the succeeding sheet onto the collected sheets.

As is well known, with the above-described sheet folding device, when sheets are loaded and collected in a path on which a sheet folding mechanism is located, if the preceding sheets are carried into the path and the succeeding sheet is then carried in so as to follow the trailing end of the preceding sheets, the succeeding sheet may slip in between the loaded preceding sheets to cause incorrect collating. In particular, when the position of the leading end of the collected sheets is regulated so as to place the sheets at a predetermined fold position or a staple position, if the succeeding sheet has a length size different from that of the collected sheets, for example, the succeeding sheet is shorter than the collected sheets, a gap is created between the trailing end of the collected sheets and the trailing end of the succeeding sheet. This prevents the succeeding sheet from being guided onto the collected sheets, increasing the likelihood of out-of-order pages. The conventional art thus adopts a mechanism that collects sheets into a bunch at an upstream position different from the sheet fold position or staple position and then conveys the resultant sheet bunch to the staple position or the fold position.

Patent Document 2 [Japanese Patent Laid-Open No. 2005-041660] thus proposes the mechanism having the flapper member that maintains the correct order of sheets collected at the sheet carry-in port. Patent Document 2 [Japanese Patent Laid-Open No. 2005-041660] discloses the mechanism having the flapper member hanging from the sheet carry-in port to a collecting guide to guide the sheets. The carried-in sheets are wholly fed in a conveying direction by a predetermined amount, switched back, and placed under the flapper member so that the flapper member can overlap the sheets to carry in the next sheet. That is, Patent Document 2 [Japanese Patent Laid-Open No. 2005-041660] proposes the mechanism having the flapper that guides the sheets to the sheet carry-in port while maintaining the correct order of the sheets, the mechanism using a sheet leading end regulating member to move each entire sheet in a forward-backward direction (up and down) to offset the trailing end of the sheet guided by the flapper member (see FIG. 9 of Patent Document 2 [Japanese Patent Laid-Open No. 2005-041660]).

However, when a guide mechanism such as the flapper and a sheet position regulating mechanism that adjusts the position of the trailing end of the collected sheets are arranged at the sheet carry-in port as in the case of Patent Document 2 [Japanese Patent Laid-Open No. 2005-041660], the apparatus disadvantageously becomes complicated. That is, every time a sheet from the sheet bunch collected on the collecting guide is carried in through the carry-in port, the sheets already collected into the bunch are offset from one another forward or backward in a conveying direction. This requires a complicated mechanism. With sheets consecutively delivered through the carry-in port, it is disadvantageous to offset the bunched sheets forward or backward in the conveying direction for every sheet carry-in operation, in terms of operation time, timing, and a control mechanism.

It is therefore an object of the invention to solve the problems stated above and provide a guide member at the sheet carry-in port so as to be able to offset the sheet to be delivered without the need to move the sheets on the collecting guide forward or backward. Further, the guide member at the sheet carry-in port is configured to be elastically deformable or rotatable around a shaft. Further, pivotally moving the guide member so as to pass over the sheet bunch enables the trailing end of the sheet carried in along the guide to be offset so as to allow the next sheet to be carried in.

It is also an object of the present invention to provide an inexpensive sheet folding device of a simple structure which can prevent a possible sheet jam or possible out-of-order pages when sheets are collected at a post-processing position and which enables the resultant sheet bunch to be subsequently accurately placed at a staple position or a fold position.

Further objects and advantages of the invention will be apparent from the following description of the invention.

SUMMARY OF THE INVENTION

The present invention adopts the following configuration in order to accomplish the above object.

A post-processing apparatus includes a sheet carry-in path along which sheets from a carry-in port are fed through a sheet discharging port to a downstream post-processing position. A collecting guide means, for setting and collecting the sheets into a bunch, the collecting guide means being located downstream of the sheet discharging port with a difference in level between the sheet discharging port and the collecting guide means, is provided. A post-processing means is provided for executing a stapling process and/or a folding process on the sheet bunch collected on the collecting guide means. Further, a sheet leading end regulating means is provided for regulating a position of a leading end of the sheets collected on the collecting guide means. The sheet leading end regulating means is configured to be movable according to a sheet size so that a trailing end of the sheet ends supported on the collecting guide means is placed at a predetermined position below the sheet discharging port. A plate-like guide member is provided at a sheet discharging port of the sheet carry-in path to guide a carried-in sheet onto an uppermost one of the sheets supported on the collecting guide means. The plate-like guide member has a base end supported via a shaft so as to be pivotable above the collecting guide means and a leading end configured to retract from an operative position where the carried-in sheet is guided onto the uppermost sheet, along a surface of the uppermost sheet to outside of the surface of the uppermost sheet and then to pivot onto the carried-in sheet. Driving means moving rotationally around the base end is coupled to the plate-like guide member.

The plate-like guide member includes an elastically deformable flexible member or a plate-like member having the base end deformably coupled to a shaft. The plate-like guide member is elastically deformed or rotates around the shaft so as to pass over the uppermost sheet on the collecting guide means.

The post-processing means further includes folding roll means disposed on the collecting guide means at a sheet fold position. The collecting guide means includes a curved or a bent sheet loading guide. The sheet loading guide supports the sheets so that the sheets roll back with the sheet fold position projecting toward the folding roll means.

The post-processing means also includes staple means for stapling the sheet bunch collected on the collecting guide means and folding roll means for folding the sheet bunch. The staple means is located on the collecting guide means at an upstream sheet staple position and the folding roll means is located on the collecting guide means at the downstream sheet fold position so that the staple means and the folding roll means are arranged in this order. The collecting guide means includes the curved or bent sheet loading guide. The sheet loading guide supports the sheets so that the sheets roll back with the sheet fold position projecting toward the folding roll means.

The sheet carry-in path includes a curved guide member curving the sheets in a predetermined direction. The curved guide member curves the sheets in a direction opposite to that of the sheet loading guide. The plate-like guide member urges and holds the trailing end of the sheets on the sheet loading guide.

During a staple operation in which the staple means staples the sheet bunch supported on the sheet loading guide, the plate-like guide member urges and holds the trailing end of the sheet bunch on the sheet loading guide.

The sheet leading end regulating means includes a locking member locking the leading end of the sheets and a grip member gripping the sheets. The sheet grip member grips the leading end of the sheet bunch when at least the sheet bunch on the sheet loading guide is moved from the staple position to the fold position.

An image forming system according to an embodiment of the present invention includes an image forming apparatus sequentially forming images on sheets and a sheet post-processing apparatus executing a stapling process and/or a folding process on the sheets from the image forming apparatus, the sheet post-processing apparatus being configured as described above.

BRIEF DESCRIPTION OF THE DRAWINGS

FIG. 6(*b*) is a plan view illustrating the folding roll means in FIG. 4 as viewed in a sheet width direction;

FIG. 6(*c*) is a diagram in section explaining the sheet folding device of FIG. 4;

FIG. 7(*b*) is a diagram illustrating a driving mechanism for a folding blade;

FIG. 7(*c*) is a diagram illustrating the structure of a one-way clutch;

FIG. 7(*d*) is a diagram illustrating the driving mechanism for the folding blade;

FIG. 8(*b*) is a state diagram illustrating an initial state of the sheet bunch folding operation performed by the apparatus in FIG. 2;

FIG. 8(*c*) is a state diagram showing that the sheet bunch has been inserted to a nip position of the folding roll means, to describe the sheet bunch folding operation performed by the apparatus in FIG. 2;

FIG. 8(*d*) is a state diagram showing a carry-out state in which the sheet bunch is folded by the folding roll means, to describe the sheet bunch folding operation performed by the apparatus in FIG. 2;

FIG. 10(*b*) is a state diagram illustrating the initial state of the sheet bunch folding operation performed by the apparatus in FIG. 2;

FIG. 10(*c*) is a state diagram showing that the sheet bunch has been inserted to the nip position of the folding roll means, to describe the sheet bunch folding operation performed by the apparatus in FIG. 2;

FIG. 10(*d*) is a state diagram showing the carry-out state in which the sheet bunch is folded by the folding roll means, to describe the sheet bunch folding operation performed by the apparatus in FIG. 2;

FIG. 10(*e*) is a state diagram showing that the folding operation has been completed to retract the folding blade, to describe the sheet bunch folding operation performed by the apparatus in FIG. 2;

FIG. 11(*b*) is a state diagram showing that the trailing end of the sheet bunch is being carried out, to describe the operating state in which the apparatus in FIG. 2 carries out the sheet bunch from the folding rolls to the carry-out guide;

FIG. 11(*c*) is a diagram explaining the operating state of the sheet bunch transferring from the folding rolls to the carry-out guide in FIG. 2 in a state that a rear end of the sheet bunch is being transferred;

FIG. 12(*b*) is a diagram illustrating an initial state of the folding operation of the folding rolls;

FIG. 12(*c*) is a diagram illustrating that the folded sheets are being discharged during the folding operation of the folding rolls;

FIG. 14(*b*) is a state diagram showing that the succeeding sheet has reached the collecting guide, to describe the operating state of the sheet leading end regulating means of the device in FIG. 4;

FIG. 14(*c*) is a state diagram showing that the sheet bunch collected on the collecting guide is being placed at the staple position, to describe the operating state of the sheet leading end regulating means of the device in FIG. 4;

FIG. 14(*d*) is a state diagram showing that the sheet bunch collected on the collecting guide is being placed at the fold position, to describe the operating state of the sheet leading end regulating means of the device in FIG. 4;

FIG. 15(*b*) is a diagram illustrating the configuration of the sheet carry-in guide and pressurizing means in the apparatus in FIG. 2 and showing a sheet carry-in state;

FIG. 16(*b*) is a diagram illustrating the configuration of the sheet carry-in guide and pressurizing means in FIG. 2, showing a sheet carrying-in condition;

FIG. 18(*b*) is a state diagram showing that a sheet is being carried into the collecting guide, to describe the sheet post-processing operation performed by the apparatus in FIG. 2;

FIG. 18(*c*) is a state diagram showing that sheets have been collected on the collecting guide, to describe the sheet post-processing operation performed by the apparatus in FIG. 2;

FIG. 18(*d*) is a state diagram showing that the sheet bunch is being moved and set at the staple position, to describe the sheet post-processing operation performed by the apparatus in FIG. 2;

FIG. 18(*e*) is a state diagram showing a staple operation of stapling the sheet bunch to describe the sheet post-processing operation performed by the apparatus in FIG. 2;

FIG. 18(*f*) is a state diagram showing that the stapled sheet bunch is being moved to the fold position, to describe the sheet post-processing operation performed by the apparatus in FIG. 2;

FIG. 18(*g*) is a diagram of an initial state of a folding process to describe the sheet post-processing operation performed by the apparatus in FIG. 2;

FIG. 18(*h*) is a diagram showing that the sheet bunch is leaving the pressurizing means, to describe the sheet post-processing operation performed by the apparatus in FIG. 2;

FIG. 20 is a diagram illustrating how a preceding sheet is carried in;

FIG. 21(*b*) is a state diagram illustrating the preceding sheet standby state and showing that the trailing end of the preceding sheet is held in a standby area;

FIG. 21(*c*) is a state diagram illustrating the preceding sheet standby state and showing that the succeeding sheet has been carried in;

FIG. 21(*d*) is a state diagram illustrating the preceding sheet standby state and showing that the preceding sheet and the succeeding sheet are held so as to overlap in a vertical direction;

FIG. 21(*e*) is a state diagram illustrating that the preceding sheet and the succeeding sheet are being nipped by the sheet discharging roller;

FIG. 21(*f*) is a state diagram illustrating that the preceding sheet and the succeeding sheet are being guided to a second switchback conveying path;

FIG. 22(*b*) is a diagram illustrating that rollers of the first conveying roller means are in pressure contact with each other;

FIG. 22(*c*) is a diagram illustrating that the rollers of the first conveying roller means are in loose pressure contact with each other;

FIG. 22(*d*) is a diagram illustrating that the rollers of the first conveying roller means are separated from each other;

FIG. 23(*b*) is a diagram showing the operating state of the sheet discharging roller in the apparatus in FIG. 2;

FIG. 23(*c*) is a diagram showing the operating state of the sheet discharging roller in the apparatus in FIG. 2;

FIG. 24(*b*) is a diagram showing the relationship between sheet conveyance and the pressure contact operation of the sheet discharging roller in the apparatus in FIG. 2;

FIG. 24(*c*) is a diagram showing the relationship between sheet conveyance and the pressure contact operation of the sheet discharging roller in the apparatus in FIG. 2;

FIG. 24(*d*) is a diagram showing the relationship between the conveyance of the succeeding sheet and the pressure contact operation of the sheet discharging roller in FIG. 10;

FIG. 24(*e*) is a diagram showing the relationship between the conveyance of the succeeding sheet and the pressure contact operation of the sheet discharging roller in FIG. 10;

FIG. 24(*f*) is a diagram showing the relationship between the conveyance of the succeeding sheet and the pressure contact operation of the sheet discharging roller in FIG. 10;

FIG. 24(*g*) is a state diagram of the conveyance of the sheet bunch in the apparatus in FIG. 2, showing that a predetermined number of sheets have been collected like scales;

FIG. 24(*h*) is a state diagram of the conveyance of the sheet bunch in the apparatus in FIG. 2, showing that a folding process and a stapling process are being executed on the sheet bunch;

FIG. 26(*b*) is a diagram continued from FIG. 26(*a*) and illustrating the operation of the sheet carry-in guide;

FIG. 26(*c*) is a diagram continued from FIG. 26(*b*) and illustrating the operation of the sheet carry-in guide;

FIG. 26(*d*) is a diagram continued from FIG. 26(*c*) and illustrating the operation of the sheet carry-in guide; and FIG. 26(*e*) is a diagram continued from FIG. 26(*d*) and illustrating the operation of the sheet carry-in guide.

DETAILED DESCRIPTION OF PREFERRED EMBODIMENT

Figure 1:
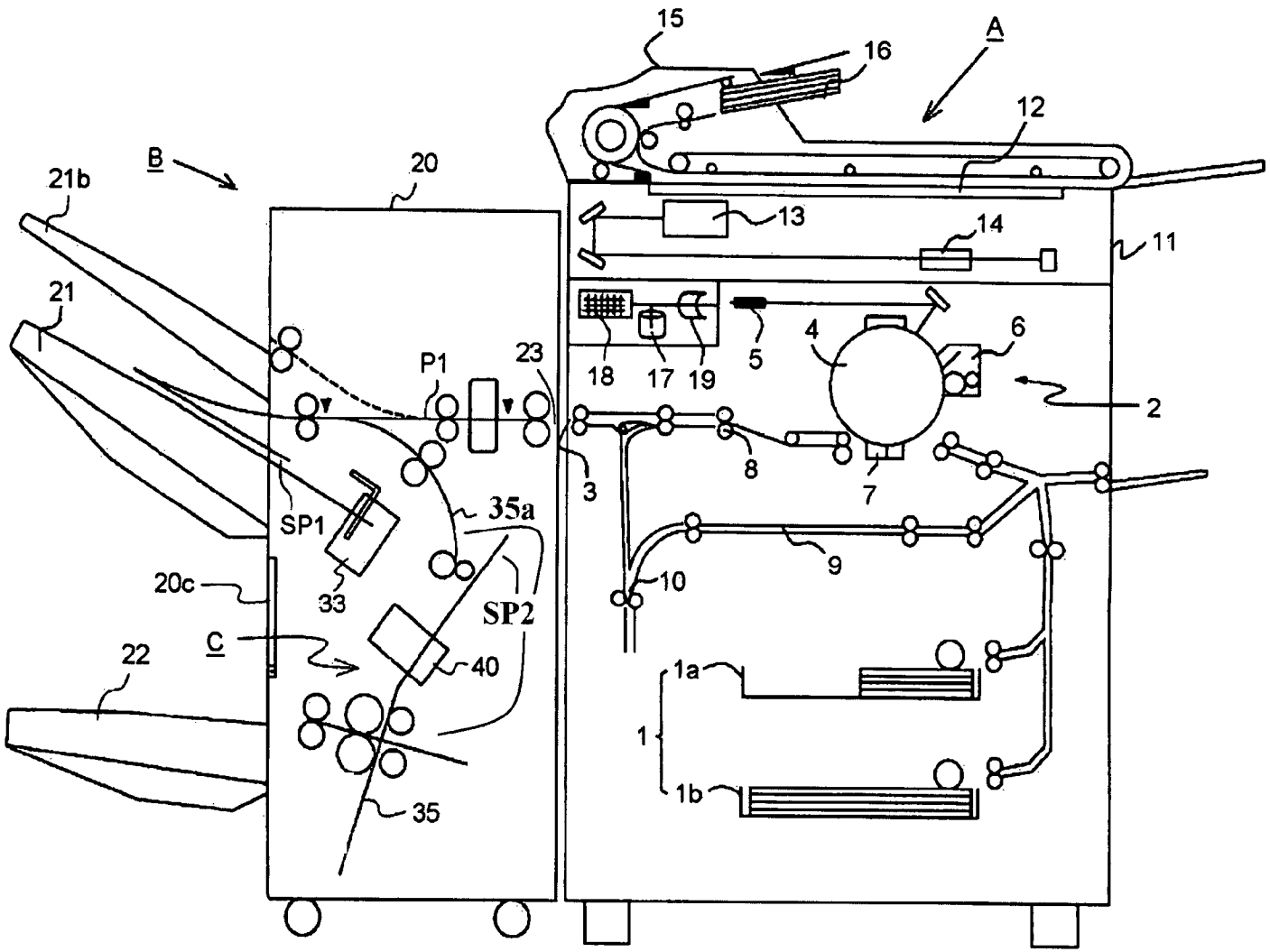
FIG. 1 is a diagram illustrating an entire image forming apparatus.
Figure 2:
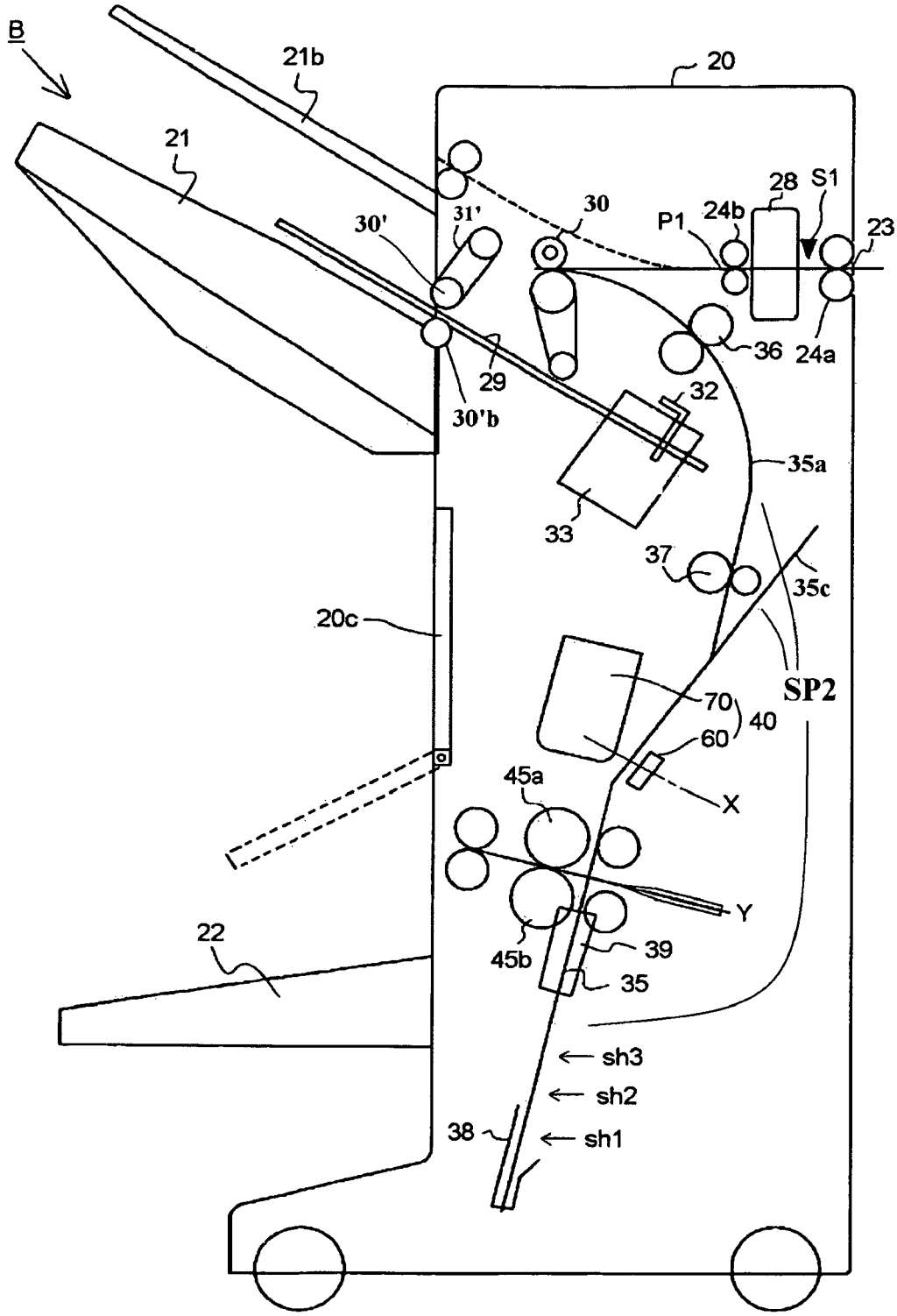
FIG. 2 is a diagram illustrating an entire post-processing apparatus comprising a sheet folding device according to the present invention.
Figure 3:
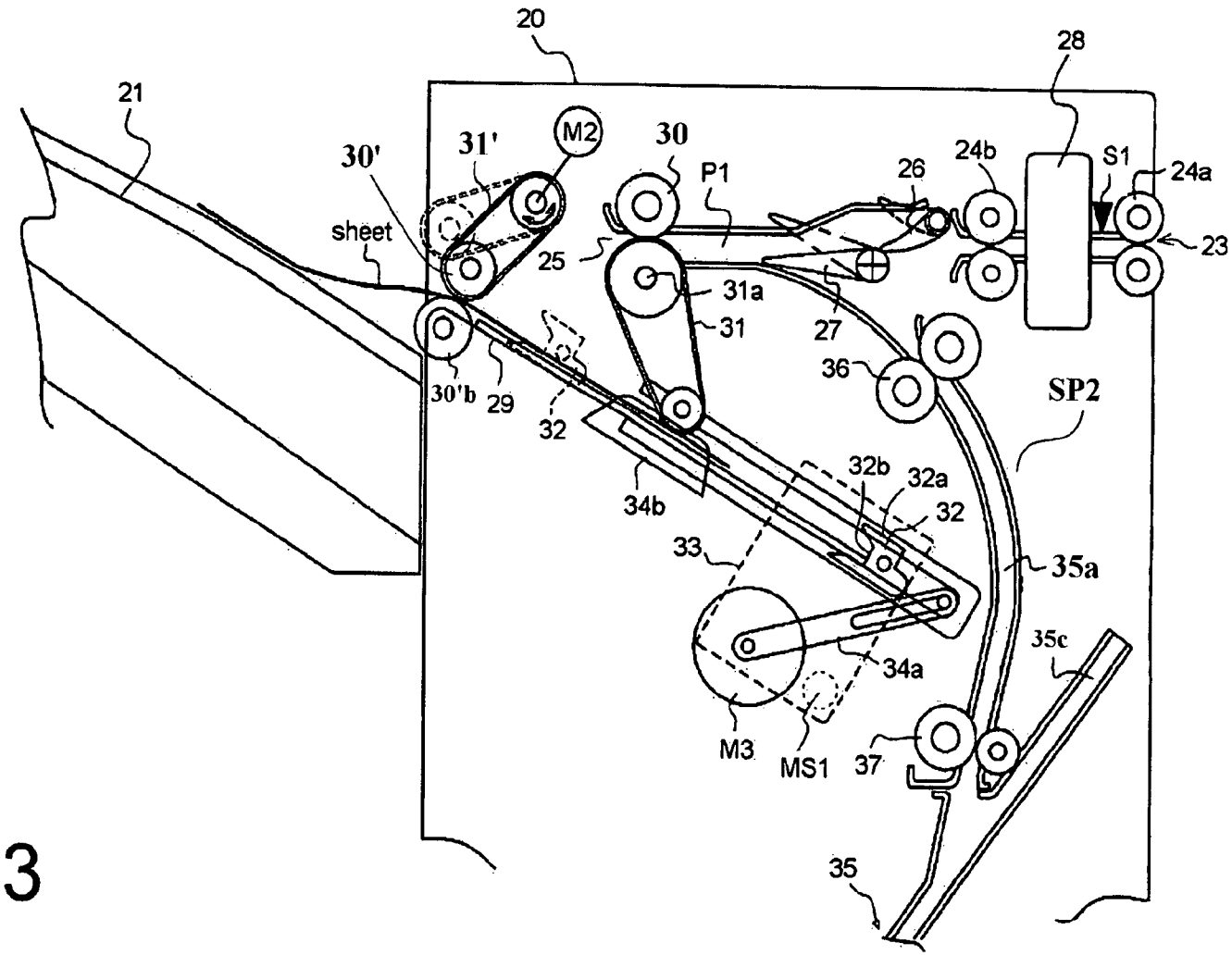
FIG. 3 is a detailed diagram showing a part of the post-processing apparatus in FIG. 2.

The present invention will be described below in detail on the basis of an illustrated preferred embodiment. FIG. 1 shows the general configuration of an image forming system according to the present invention. FIG. 2 is a diagram illustrating the general configuration of a post-processing apparatus. FIG. 3 is a diagram illustrating the detailed configuration of a sheet folding device. The image forming system shown in FIG. 1 is composed of an image forming apparatus A and a post-processing apparatus B. A sheet folding device C is incorporated into the post-processing apparatus B as a unit.

In the image forming apparatus A, shown in FIG. 1, a sheet feeding section 1 feeds a sheet to an image forming section 2. The image forming section 2 prints the sheet, which is then carried out through a body sheet discharging port 3. The sheet feeding section 1 has sheets of plural sizes housed in sheet feeding cassettes 1*a* and 1*b* and separately feeds specified sheets one by one to the image forming section 2. The image forming section 2 has, for example, an electrostatic drum 4, as well as a print head (laser light emitter) 5, a developing unit 6, a transfer charger 7, and a fixer 8 which are arranged around the periphery of the static drum 4. The laser light emitter 5 forms an electrostatic latent image on the electrostatic drum 4, and the developing unit 6 sticks toner to the latent image. The transfer charger 7 transfers the image to the sheet, and the fixer 8 heats and fixes the image to the sheet. Sheets with images thus formed thereon are sequentially carried out through the body sheet discharging port 3. A circulating path 9 for double side printing along which a sheet from the fixer 8 having an image formed on a front surface thereof is turned upside down via a body switchback path 10 and then fed to the image forming section 2 again, which prints a back surface of the sheet. The sheet with images printed on the opposite surfaces thereof is turned upside down on the body switchback path 10 and carried out through the body sheet discharging port 3.

Further, an image reading device 11 has a scan unit 13 that scans a document sheet set on a platen 12 and a photoelectric converting element (not shown) that electrically reads an image from the sheet. The image data is subjected to a digital process by the image processing section. The resultant image data is transferred to a data storage section 14 and sends an image signal to the laser light emitter 5. A document feeding device 15 is a device that feeds document sheets accommodated in a stacker 16 to the platen 12.

Figure 9:
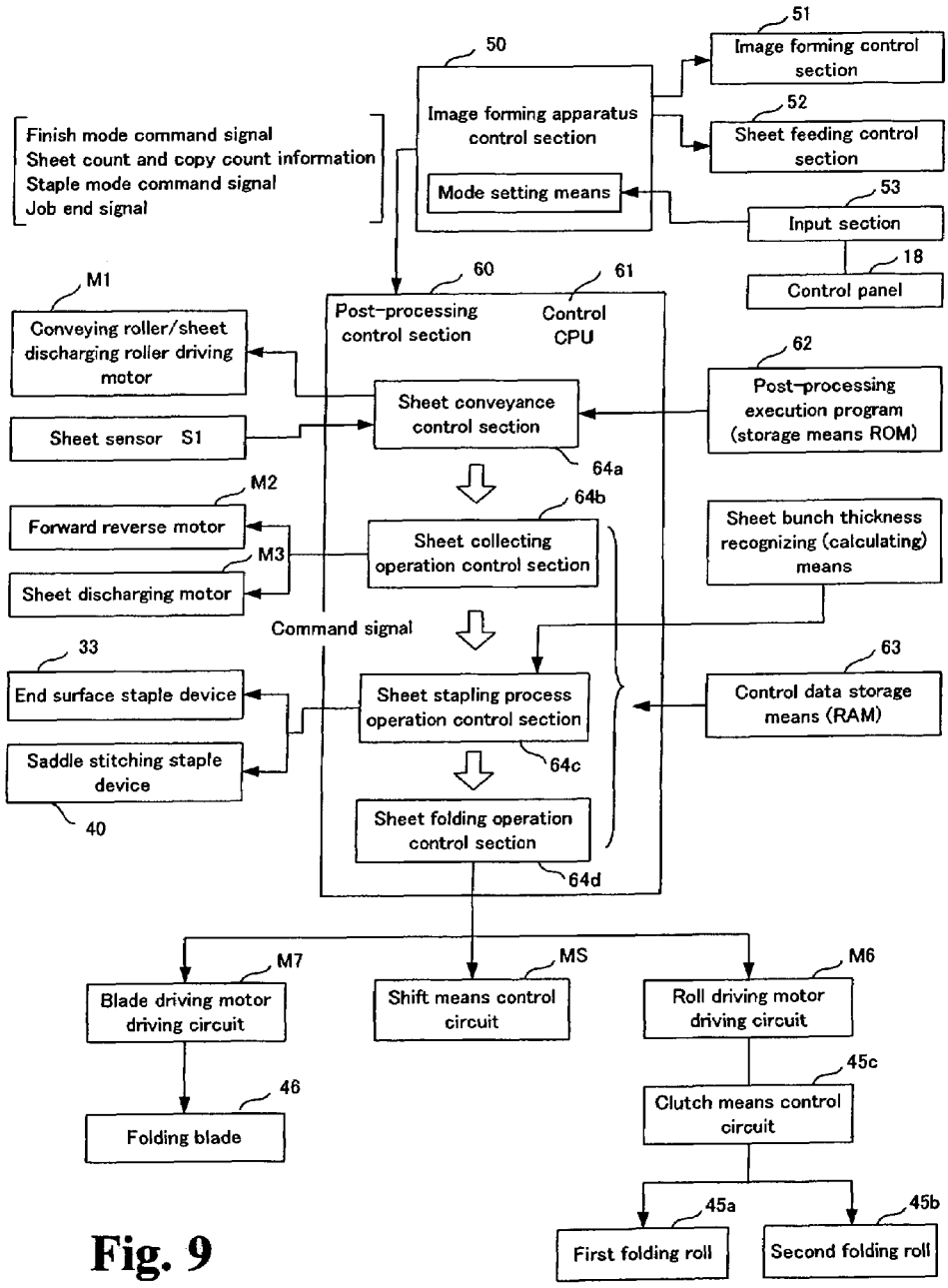
FIG. 9 is a diagram illustrating a control configuration in the system in FIG. 1.
Figure 10A:
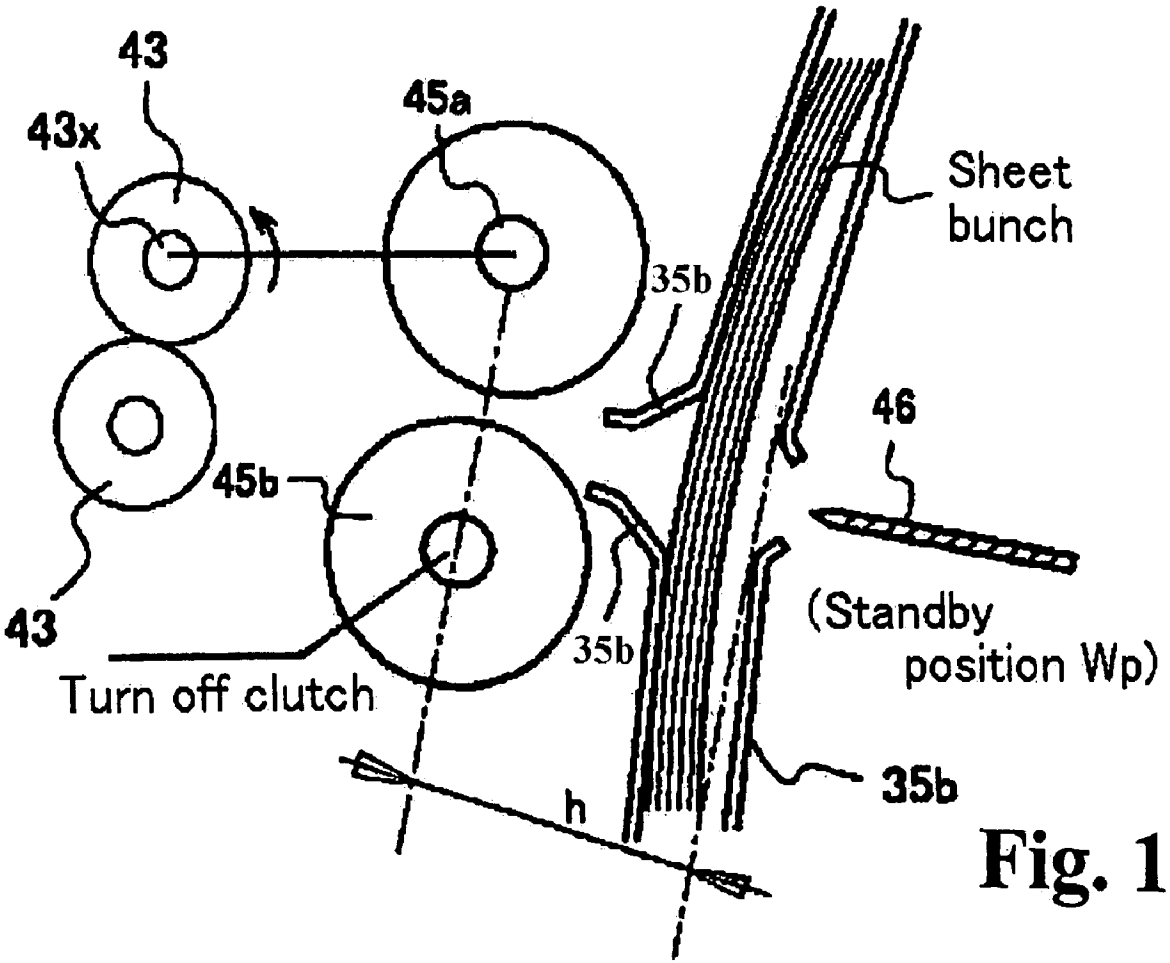
FIG. 10 (*a*) is a state diagram showing that the sheet bunch has been placed and set at the fold position, to describe the sheet bunch folding operation performed by the apparatus in FIG. 2.
Figure 10B:
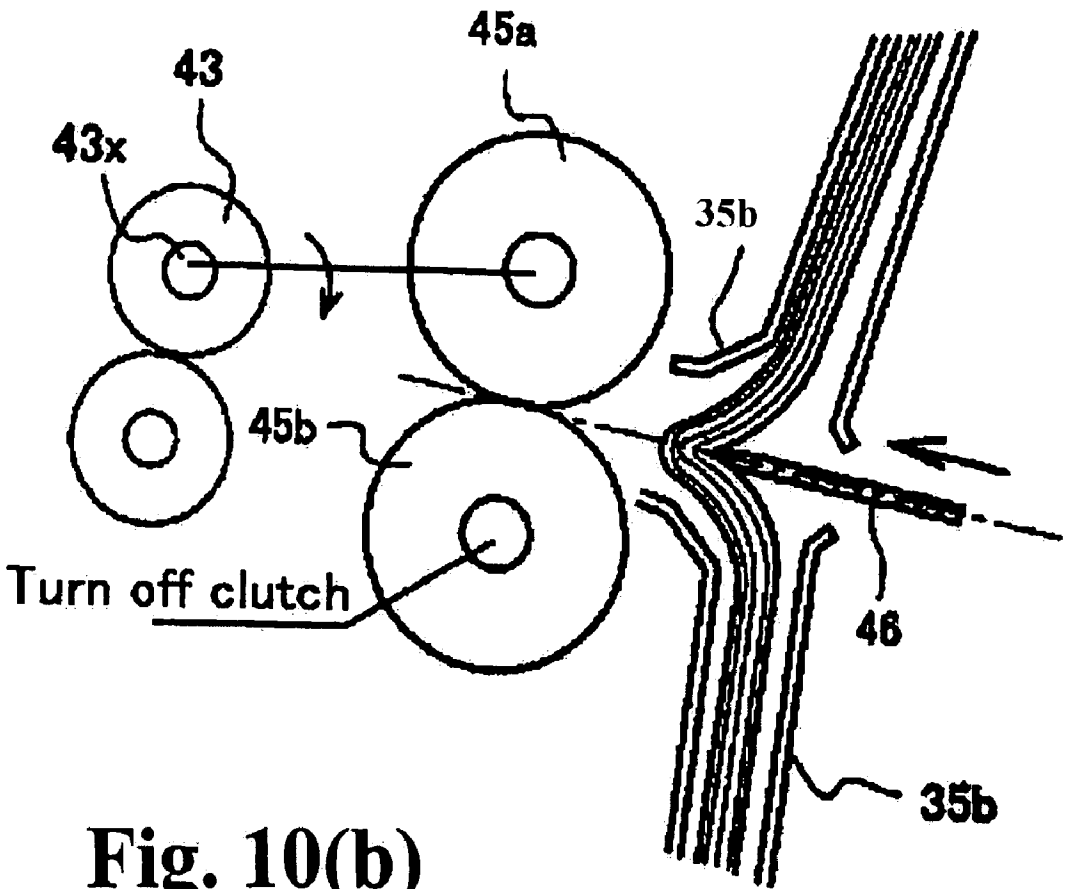
Figure 10C:
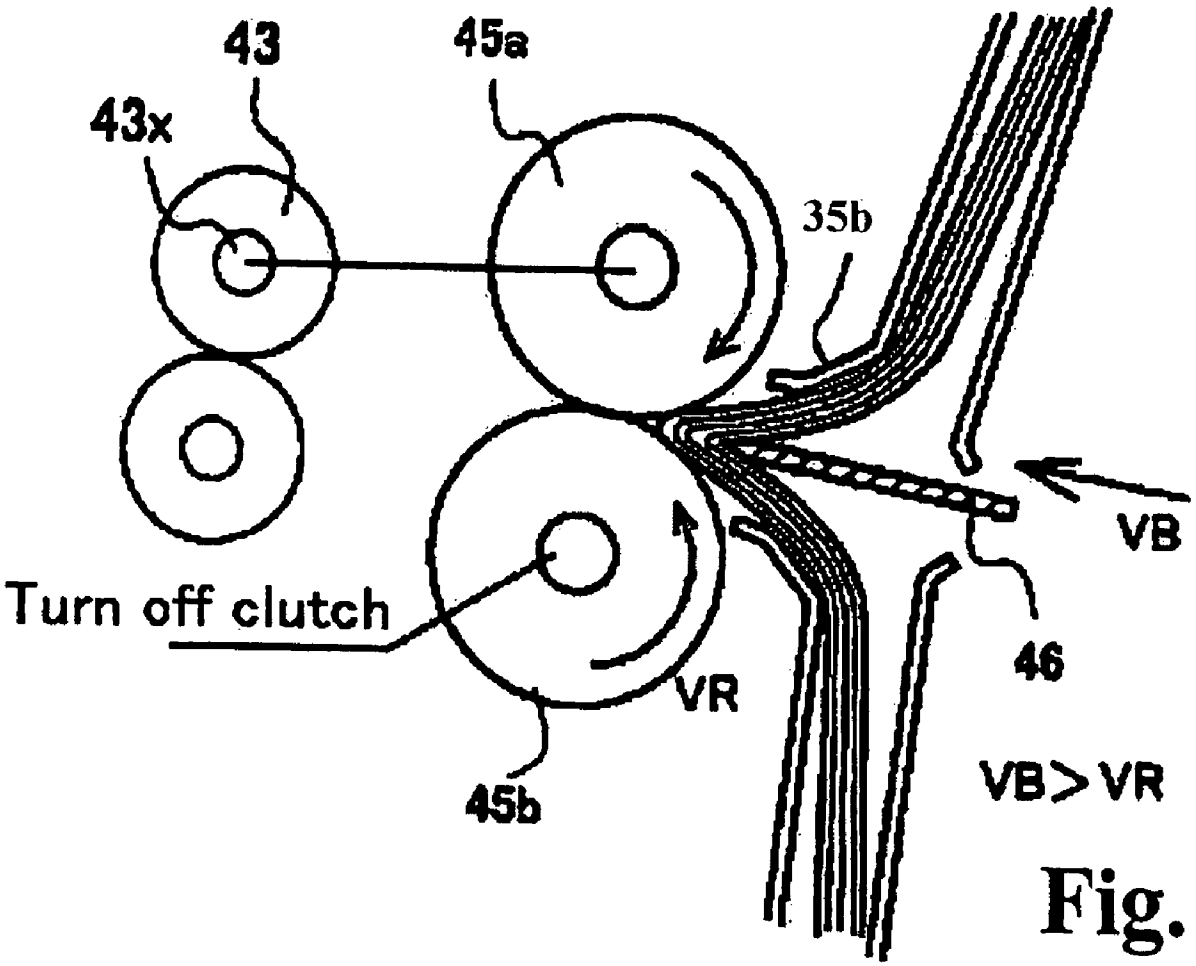
Figure 10D:
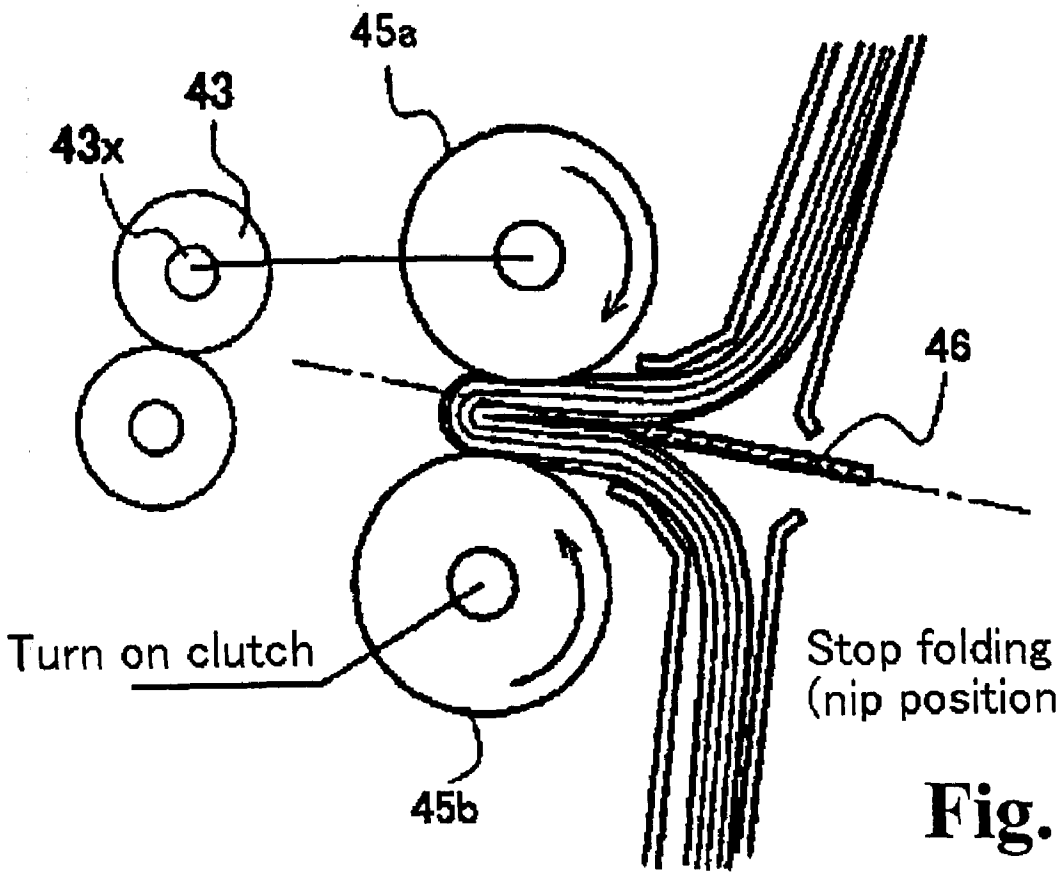
Figure 10E:
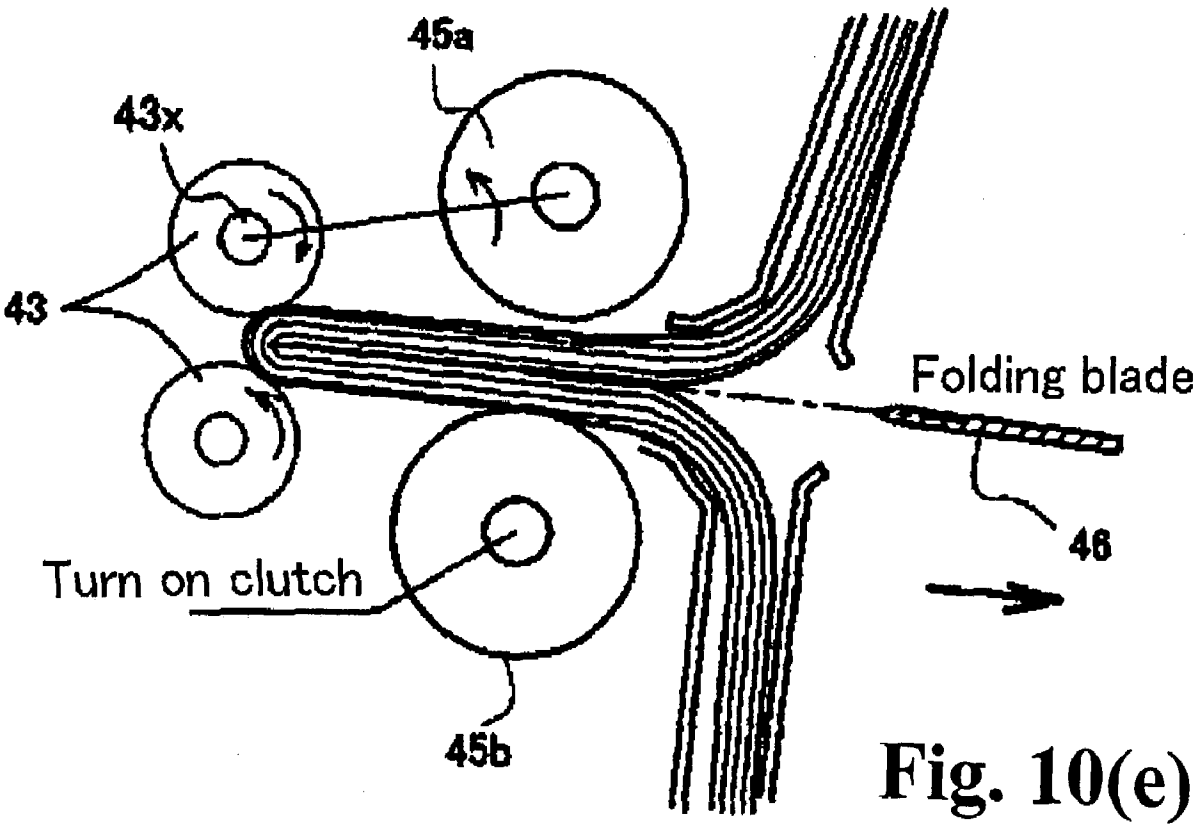

The image forming apparatus A configured as described above has a control section (controller) shown in FIG. 9. Image formation conditions are set via a control panel 18, for example, printout conditions such as a sheet size specification, a color or black-and-white printing specification, a print copy count specification, single- or double-side printing specification, and enlarged or reduced printing specification. On the other hand, in the image forming apparatus A, image data read by the scan unit 13 or transferred through an external network is stored in a data storage section 17. The image data from the data storage section is transferred to a buffer memory 19, which sequentially transfers data signals to the laser light emitter 5.

Further, simultaneously with the image formation conditions, post-processing conditions are input and specified via the control panel 18. For example, a "printout mode", a "stapling mode", and a "sheet bunch folding mode" are specified as the post-processing conditions. The image forming apparatus A formed an image on the sheet in accordance with the image formation conditions and the post-processing conditions. This image forming aspect will be described with reference to FIG. 5. When the "single-side printing" is set as an image formation condition and the "printout mode" or the "stapling mode" is set as a post-processing condition, the image forming section 2 forms a predetermined on a specified sheet. The sheet is turned upside down on the body switchback path 10 and then carried out through the body sheet discharging port 3.

Thus, the image forming apparatus A sequentially forms images on a series of sheets from the first to nth pages. In the post-processing apparatus B receives the sheets carried out in a face down posture, starting with the first page. In the "printout mode", the sheets are sequentially loaded and housed on a first sheet discharging tray 21 located in the post-processing apparatus B. In the "stapling mode", the sheets are loaded and housed on a first collecting section (first sheet collecting means; this also applies to the description below) located in the post-processing apparatus B. The sheets collected on the tray are stapled by end surface staple means 33 in response to a job end signal and then housed in the first sheet discharging tray 21.

Figure 5:
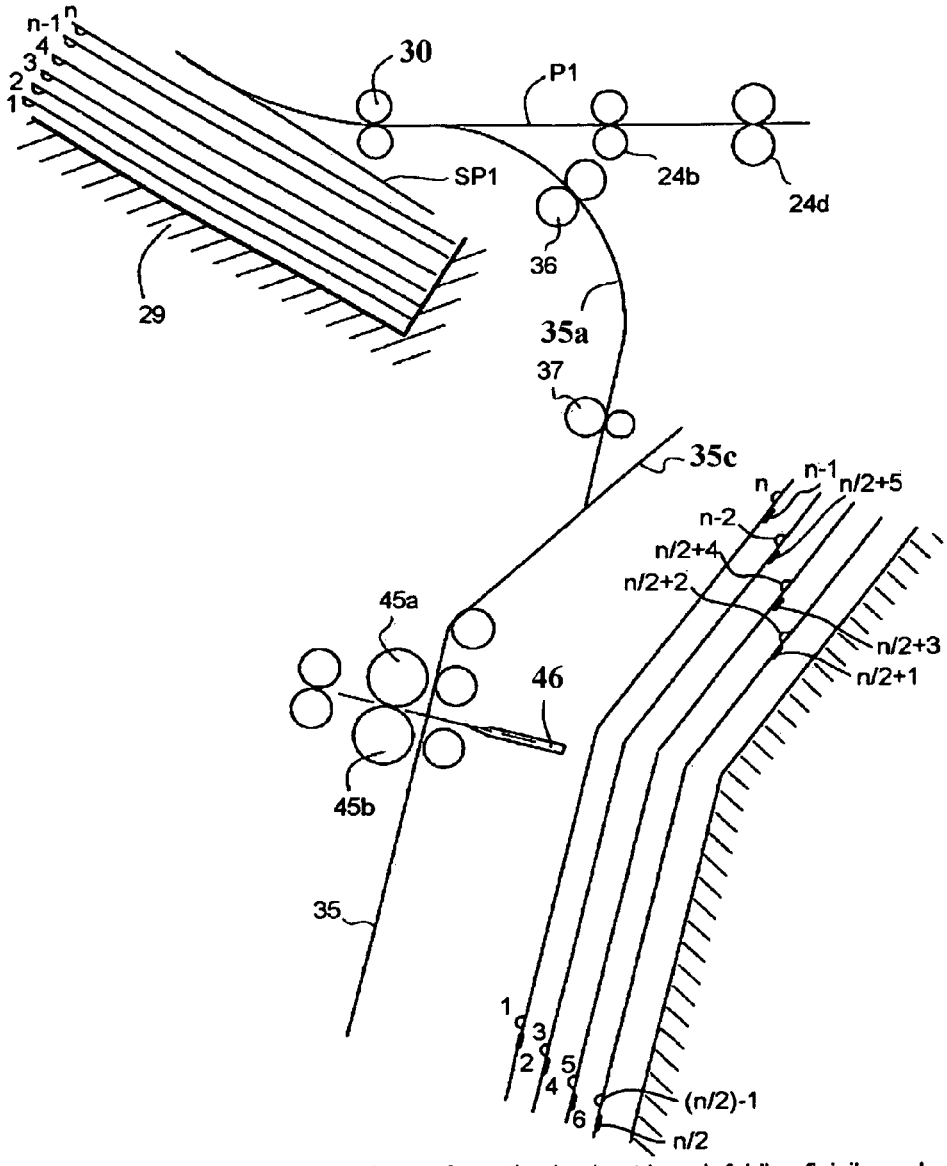
FIG. 5 is a diagram illustrating the order of image formation by the apparatus in FIG. 1.

When the double-side printing and 2in1 printing are specified as image formation conditions and the "sheet folding mode" is set for post-processing, if the final page is the nth page, the image forming apparatus A forms an image for the $(n/2)^{th}$ page and an image for the $(n/2+1)^{th}$ page on a front surface of the first sheet and forms an image for the $(n/2-1)^{th}$ page and an image for the $(n/2+2)^{th}$ page on a back surface of the sheet, as shown in FIG. 5. The image forming apparatus A then carries out the sheet through the sheet discharging port 3. Then, the post-processing apparatus B houses the sheet on a second collecting section (second sheet collecting means; this also applies to the description below) 35 via a sheet carry-in path P1. Then, the image forming apparatus A forms an image for the $(n/2-2)^{th}$ page and an image for the $(n/2+3)^{th}$ page on a front surface of the next sheet and forms an image for the $(n/2-3)^{th}$ page and an image for the $(n/2+4)^{th}$ page on a back surface of the sheet. The image forming apparatus A then carries out the sheet through the sheet discharging port 3. The post-processing apparatus B then stacks the sheet on the first sheet for collection. Thus, the image forming apparatus A forms images in the order suitable for the structure of the collecting tray. For the page order, when image data is transferred from the data storage section 17 to the buffer memory 19, a printing order is calculated and used to control the print head (laser light emitter) 5.

The post-processing apparatus B, coupled to the image forming apparatus A, described above, receives the sheet with an image formed thereon from the body sheet discharging port 3 in the image forming apparatus A, through a carry-in port 23. The post-processing apparatus B then (1) accommodates the sheet on the first sheet discharging tray 21 (the above-described "printout mode"), (2) sets the sheets from the body sheet discharging port 3 into a bunch and staples and houses the sheets on the first sheet discharging tray 21 (the above-described "stapling mode"), or (3) sets the sheets from the body sheet discharging port 3 into a bunch, folds the sheet bunch into a booklet, and houses the sheet bunch on a second sheet discharging tray 22 (the above-described "sheet bunch folding mode").

Thus, as shown in FIG. 2, the post-processing apparatus B has a casing 20 comprising the first sheet discharging tray 21 and the second sheet discharging tray 22, and the sheet carry-in path P1 having the carry-in port 23, connected to the body sheet discharging port 3. The sheet carry-in path P1 is composed of a linear path formed in the casing 20 so as to extend in a substantially horizontal direction. Thus, a first switchback conveying path SP1 and a second switchback conveying path SP2 branch off from the sheet carry-in path P1 so that sheets are transferred in a reverse direction along the first switchback conveying path SP1 and the second switchback conveying path SP2. The first switchback conveying path SP1 and the second switchback conveying path SP2 branch off from the sheet carry-in path P1 so that the first switchback conveying path SP1 is located downstream, whereas the second switchback conveying path SP2 is located upstream. The second switchback conveying path SP2 downwardly extends from the sheet carry-in path P1 to the end. The two conveying paths are located away from and opposite each other.

Further, as shown in FIG. 2, the outer cover (casing) 20 has an opening and closing cover 20*c* shown in FIG. 21 and forming an opening for maintenance of saddle stitching staple means 40 described below. The end surface staple means 33 is located on a first collecting section 29, and the saddle stitching staple means 40 is located on the collecting guide 35. In the staple means, the end surface staple means 33 is located above and the saddle stitching staple means 40 is located below so that the staple means 33 and 40 are positioned adjacent to each other in a vertical direction.

As described above, the opening and closing cover is located at the intermediate position between the first sheet discharging tray 21 and the second sheet discharging tray 22, which are arranged in the vertical direction, so that the saddle stitching staple means 40, stapling the sheet traveling to the lower second sheet discharging tray 22, can be maintained through the opening and closing cover. This allows the saddle stitching staple means 40 to be easily maintained through the opening and closing cover 20*c*. In this case, a work area is provided by removing the sheets loaded on the lower second sheet discharging tray 22. Thus, the relevant structure is simple and a maintenance operation can be easily performed.

Furthermore, the upper one of the two vertically arranged sheet discharging trays, the first sheet discharging tray 21, is configured to be able to elevate and lower in the vertical direction, and the opening and closing cover is located within an elevating and lowering trajectory of the first stack tray so that the saddle stitching staple means 40 for the sheet traveling to the second sheet discharging tray 22 can be maintained through the opening and closing tray. Thus, during the maintenance operation, the work area can be provided by moving the first stack tray above or below the opening and closing cover. The maintenance operation can then be safely and easily performed. This allows a small-sized, compact apparatus to be constructed.

The opening and closing cover 20*c* can be easily opened and closed by using a needle empty signal or an inappropriate operation signal from the saddle stitching staple means 40 to retract the first sheet discharging tray 21 above or below the opening and closing cover 20*c*.

In this path configuration, a carry-in roller 24 (REFERENCE NUMERAL 24 SHOULD BE DESIGNATED IN FIG. 2) and a sheet discharging roller 30 are arranged on the sheet carry-in path P1. The rollers are coupled to a forward reversible drive motor M1 (not shown). The sheet carry-in path P1 has a path switching piece 27 located on the switchback conveying path SP2 to guide sheets and coupled to actuating means such as a solenoid. The sheet carry-in path P1 also has a post-processing unit 28 which is located between a carry-in roller 24(*a*) succeeding the carry-in port 23 and a carry-in roller 24(*b*) lying behind the post-processing unit 28 to execute post-processing by using a sheet sensor S1 to detect the trailing end of a sheet from the carry-in port 23, the post-processing unit 28 is, for example, stamp means for executing a stamping process using a detection signal from the sheet sensor S1 or a punch means for executing a punching process using the detection signal from the sheet sensor S1. The illustrated post-processing unit 28 is located at the carry-in port 23 upstream of the paired front and back carry-in rollers 24 (24*a* and 24*b*) so as to be able to be removed from and installed back in the casing 20 depending on the apparatus specifications.

The sheet carry-in path P1 has a sheet locking member (buffer guide) 26 located upstream of a branching path (at the position of the path switching piece 27) from the second switchback conveying path SP2, to temporarily hold the sheet traveling to the second switchback conveying path SP2, as shown in detail in FIG. 10 described below. The configuration and operation of the sheet locking member 26 will be described below.

The first switchback conveying path SP1, located downstream of the sheet carry-in path P1 (closer to a trailing end of the apparatus) as described above, is configured as follows. As shown in FIG. 3, the sheet carry-in path P1 has the sheet discharging roller 30 and a sheet discharging port 25 at an outlet end thereof, as well as the first collecting section 29 located below the sheet discharging port 25*a* via a step. The first collecting section 29 is composed of a tray (hereinafter referred to as the "collecting tray 29") on which sheets from the sheet discharging port 25 are loaded and supported. A forward reverse roller ' is located above the collecting tray 29 so as to be able to elevate and lower between a position where the forward reverse roller ' comes into contact with the sheets on the roller and a standby position (shown by a chain line in FIG. 3) where the forward reverse roller 30' is separated from the sheets. A forward reverse motor M2 is coupled to the forward reverse roller 30' and controlled so as to rotate clockwise in the figure when the sheet reaches the collecting tray 29 and to rotate counterclockwise after the trailing end of the sheet reaches the tray. Accordingly, the first switchback conveying path SP1 is constructed on the collecting tray 29. A caterpillar belt 31 is supported by shafts so as to be able to roll freely so that a one end pulley side of the caterpillar belt 31 is in pressure contact with the sheet discharging roller 30, while a leading end pulley side of the caterpillar belt 31, hanging from a pulley shaft 31*a*, reaches the collecting tray 29. A driven roller 30'*b*, which engages the forward reverse roller 30' is provided on the collecting tray 29.

Further, the first sheet discharging tray 21 is located downstream of the switchback conveying path SP1 to support the leading end of sheets guided to the first switchback conveying path SP1 and the second switchback conveying path SP2.

With the above-described configuration, the sheet from the sheet discharging port 25 reaches the collecting tray 29 and is transferred toward the first sheet discharging tray 21 by the forward reverse roller 30'. Once the trailing end of the sheet from the sheet discharging port 25 reaches the collecting tray 29, the forward reverse roller 30' is reversely rotated (counterclockwise in the figure) to transfer the sheet on the collecting tray 29 in a direction opposite to a sheet discharging direction. At this time, the caterpillar belt 31' cooperates with the forward reverse roller 30' in switching back and transferring the trailing end of the sheet along the collecting tray 29.

A trailing end regulating member 32 and the end surface staple means 33 is located at a trailing end of the collecting tray 29, the trailing end regulating member 32 regulates the position of the sheet trailing end. The illustrated staple means 33 is composed of an end surface stapler and staples the sheet bunch collected on the tray at one or more positions. The trailing end regulating member 32 is also used to provide a function of carrying out the stapled sheet bunch to the first sheet discharging tray 21, located downstream of the collecting tray 29. The trailing end regulating member 32 is configured to be able to reciprocate in the sheet discharging direction along the collecting tray 29. A carry-out mechanism of the illustrated trailing end regulating member 32 comprises a grip pawl 32*a* that grips the sheet bunch and a trailing end regulating surface 32*b* against which the sheet trailing end abuts for regulation. The carry-out mechanism is configured to be movable in the lateral direction of the figure along a guide rail provided on an apparatus frame. A Driving arm 34*a* reciprocating the trailing end regulating member 32 and coupled to a sheet discharging motor M3 is provided.

The collecting tray 29 has a side aligning plate 34*b* with which the sheets collected on the tray align in the width direction. The side aligning plate 34*b* is composed of a lateral (the front to back of the device in FIG. 3) pair of aligning plates configured to approach and leave the sheet center. The side aligning plate 34*b* is coupled to an aligning motor.

In the "stapling mode", along the first switchback conveying path SP1 configured as described above, the sheets from the sheet discharging port 25 are set on the collecting tray 29. The sheet bunch is then stapled at one or more positions at the trailing edge thereof by the end surface staple means 33. In the "printout mode", a sheet from the sheet discharging port 25, the sheet fed along the collecting tray 29 is passed between the forward reverse roller 30' and the driven roller 30*b* and carried out to the first sheet discharging tray 21. Thus, the illustrated apparatus is characterized in that the sheet to be stapled is bridged between the collecting tray 29 and the first sheet discharging tray 21 to allow the apparatus to be compactly configured.

Figure 4:
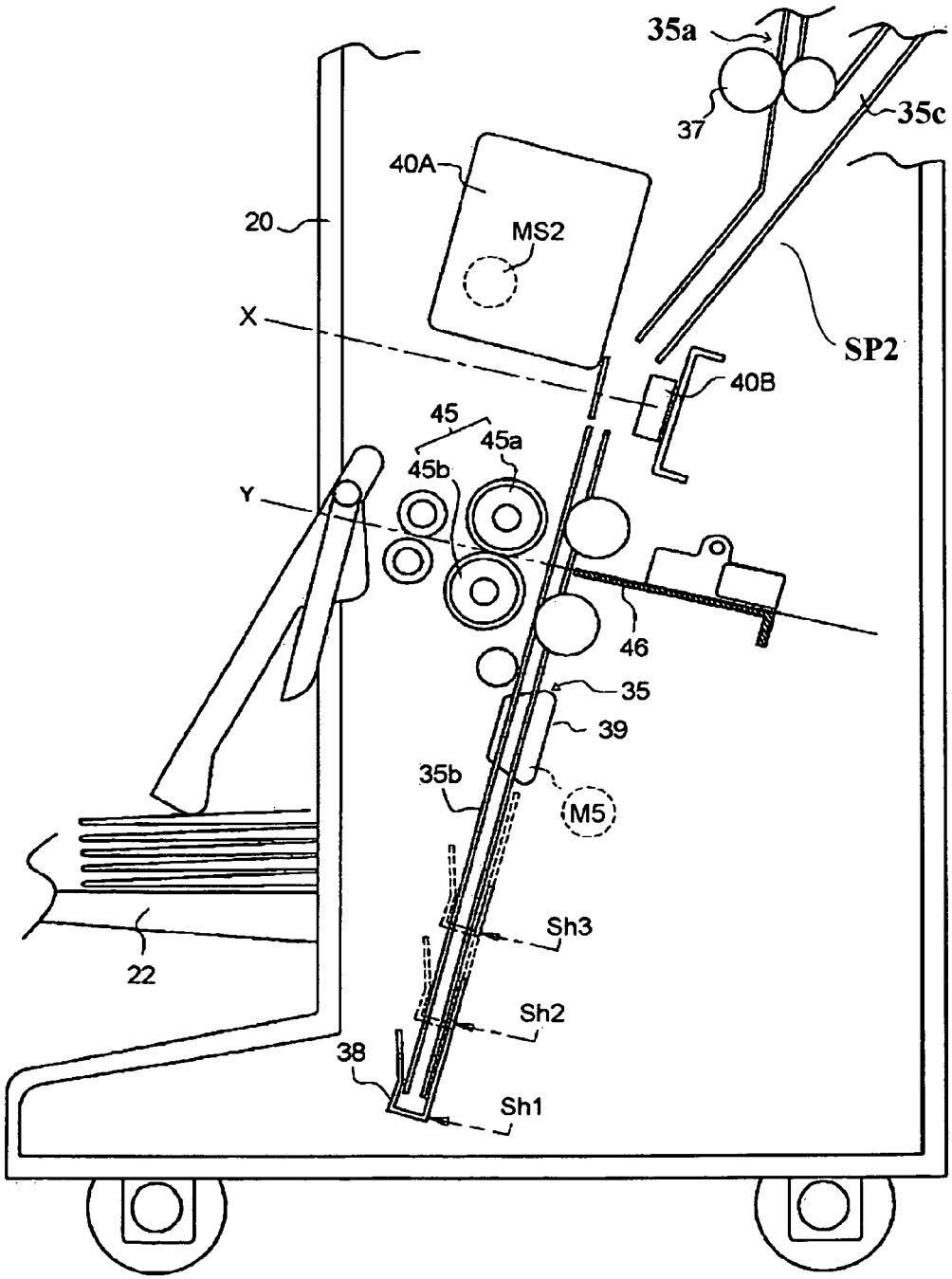
FIG. 4 is a detailed diagram of the sheet folding device incorporated into the post-processing apparatus.

Now, description will be given of the configuration of the second switchback conveying path SP2, branching off from the sheet carry-in path P1, as shown in FIGS. 3 and 4. As shown in FIGS. 3 and 4, the second switchback conveying path SP2 is located in a substantially vertical direction with respect to the apparatus casing 20. A conveying roller 36 is located at an inlet of the second switchback conveying path SP2 (a sheet approaching path 35*a*). A conveying roller 37 is located at an outlet of the sheet approaching path 35*a*. The second collecting section 35, which sets the sheets fed along the conveying path SP2, is provided downstream of the second switchback conveying path SP2. As shown in FIG. 4, the second collecting section 35 is composed of a conveying guide (collecting guide) that transfers the sheets (the second collecting section 35 is hereinafter referred to as the "collecting guide 35"). The saddle stitching staple means 40. (40*a* and 40*b*) and folding roll means 45 are arranged on the collecting guide 35. The configuration of these components will be sequentially described below.

As shown in FIG. 3, the conveying roller 36, located at the inlet of the second switchback conveying path SP2, is configured to be rotatable forward and backward, respectively. A sheet carried into the first switchback conveying path SP1, located downstream, is temporarily held (temporarily reside) on the second switchback conveying path SP2. The reason for the temporary holding is as follows. The preceding sheets are collected on the collecting tray 29 and are then stapled in response to the job end signal. The sheet fed to the sheet carry-in path P1 while the sheet bunch is being carried out to the first sheet discharging tray 21 is temporarily held on the second switchback conveying path SP2. Then, after the processing of the preceding sheets is finished, the standing-by sheet is conveyed from the first switchback conveying path SP1 onto the collecting tray 29. The effects of this operation will be described below.

As shown in FIG. 4, the collecting guide 35 is formed of a guide member that guides the sheet being conveyed. The collecting guide 35 is configured so that the sheets are loaded and housed thereon. The illustrated collecting guide 35 is connected to the second switchback conveying path SP2 and located in a central part of the apparatus casing 20 in the substantially vertical direction. This allows the apparatus to be compactly configured. The collecting guide 35 is shaped to have an appropriate size to house maximum sized sheets. In particular, the illustrated collecting guide 35 is curved or bent so as to project toward the area in which the saddle stitching staple means 40 and folding roll means 45, described below, are arranged.

A switchback approaching path 35*c* is connected to a conveying direction trailing end of the collecting guide 35, the switchback approaching path 35*c* overlaps the outlet end of the sheet approaching path 35*a*. This is to allow the trailing end of the carried-in (succeeding) sheet fed from the conveying roller 37 on the second switchback conveying path SP2 to overlap the trailing end of the loaded (preceding) sheets supported on the collecting guide 35 to ensure the page order of the collected sheets. A leading end regulating member 38 regulating the sheet leading end is located downstream of the collecting guide 35. The leading end regulating member 38 is supported by a guide rail so as to be movable along the collecting guide 35. The leading end regulating member 38 is moved between positions Sh1 and Sh2 and Sh3, shown in the figure, by shift means MS.

When the leading end regulating member 38 is placed at the illustrated position Sh3, the trailing end of the sheet (sheet bunch) supported on the collecting guide 35 enters the switchback approaching path 35*c*. In this condition, the succeeding sheet fed through the second switchback conveying path SP2 is reliably stacked on the collected sheets. When the leading end regulating member 38 is placed at the illustrated position Sh2, the center of the sheets (sheet bunch) supported on the collecting guide 35 is placed at a staple position X on the saddle stitching staple means 40, described below. Likewise, when the leading end regulating member 38 is placed at the illustrated position Sh1, the sheet bunch is stapled and the center of the sheet bunch supported on the collecting guide 35 is placed at a fold position Y on the folding roll means 45. Thus, the illustrated positions Sh1, Sh2, and Sh3 are set at the optimum positions depending on the sheet size (conveying-direction length).

A sheet side edge aligning member 39 is located on a downstream side of the collecting guide 35 in the sheet conveying direction. The sheet side edge aligning member 39 aligns, with a reference, the width-direction position of the sheets carried into the collecting guide 35 and supported on the leading end regulated member 38. That is, with the leading end regulating member 38 placed at the position Sh3 and the whole sheets supported on the collecting guide 35, side edges of the sheets are aligned with the sheet side edge aligning member 39. Since the illustrated apparatus aligns the sheets using the sheet center as a reference, the sheet side edge aligning member 39 is composed of a lateral pair of aligning plates, the aligning plates are arranged at an equal distance from the sheet center as a reference to align the sheet bunch supported on the collecting guide 35. Thus, an aligning motor M5 is coupled to the sheet side edge aligning member 39.

The staple position X and the fold position Y are set on an upstream side and a downstream side, respectively, along the collecting guide 35. The saddle stitching staple means 40 is located at the staple position X. The saddle stitching staple means is composed of a driver unit 40A and an anvil unit 40B which are separately arranged opposite to each other and across the collecting guide 35. A needle cartridge is installed on the driver unit 40A and contains needles coupled together like a band. A driver member moves upward and downward between a top dead center and a bottom dead center to allow a former member to fold the needle at the leading end into a U shape. The needle is then stuck into the sheet bunch. The driver unit 40A thus comprises a drive motor MS2 (AS DEPICTED IN FIG. 4), a driving arm that moves the driver member upward and downward, and a driving cam that drives the arm.

A folding groove is formed in the anvil unit 40B such that the tip of the staple needle stuck into the sheet bunch is folded in the folding groove. In the saddle stitching staple means 40 configured as described above, the driver unit 40A and the anvil unit 40B are separately arranged opposite to each other so that the sheet bunch can pass between the units 40A and 40B. This enables the sheet bunch to be stapled at the center or any other desired position.

Figure 6A:
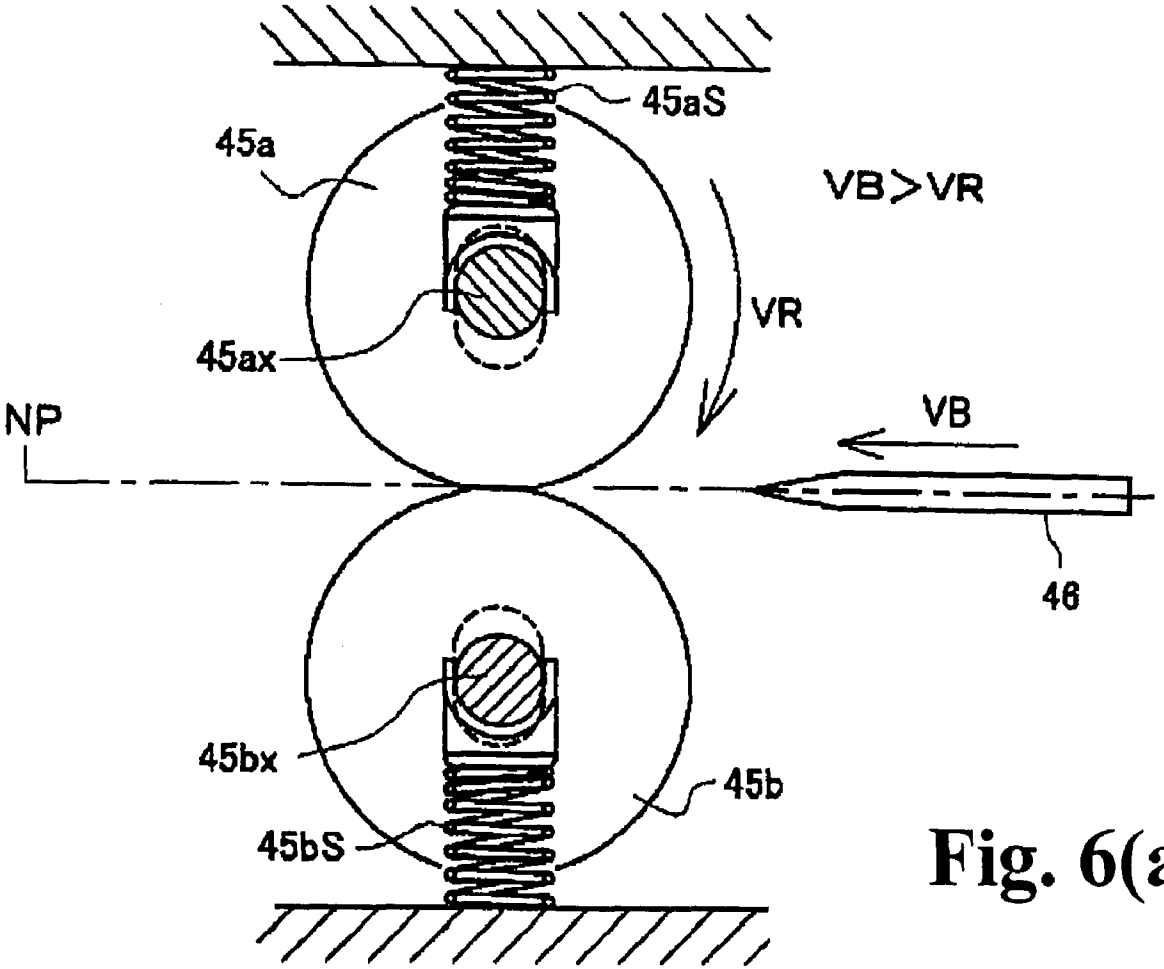
FIG. 6(*a*) is a diagram illustrating the sectional structure of folding roll means in FIG. 4.
Figure 6B:
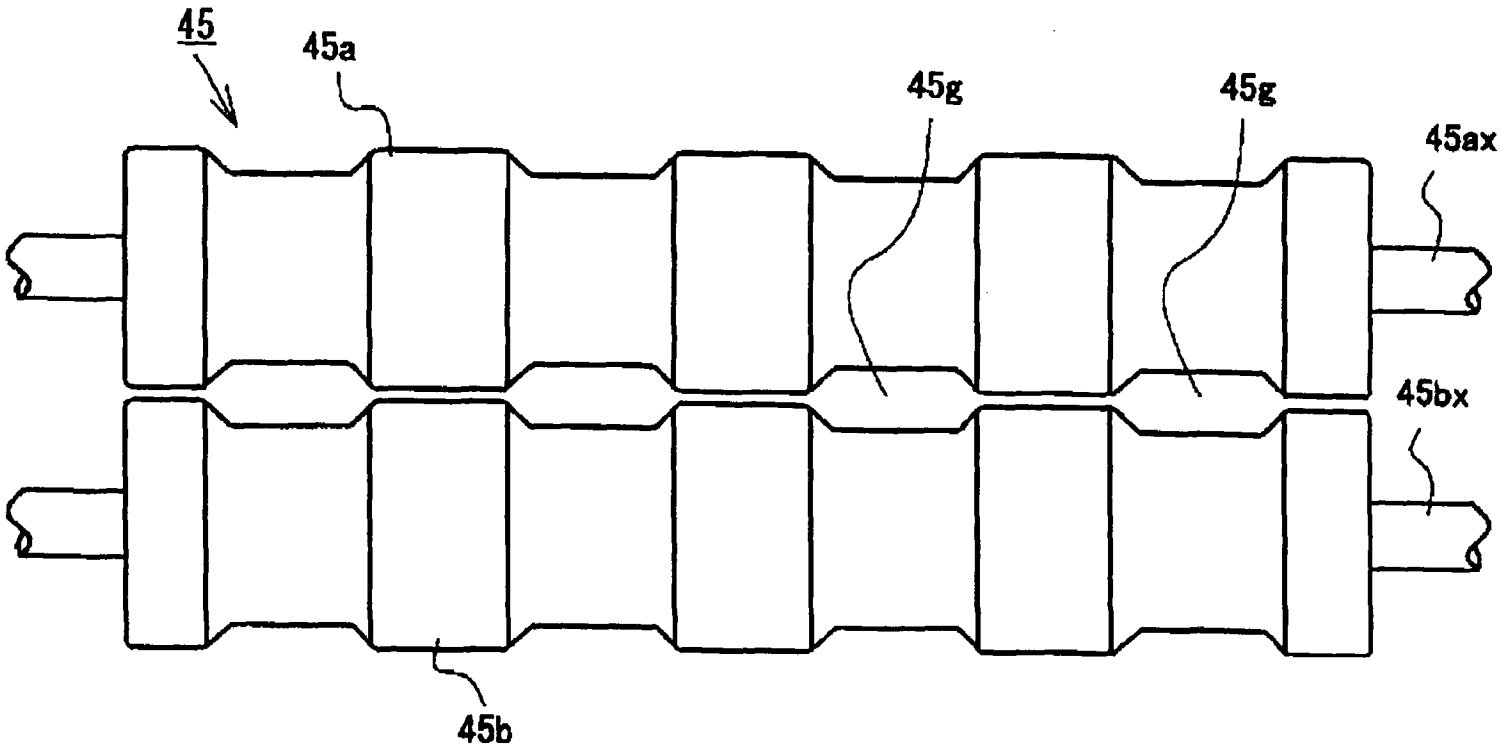
Figure 6C:
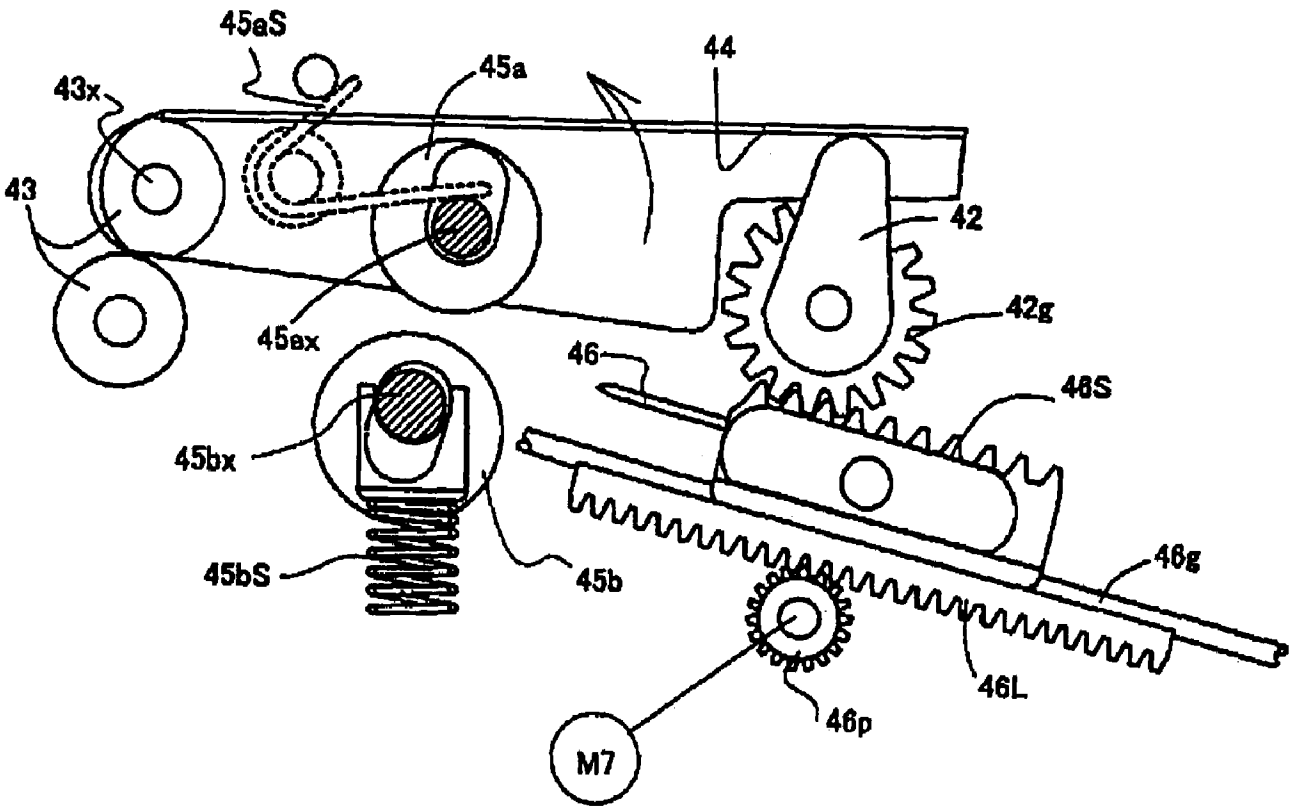
Figure 7A:
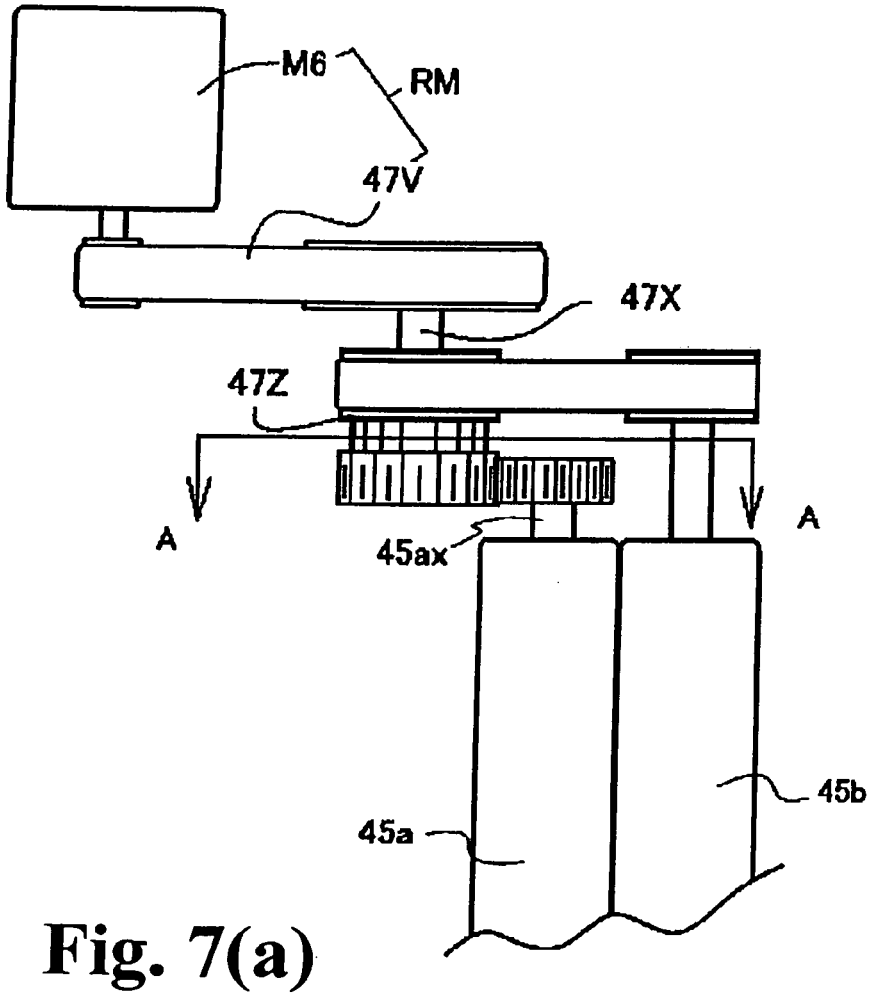
FIG. 7(*a*) is a diagram illustrating a driving mechanism for the folding roll means.
Figure 7B:
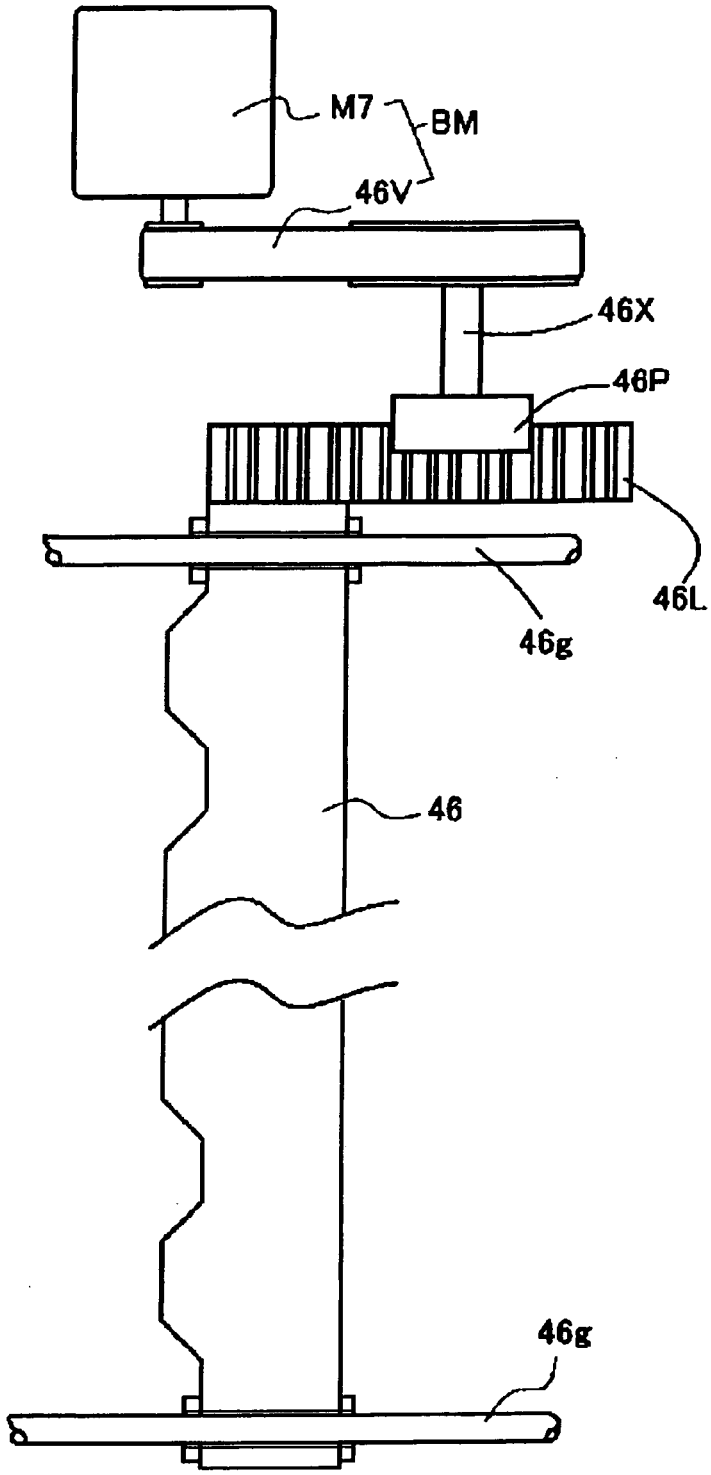
Figure 7C:
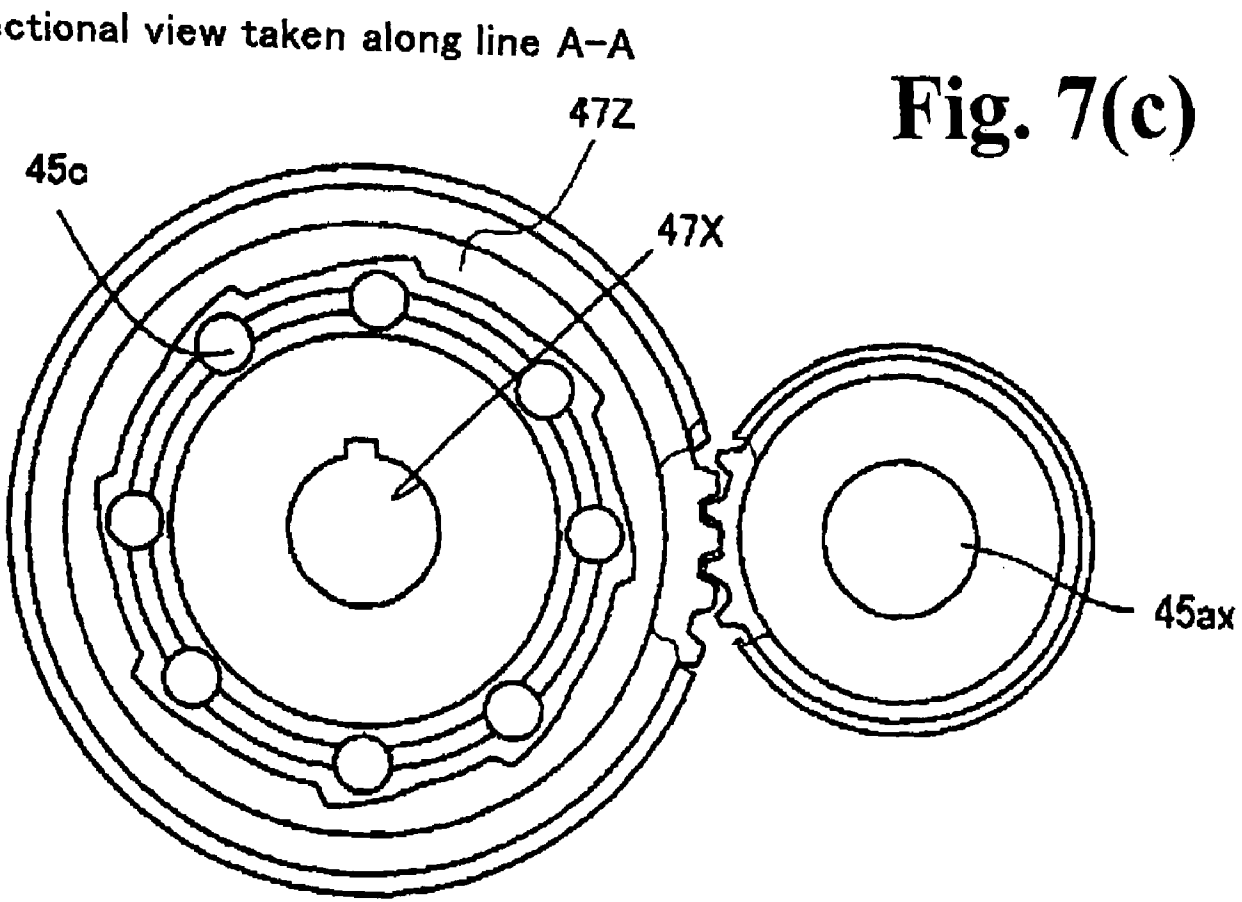
Figure 7D:
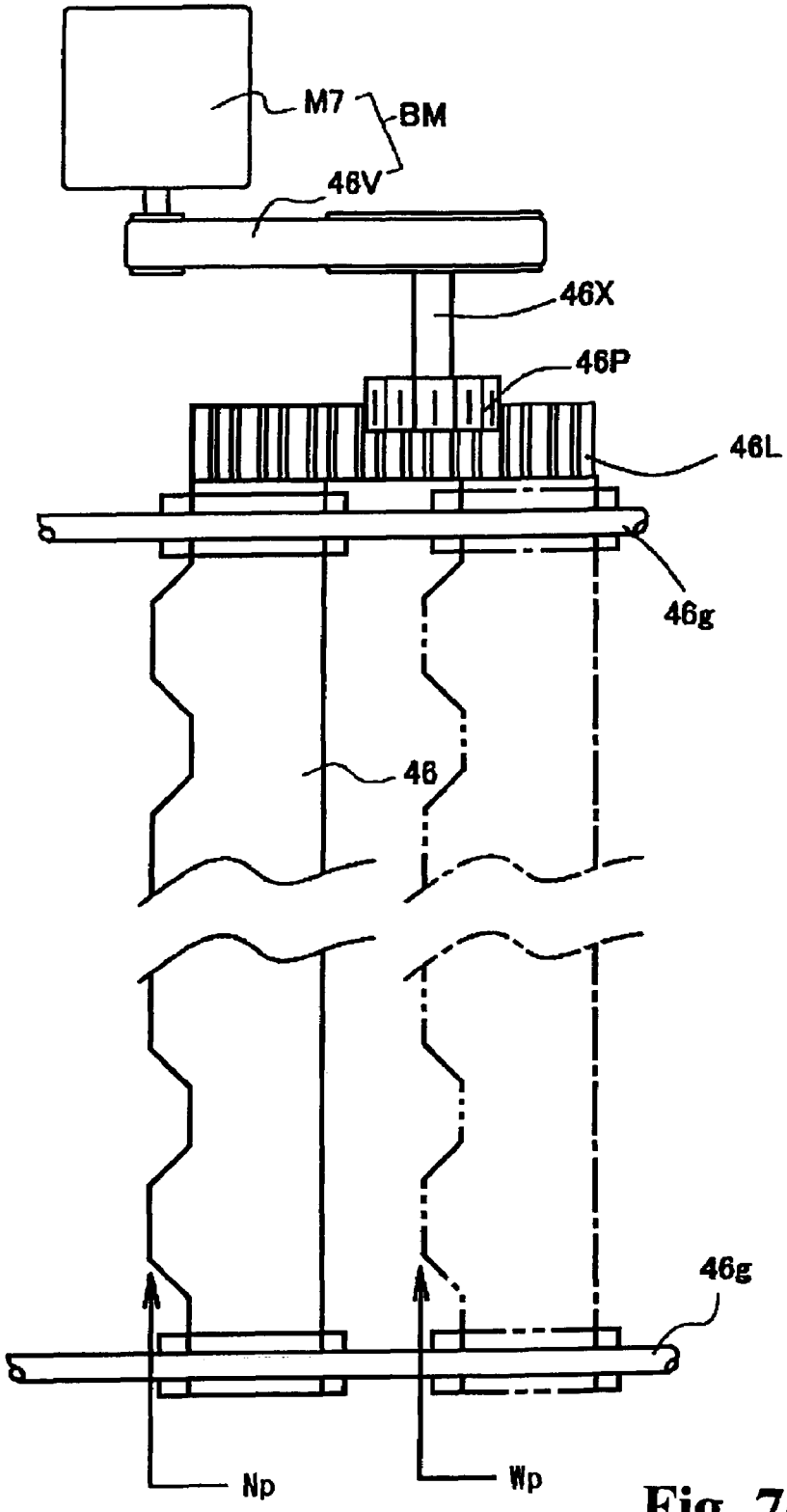
Figure 8A:
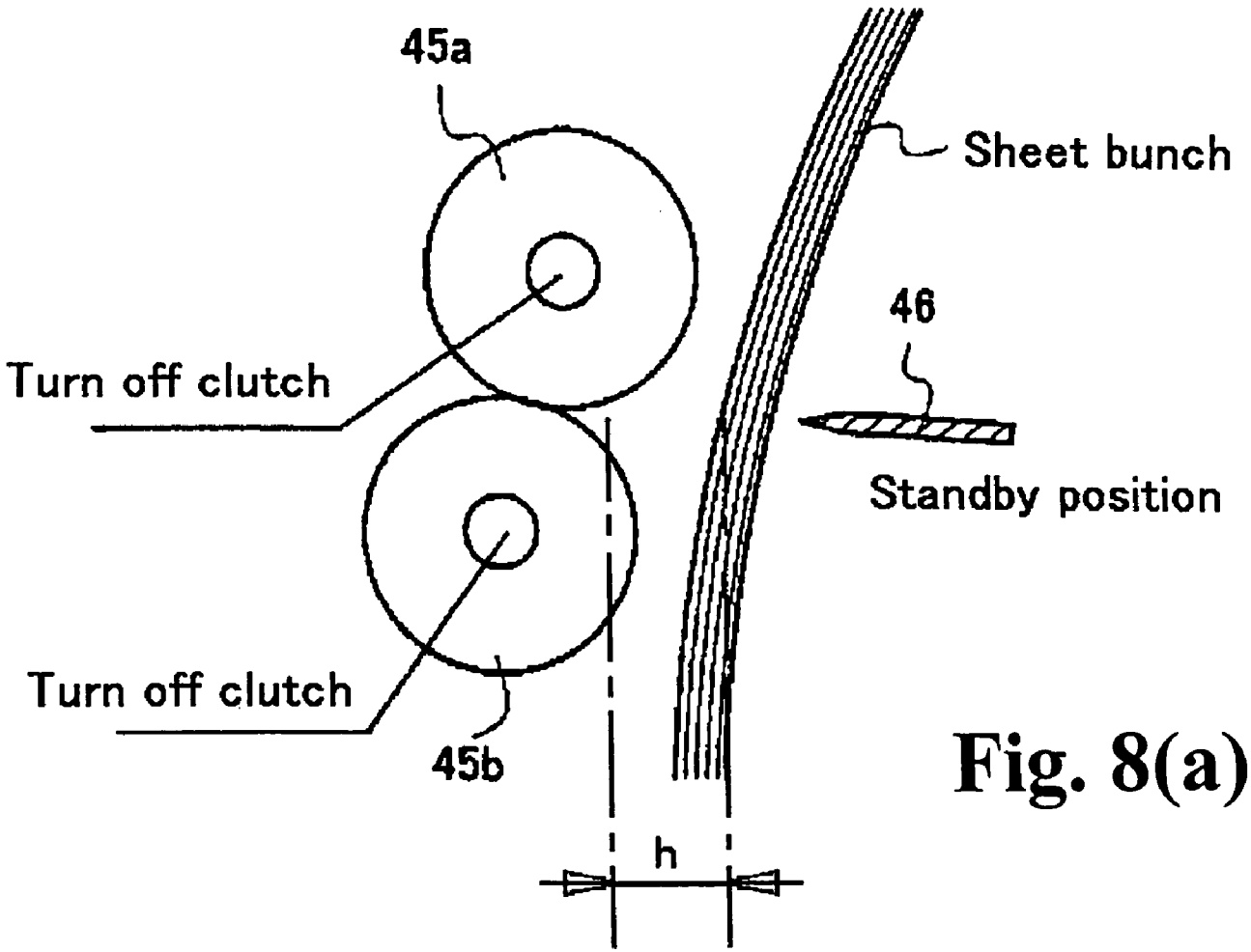
FIG. 8(*a*) is a state diagram showing that a sheet bunch has been placed and set at a fold position, to describe a sheet bunch folding operation performed by the apparatus in FIG. 2.
Figure 8B:
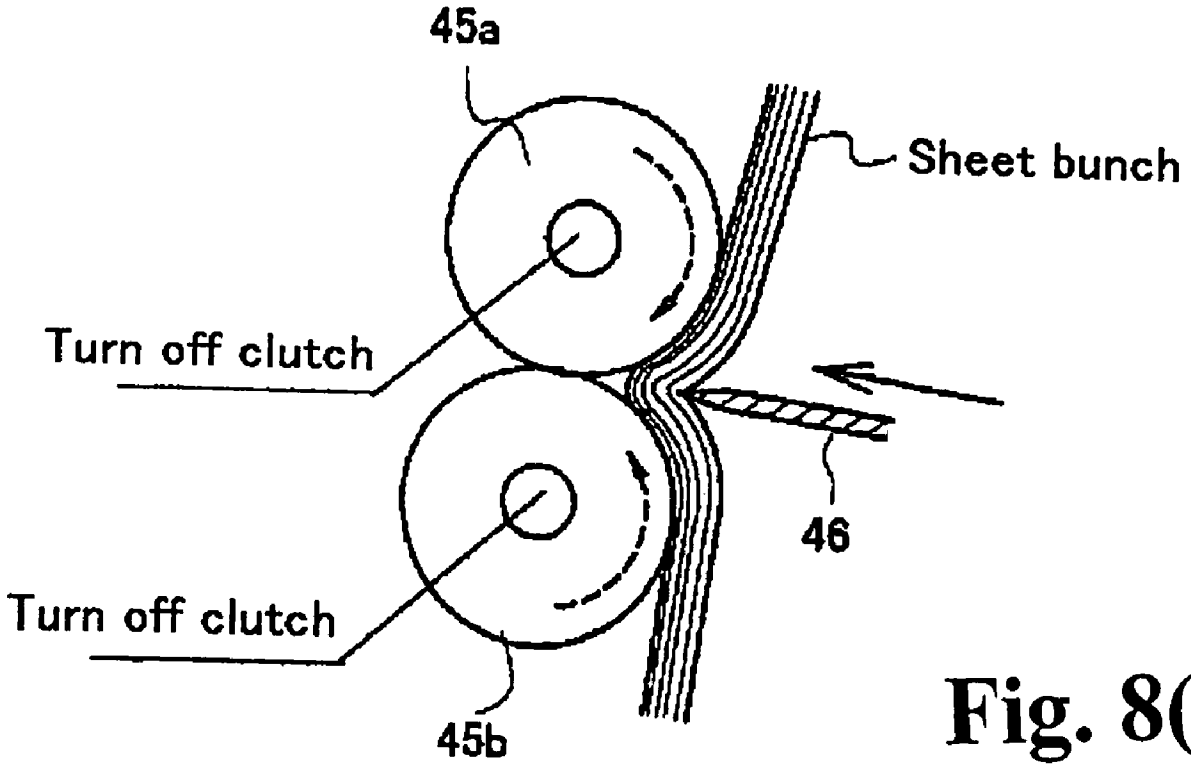
Figure 8C:
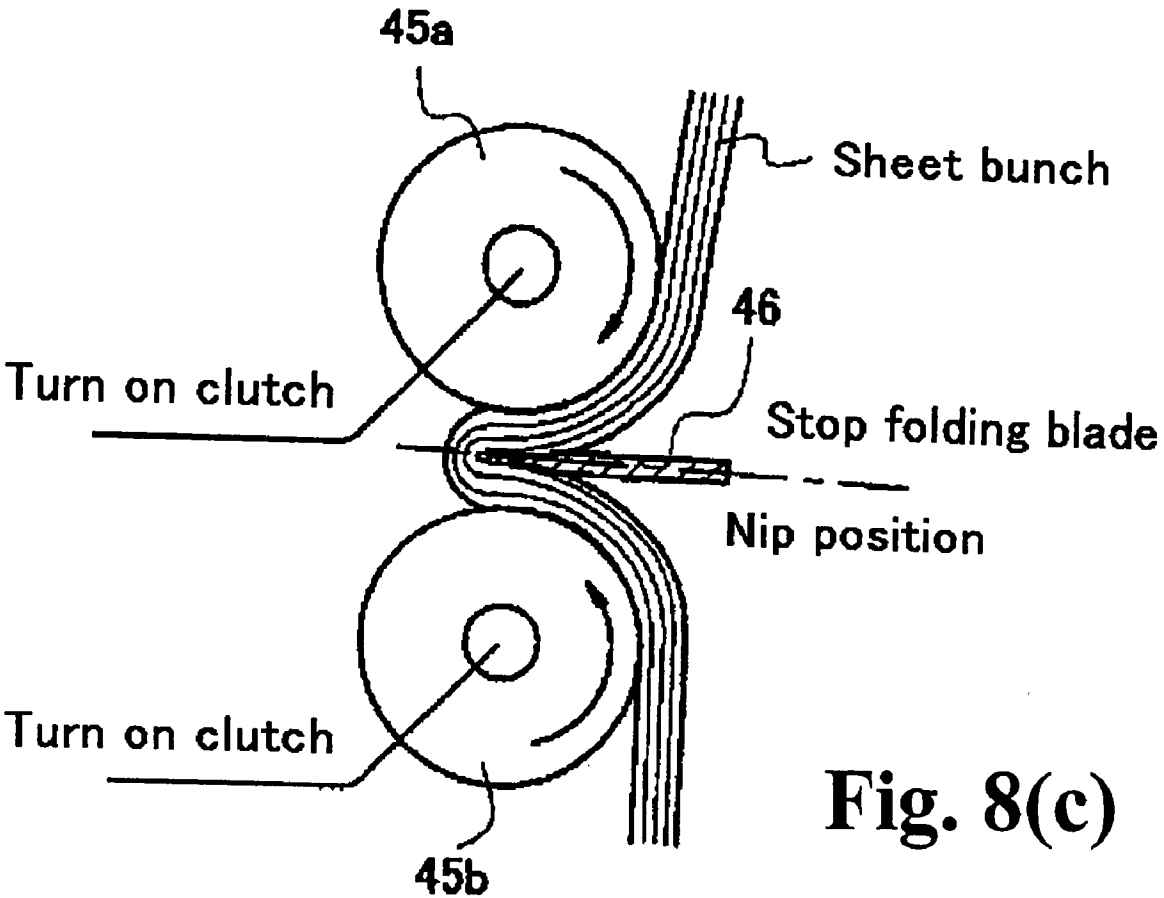
Figure 8D:
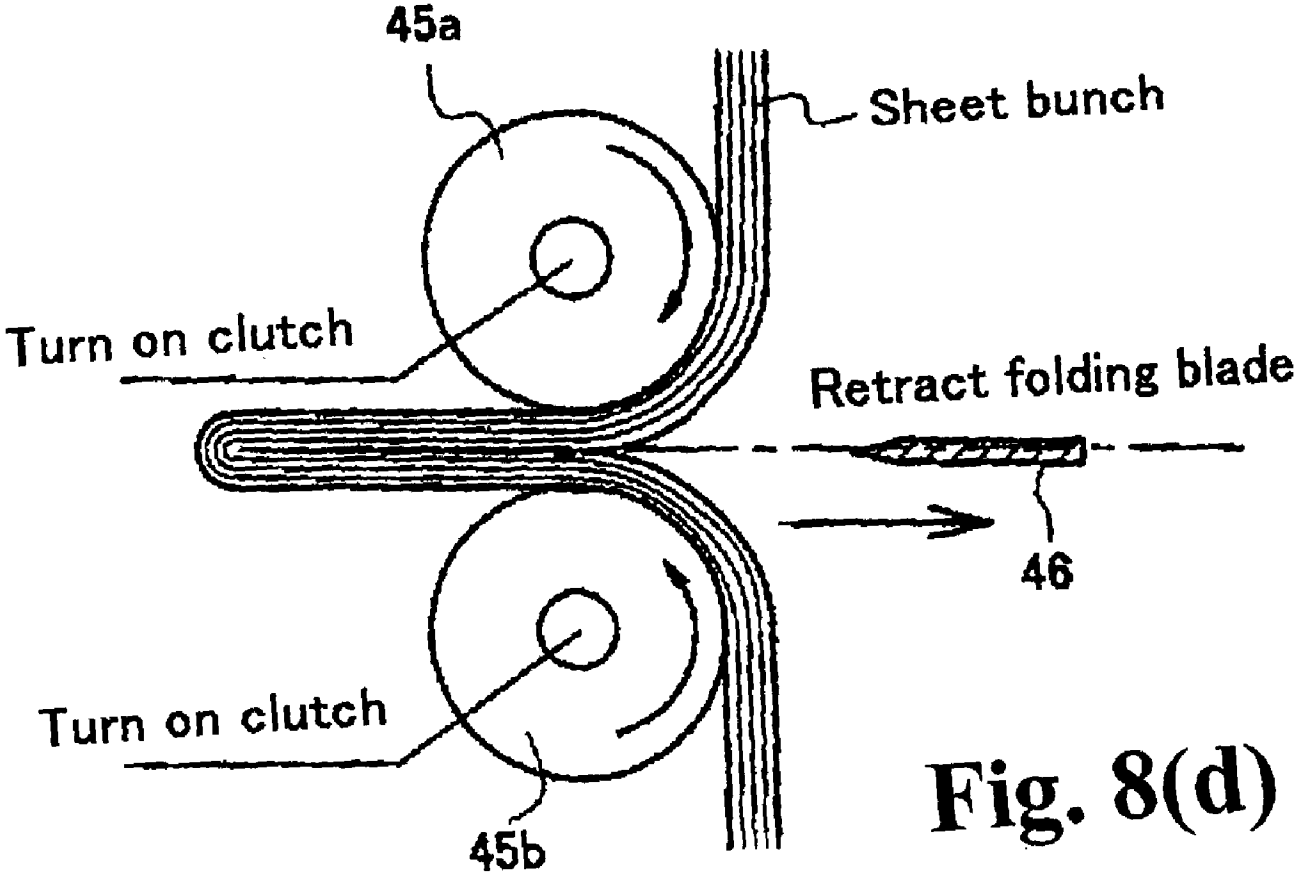

The folding roll means 45 and a folding blade 46 are provided at the fold position X, located on the downstream side of the staple means 40, the folding roll means folds the sheet bunch and the folding blade 46 inserts the sheet bunch into a nip position NP (shown in FIG. 6(*a*) on the folding roll means 45. As shown in FIGS. 6(*a*) and 6(*b*), the folding roll means 45 is composed of rolls 45*a* and 45*b* that are in pressure contact with each other and each of which is formed to have a width substantially equal to that of the maximum sized sheet. The paired rolls 45*a* and 45*b* have respective rotating shafts 45*ax* and 45*bx* fitted in long grooves in the apparatus frame so as to be in pressure contact with each other. The rolls 45*a* and 45*b* are biased in a pressure contact direction by compression springs 45*a*S and 45*b*S, respectively. Alternatively, the rolls may be supported via shafts so that at least one of the rolls 45*a* or 45*b* is movable in the pressure contact direction, with a bias spring engaged with this roll.

The pair of rolls 45*a* and 45*b* is preferably formed of a material such as rubber which has a relatively large coefficient of friction to fold the sheet being transferred in a rotating direction. The rolls 45*a* and 45*b* may be formed by lining a rubber like material. The folding roll means 45 is shaped to have recesses and protrusions and thus gaps 45*g* in the sheet width direction as shown in FIG. 6(*b*). The gaps 45*g* are arranged so as to coincide with recesses and protrusions on the folding blade 46, described below. A leading end of the folding blade thus advances easily between roll nips. The gaps 45*g* are also arranged at width-wise positions corresponding to staple positions at which the sheet bunch is stapled. That is, the pair of rolls 45*a* and 45*b*, which are in pressure contact with each other, is shaped to have the recesses and protrusions and thus the gaps 45*g* in the sheet width direction. The gaps coincide with the sheet staple positions and knife edges of the folding blade 46, which is similarly shaped to have recesses and protrusions, enter the gaps.

Each of the rolls 45*a* and 45*b* is coupled to the roll driving means RM. The illustrated roll driving means RM is composed of a roll drive motor M6 and a transmission mechanism (transmission means) 47V as shown in FIGS. 7(*a*) and 7(*c*). The illustrated transmission means 47V is composed of a transmission belt which reduces the rotation of the roll drive motor M6 so that the reduced rotation is transmitted to a transmission shaft 47X . A clutch means 45*c* is located between the transmission shaft 47X and the rotating shaft 45*ax* of the roll 45*a*. Similarly, clutch means 45*c* is located between the transmission shaft 47X and the rotating shaft 45*bx* of the roll 45*b*. The clutch means 45*c* is composed of an electromagnetic clutch, a one-way clutch (one-way clutch), a sliding friction clutch (spring clutch), or the like to make it possible to turn on and off the transmission of the driving rotation of the roll drive motor M6 to the roll 45*a* and the roll 45*b*.

The illustrated clutch means 45*c* is composed of a one-way clutch and located between the transmission shaft 47X and a transmission collar 47Z so as to transmit the rotation of the transmission shaft 47X to the transmission collar 47Z in only one direction. The roll 45*a* is coupled to the transmission collar 47Z via a gear, and the roll 45*b* is coupled to the transmission collar 47Z via a belt. The motor rotation in only one direction is transmitted to the rolls 45*a* and 45*b*, thus coupled to the roll drive motor M6 via the clutch means 45*c*. The rolls are configured so as to be freely rotatable in a sheet delivery direction.

The rolls 45*a* and 45*b* are positioned in the area to which the collecting guide 35 is curved or bent to project. Further, the rolls 45*a* and 45*b* are located at a distance h from the sheet bunch supported on the collecting guide 35 as shown in FIG. 8 (*a*). That is, the rolls 45*a* and 45*b* are located at the distance h from the sheets (bunch) supported on the collecting guide 35 so as to prevent the roll surface from coming into contact with the sheets (bunch). The folding blade 46 with the knife edge is provided opposite the rolls 45*a* and 45*b* across the sheet bunch. The folding blade 46 is supported by the apparatus frame so as to be able to reciprocate between a standby position in FIG. 8(*a*) and a nip position in FIG. 8(*c*). A blade driving means BM (FIG. 7(*b*)) is coupled to the folding blade 46. The folding blade 46 is reciprocated, by a drive motor M7, between the standby position, where the folding blade is retracted from the sheet bunch supported on the collecting guide 35, and the nip position where the rolls of the folding roll means 45 are in pressure contact with each other. The folding blade 46 is formed of a material such as metal which has a relatively small coefficient of friction, and is shaped like a plate. The leading end of the folding blade 46 is shaped like a recessed and protruding surface as shown in FIG. 7 (*b*). The blade leading end is shaped to enter the gaps 45*g* in the rolls 45*a* and 45*b* as described above.

In the illustrated apparatus, the relationship between the coefficient of friction ν1 between the rolls 45*a* and 45*b* and the sheets, the coefficient of friction ν2 between the sheets, and the coefficient of friction ν3 between the sheets and the folding blade 46 is set to be ν1>ν2>ν3. Consequently, when the sheet bunch, shown in FIG. 8(*c*), is inserted between the roll 45*a* and the roll 45*b* by the folding blade 46, the pressure contact force acting on both rolls 45*a* and 45*b* also acts on the folding roll means 45, the sheet bunch, and the folding blade 46. In this case, since the coefficients of friction are set to have the above-described relationship, the sheet bunch is smoothly fed in the delivery direction (leftward in the figure).

Now, the configuration of the blade driving means BM of the folding blade 46 will be described. As shown in FIG. 7(*b*), the folding blade 46 is supported on the apparatus frame so as to be movable along the guide rail 46g in a sheet folding direction. The folding blade 46 is supported so as to be able to reciprocate between the standby position, where the folding blade 46 is retracted from the sheets supported on the collecting guide 35, and the nip position on the folding roll means 45. The blade driving means BM, which reciprocates the folding blade 46, includes a blade drive motor M7 and transmission means 46V for transmitting the rotation of the blade drive motor M7, in the figure, a transmission belt, to transmit the rotation to a transmission rotating shaft 46X. A transmission pinion 46P is provided on the transmission rotating shaft 46X and meshes with a rack gear 46L integrally mounted on the folding blade 46. Thus, rotating the blade drive motor M7 forward or backward reciprocates the folding blade 46 between the standby position and the nip position along the guide rail 46g. The folding blade 46 is composed of a plate-like member having the knife edge in the sheet width direction. The leading end of the folding blade 46 is shaped so as to have recesses and protrusions as shown in the figure.

Now, with reference to FIGS. 8(*a*) to 8(*d*), description will be given of how the folding roll means 45 and folding blade 46 are configured as described above to fold the sheets. First, the sheet bunch supported on the collecting guide 35 is locked by the leading end regulating member 38, shown in FIG. 4, as shown in FIG. 8(*a*). The sheet bunch stapled at a fold position is positioned at the fold position Y. Upon receiving a set end signal, driving control means (a sheet folding operation control section 64*d* shown in FIG. 9, this also applies to the description below) turns off the clutch means 45*c*, shown in FIG. 7(*c*). In the illustrated on-way clutch configuration, the roll drive motor M6 is stopped or rotated at a speed lower than the moving speed of the folding blade 46. This is to allow the rolls 45*a* and 45*b* to be rotated in conjunction with the sheet bunch inserted into the nip position by the folding blade 46 as described below.

The driving control means 64*d*, shown in FIG. 9, thus moves the folding blade 46 from the standby position to the nip position at a predetermined speed. For this moving speed VB, the rotating peripheral speed VR of the folding roll means 45 is set at zero or so that VB>VR. Thus, the sheet bunch is bent at the fold position and inserted between the rolls by the folding blade 46 as shown in FIG. 8(*b*). At this time, the rolls 45*a* and 45*b* are rotated in conjunction with the sheets moved by the folding blade 46. The driving control means 64*d* stops the blade drive motor M7 to cause the folding blade 46 to rest at the position shown in FIG. 8 (*c*) until the sheet bunch is expected to reach the predetermined nip position. Simultaneously, the driving control means 64*d* turns on the clutch means 45*c* to drivingly rotate rolls 45*a* and 45*b*. Thereafter, the sheet bunch is fed in the delivery direction (leftward in the figure). Subsequently, in parallel with the delivery of the sheet bunch by the folding roll means 45, the driving control means 64*d* moves and returns the folding blade 46 lying at the nip position, to the standby position as shown in FIG. 8(*d*).

When the thus folded sheet bunch is caught between the rolls 45*a* and 45*b*, the sheet contacting the roll surface is prevented from being drawn in between the rotating rolls 45*a* and 45*b*. That is, the folding roll means 45 rotates in conjunction with the inserted (pushed-in) sheets, preventing only the sheet contacting the rolls from being caught in between the rolls before the remaining sheets are caught. Furthermore, the folding roll means 45 rotates in conjunction with the inserted sheets, preventing the roll surface from rubbing against the sheet contacting the roll surface thereby preventing image rubbing.

A control arrangement for the image forming system described above will be described with reference to the block diagram in FIG. 9. The image forming system shown in FIG. 1 comprises a control section (hereinafter referred to as a "body control section) 50 of the image forming apparatus A, and a control section (hereinafter referred to as a "post-processing control section") 60 of the post-processing apparatus B. The body control section 50 comprises an image forming control section 51, a sheet feeding control section 52, and an input section 53. The "image forming mode" or the "post-processing mode" is set via a control panel 18 provided in the input section 53. As described above, the following image forming conditions are set for the image forming mode: print-out copy count, sheet size, color or black-and-white printing, enlarged or reduced printing, and double- or single-side printing. The body control section 50 controls the image forming control section and the sheet feeding control section in accordance with the set image forming conditions so that images are formed on predetermined sheets, which are then sequentially carried out through the body sheet discharging port 3.

Simultaneously with the settings for the image forming mode, the post-processing mode is set by input via the control panel 18. The post-processing mode is set to, for example, the "printout mode", a "stapling finish mode", or a "sheet bunch folding finish mode". The body control section 50 transfers information on a post-processing finish mode, a sheet count, and a document copy count, and stapling mode information (whether the sheets are to be stapled at one position or a plurality of positions) to a post-processing control section 60. Every time image formation is finished, the body control section transfers the job end signal to the post-processing control section 60.

The post-processing control section 60 comprises a control CPU 61 that operates the post-processing apparatus B in accordance with the specified finish mode, a ROM 62 in which operation programs are stored, and a RAM 63 in which control data is stored. The control CPU 61 comprises a sheet conveyance control section 64*a* that allows the sheet fed to the carry-in port 23 to be conveyed, a sheet collecting operation control section 64*b* that performs a sheet collecting operation, a sheet stapling operation control section 64*c* that executes a sheet stapling process, and a sheet folding operation control section 64*d* that performs a sheet bunch folding operation.

The sheet conveyance control section 64*a* is coupled to a control circuit for the drive motor M1 for the conveying roller 24 and sheet discharging roller 30 on the sheet carry-in path P1. The sheet conveyance control section 64*a* is configured to receive a sensing signal from the sheet sensor S1, located on the path P1. The sheet collecting operation control section 64*b* is connected to a driving circuit for the forward reverse motor M2 for forward reverse roller 30', which allows the sheets to be collected on the first collecting section (collecting tray), and for the sheet discharging motor M3 for the trailing end regulating member. Moreover, the sheet stapling operation control section 64*c* is connected to a driving circuit for drive motors MS1 and MS2 built in the end surface stapling means 33 of the first collecting section 29 and in the saddle stitching staple means 40 of the second collecting section (collecting guide) 35.

The sheet folding operation control section 64*d* is connected to a driving circuit for the roll drive motor R6, which drivingly rotates the folding rolls 45*a* and 45*b*, and to a driving circuit for the clutch means 45*c*. The control section 64*d* is connected to a control circuit for the shift means MS for controllably moving the conveying rollers 36 and 37 on the second switchback conveying path SP2 and the leading end regulating means 38 of the collecting guide 35. The control section 64*d* thus receives sensing signals from sheet sensors arranged on the paths. The control section 64*d* is further connected to a driving circuit for the blade drive motor M7, which operates the folding blade 46.

The control section 64*d* configured as described above allows the post-processing apparatus to perform the following process operations.

"Printout Mode"

Further, in the printout mode, the image forming apparatus A forms images on a series of documents starting with, for example, the first page. The image forming apparatus A sequentially carries out the sheets through the body sheet discharging port 3 in a face down posture. The post-processing apparatus B retracts the buffer guide 26 of the sheet carry-in path P1 upward in FIG. 3 to move the path switching piece 27 as shown by a solid line in FIG. 3. The sheet fed to the sheet carry-in path P1 is thus guided to the sheet discharging roller 30. The sheet leading end is then detected at the sheet discharging port 25, and the corresponding signal is issued. At the time when the sheet leading end is expected, on the basis of the signal, to reach the forward reverse roller 30' on the collecting tray 29, the sheet conveyance control section 64*a* lowers the forward reverse roller 30 30' from the upper standby position onto the tray. The sheet conveyance control section 64*a* further rotates the forward reverse roller 30' clockwise in FIG. 4. Then, the sheet having reached the collecting tray 29 is carried out by the forward reverse roller 30' and housed on the first sheet discharging tray 21. The succeeding sheets are thus sequentially carried out and collected and housed on the tray.

Thus, in the printout mode, the sheets with images formed thereon by the image forming apparatus are accommodated on the first sheet discharging tray 21 via the sheet carry-in path P1 in the post-processing apparatus B. For example, the sheets are sequentially laid on top of one another in a face down posture starting with the first page and ending with the nth page. In this mode, the sheets are not guided to the first switchback conveying path SP1 or the second switchback conveying path SP2, shown in FIG. 5.

In the stapling finish mode, as shown in FIG. 5, the image forming apparatus A sequentially forms images on a series of documents starting with the first page and ending with the nth page and carries out the resultant sheets through the sheet discharging port 3 in a face down posture, as in the case of the printout mode. The post-processing apparatus B retracts the buffer guide 26 of the sheet carry-in path P1 upward in FIG. 3 to move the path switching piece 27 as shown by the solid line in FIG. 3, as in the case of the printout mode. A sheet fed to the sheet carry-in path P1 is thus guided to the sheet discharging roller 30. The sheet leading end is then detected at the sheet discharging port 25, and the corresponding signal is issued. At the time when the sheet leading end is expected, on the basis of the signal, to reach the forward reverse roller 30' on the collecting tray 29, the sheet conveyance control section 64*a* lowers the forward reverse roller 30' from the upper standby position onto the tray. The sheet conveyance control section 64*a* then rotates the forward reverse roller 30' clockwise in FIG. 4. Then, after the time when the sheet trailing end is expected to reach the collecting tray 29, the sheet conveyance control section 64*a* rotationally drives the forward reverse roller 30 30' counterclockwise in FIG. 3. The sheet having passed through the sheet discharging port 25 is switched back and conveyed along the first switch back conveying path SP1 onto the collecting tray 29. This sheet conveyance is repeated to collect the series of sheets on the collecting tray 29 into a bunch in a face down state.

Further, every time a sheet is accumulated on the collecting tray 29, the control CPU 61 operates the side aligning plate 34*b* to align the sheet with the side aligning plate 34*b* in the width direction. Then, in response to the job end signal from the image forming apparatus A, the control CPU 61 operates the end surface staple means 33 to staple the sheet bunch collected on the tray 29, at the trailing edge thereof. After the stapling operation, the control CPU 61 moves the trailing end regulating means 32, also serving as bunch carry-out means, from the position shown by the solid line in FIG. 3 to the position shown by a chain line in FIG. 3. The stapled sheet bunch is then carried out and housed on the first sheet discharging tray 21. The series of sheets with images formed thereon by the image forming apparatus A are stapled and housed on the first sheet discharging tray 21.

To continuously execute the stapling finish process, the control CPU 61 temporarily holds the succeeding sheet on the second switchback conveying path SP2. This sheet buffering operation will be described with reference to FIG. 10. As previously described, the conveying roller 36 is located at the carry-in port of the second switchback conveying path SP2 and is configured so as to be rotatable forward and backward. The control CPU 61, shown in FIG. 9, collects the sheets from the first switchback conveying path SP1 on the collecting tray 29. After the image forming job is finished, the control CPU 61 allows the end surface staple means 33 to execute the stapling process on the sheet bunch collected on the collecting tray. After the stapling process, the control CPU 61 moves the trailing end regulating member 32 to carry out the sheet bunch on the collecting tray 29 to the first sheet discharging tray 21.

Further, if the succeeding sheet is carried in by the image forming apparatus A while the stapling operation and/or the sheet bunch carry-out operation is being performed on the sheet bunch on the collecting tray 29, the CPU 61 uses the sheet sensor S1 to sense the succeeding sheet. At the time when the sheet trailing end is expected to pass through the path switching piece 27 on the sheet carry-in path P1, the control CPU 61 stops the sheet discharging roller 30. At the same time, the control CPU 61 moves the path switching piece 27 to the position shown in FIG. 10. The control CPU 61 subsequently reversely rotates the sheet discharging roller 30. The sheet on the sheet carry-in path P1 is then guided to the second switchback conveying path SP2, where the sheet is nipped by the conveying roller 36. At the time when the sheet trailing end is expected to reach the conveying roller 36, the control CPU 61 stops the conveying roller 36. The sheet on the sheet carry-in path P1 is then stopped and retained on the second switchback conveying path SP2.

While the sheet bunch on the collecting tray 29 is discharged to the first sheet discharging tray 21, the control CPU 61 rotates the conveying roller 36 clockwise as shown in FIG. 10. Simultaneously, the control CPU 61 rotationally drives the sheet discharging roller 21 in the sheet discharging direction. Then, the sheet held on the second switchback conveying path SP2 is guided to the first switchback conveying path SP1 and connected on the collecting tray 29. The control CPU 61 guides the sheet SA2 succeeding the standby sheet SA from the carry-in port 23 to the sheet discharging roller 30 and stacks the sheet SA2 on the collecting tray 29 as described above. In this case, as shown in FIG. 10, the sheet discharging roller 30 is composed of a pair of rollers that can freely come into pressure contact with each other and leave each other. To lay the succeeding sheet from the carry-in port 23 on top of the sheet standing by on the sheet discharging roller 30, the sheet discharging rollers 30 are preferably separated from each other by actuating means such an electromagnetic solenoid. This operation allows the post-processing apparatus B to continuously execute the stapling process without the need to stop the image forming apparatus.

The embodiment of the present invention is thus characterized as described below. The substantially linear sheet carry-in path P1 has the first switchback conveying path SP1 on the downstream side and the second switchback conveying path SP2 on the upstream side. The first processing section (the above-described collecting tray) 29 is located on the first switchback conveying path SP1, and the second processing section (the above-described collecting guide) 35 is located on the second switchback conveying path SP2. Thus, the succeeding sheet fed to the sheet carry-in path P1 while the post-processing operation such as stapling is being performed by the downstream first processing section 29 is temporarily held on the upstream second switchback conveying path SP2. After the processing operation of the first processing section 29 is finished, the succeeding sheet held on the second switchback conveying path SP2 is transferred to the first switchback conveying path SP1. The succeeding sheet fed to the sheet carry-in path P1 while the second processing section 35 of the second switchback conveying path SP2 is performing the post-processing operation is temporarily held on the sheet carry-in path P1.

Figure 12A:
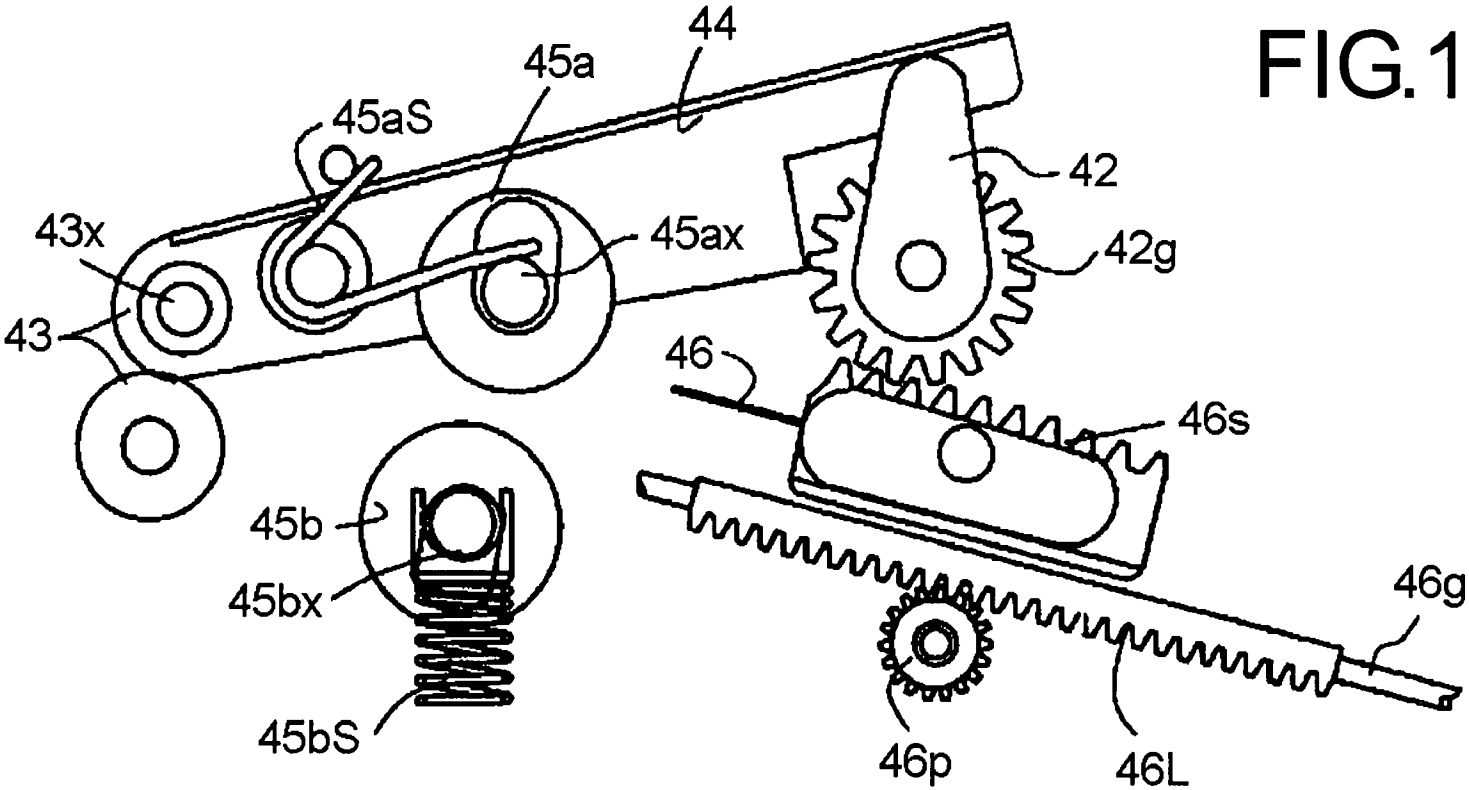
FIG. 12(*a*) is a diagram illustrating that the folding blade is at a standby position during a folding operation of the folding rolls.
Figure 12B:
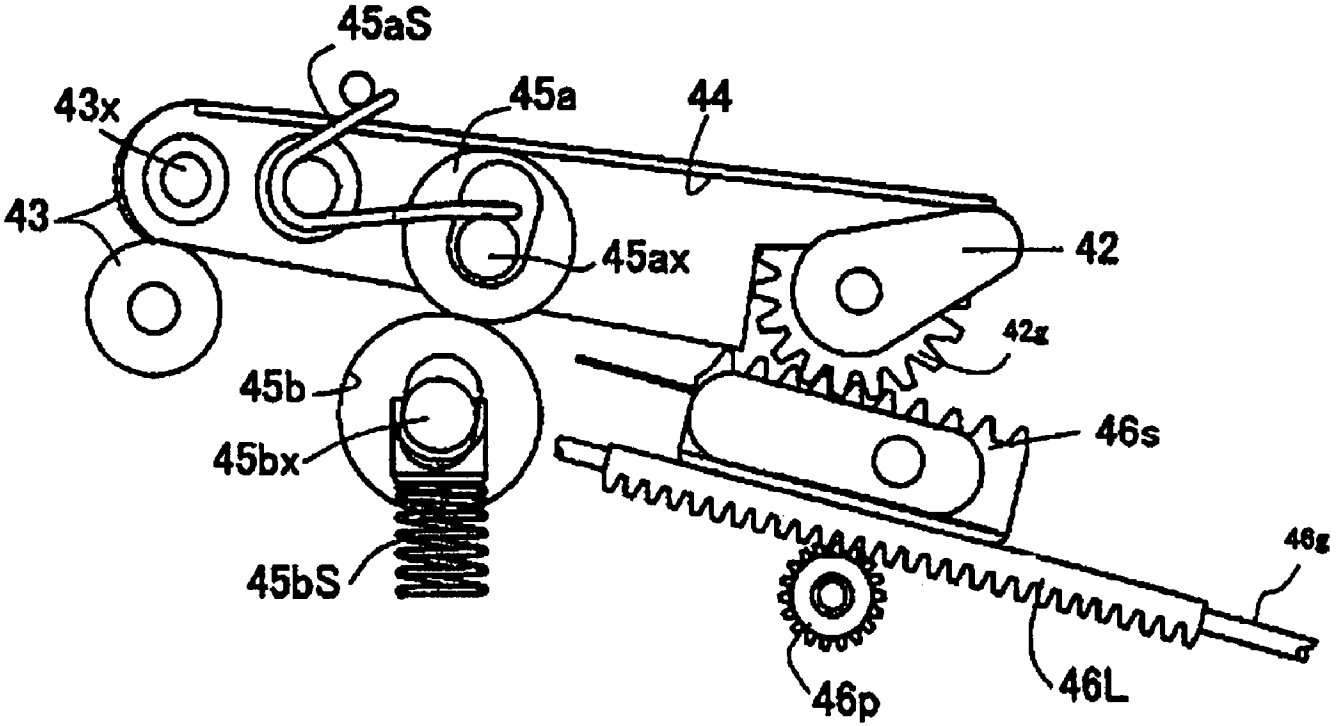
Figure 12C:
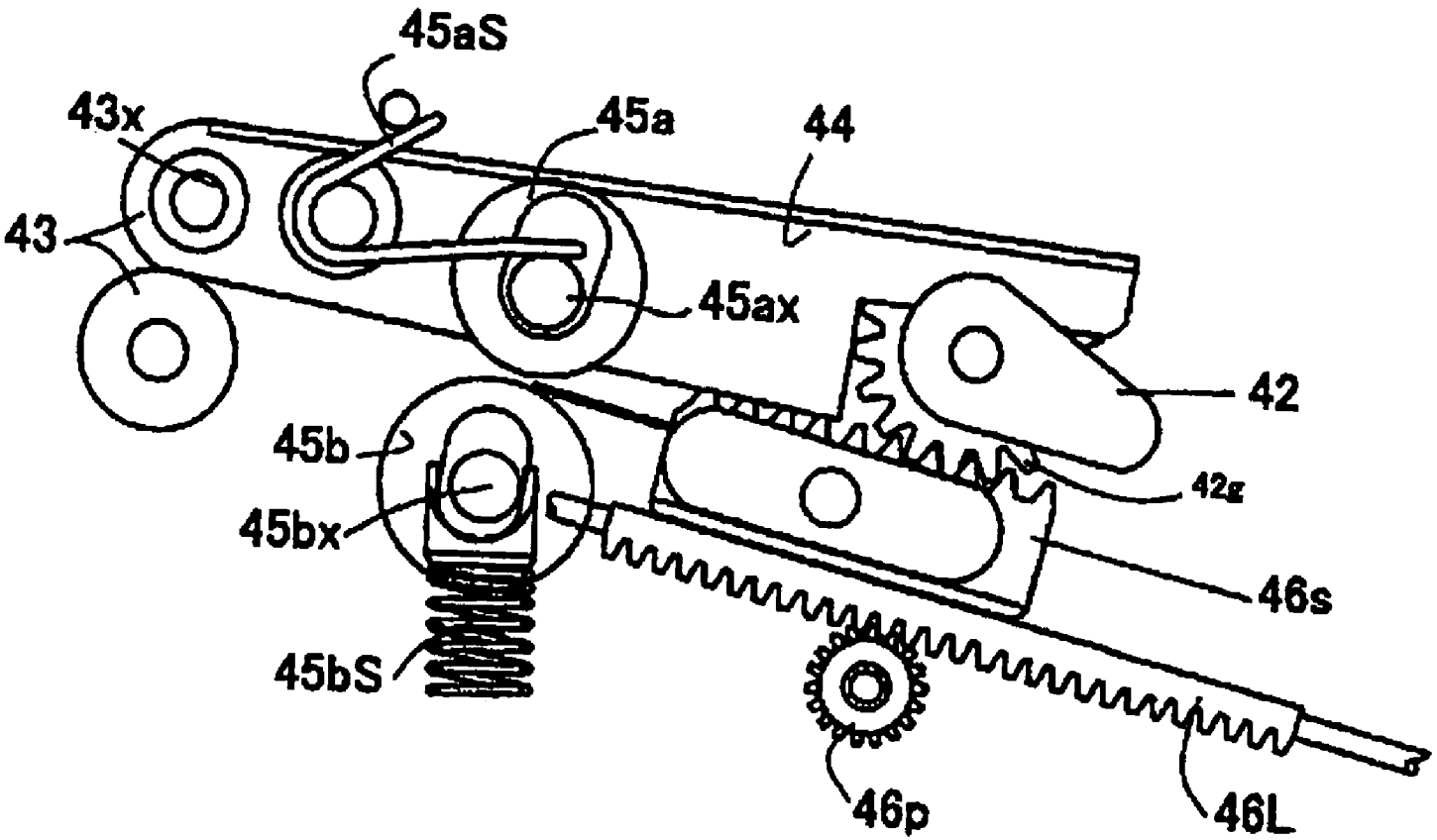

Further, conveyance control is performed as described below if the second succeeding sheet is carried into the sheet carry-in path P1 while the post-processing operation is being performed on the first switchback conveying path SP1. In this case, as shown in FIG. 10, the sheet discharging roller 30 is composed of a pair of rollers that can freely come into pressure contact with each other and leave each other. The paired rollers are configured to be separated from each other by actuating means (not shown) such as an electromagnetic solenoid. The conveyance control means 64*a* holds the first sheet (SA1 in FIG. 12(*a*)) held on the second switchback conveying path SP2 as described above. In this condition, when the second sheet (SA2 in FIG. 12(*a*)) is carried into the sheet carry-in path P1, the sheet sensor S1 detects the sheet leading end to issue the corresponding signal. The conveyance control means 64*a* then separates the sheet discharging rollers 30 from each other. The conveying roller 24 feeds the second sheet SA2 to the sheet discharging port 25. The second sheet SA2 is then laid on top of the first sheet SA1 standing by on the second switchback conveying path SP2. This state is shown in FIG. 12(*a*). The first sheet SA1 and the second sheet SA2 overlap with the leading ends of the sheets offset from each other by an amount ho. That is, the succeeding first sheet SA1 and second sheet SA2 are offset from each other by the predetermined distance ho in the conveying direction. The conveyance control means 64*a* shifts and brings the sheet discharging rollers 30 into pressure contact with each other (as shown in FIG. 12(*a*)) and rotationally drives the rollers 30 in the sheet discharging direction. The two overlapping sheets are then transferred from the first switchback conveying path SP1 to the collecting tray 29.

Figure 11A:
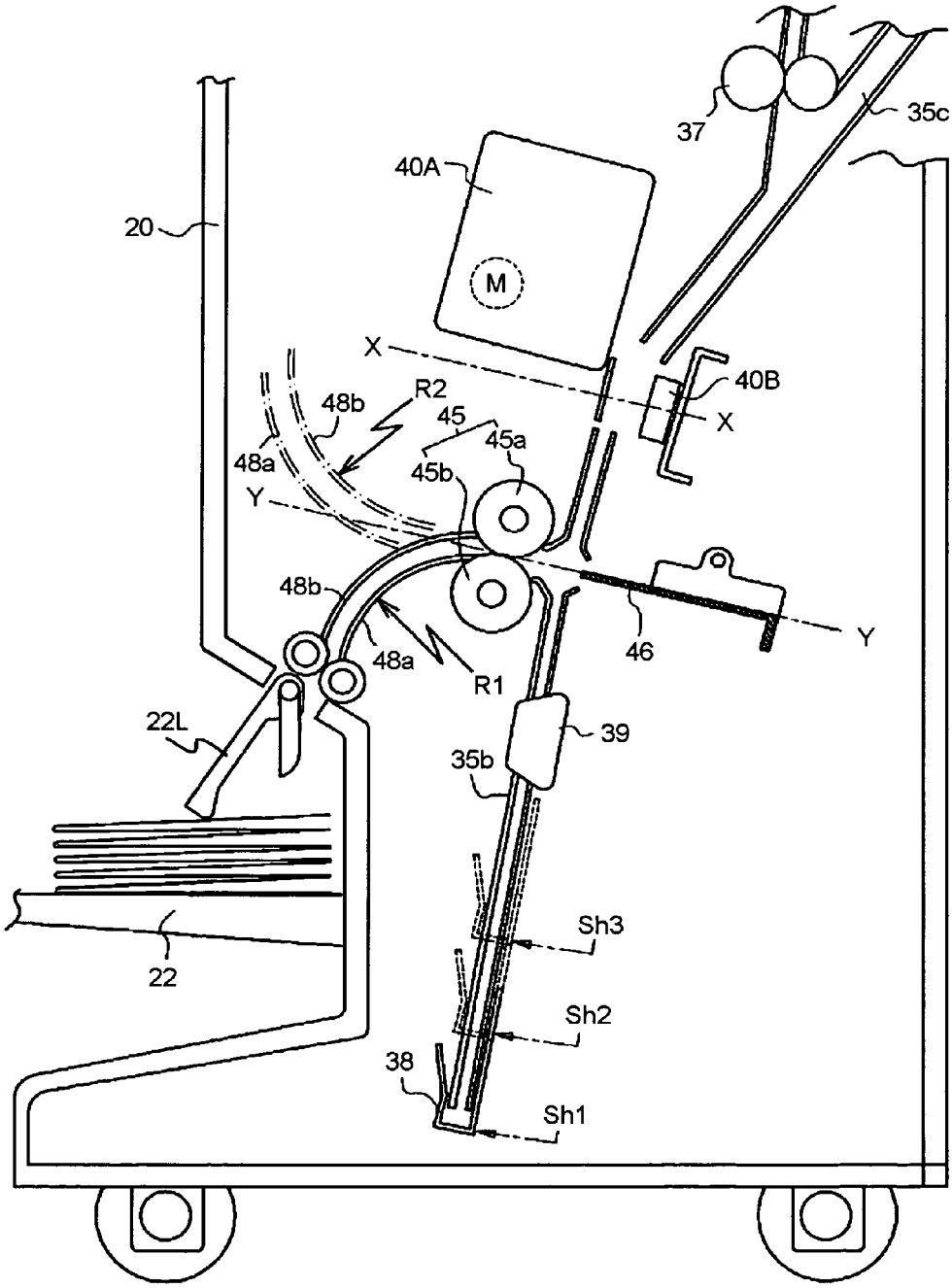
FIG. 11(*a*) is a state diagram showing that the leading end of the sheet bunch is being carried out, to describe an operating state in which the apparatus in FIG. 2 carries out the sheet bunch from folding rolls to a carry-out guide.
Figure 11B:
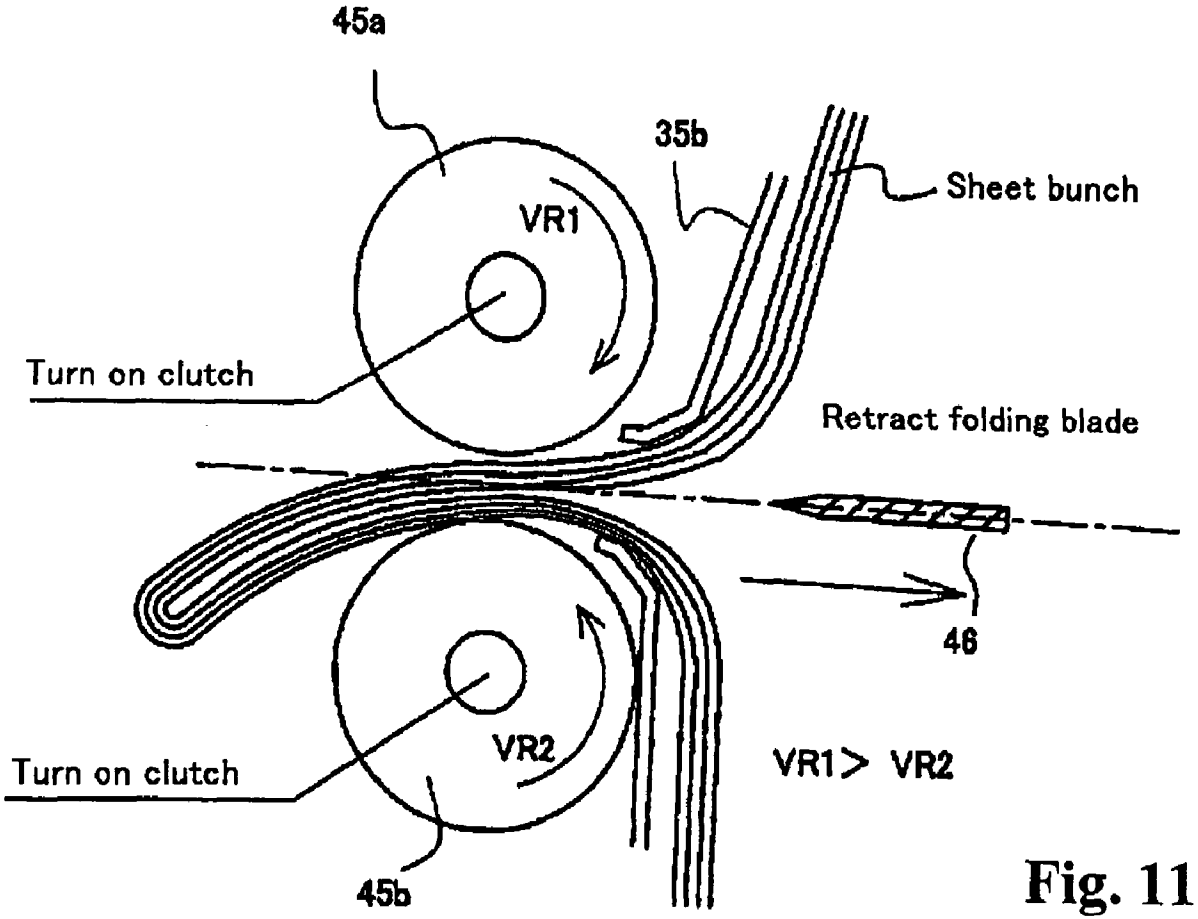
Figure 11C:
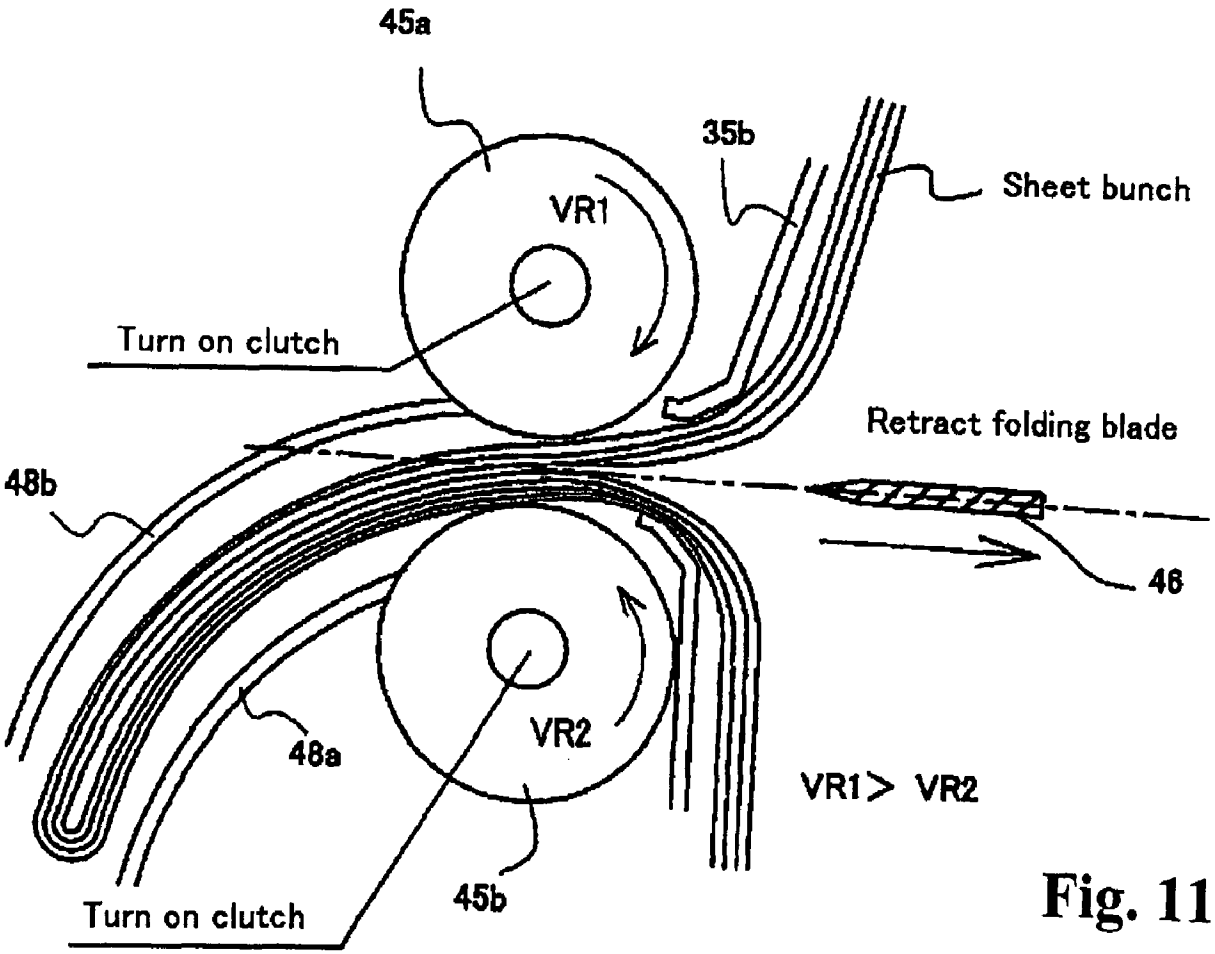

An embodiment of the present invention also allows at least two succeeding sheets to stand by temporarily on the switchback conveying path SP2. For example, if a trouble such as a jam occurs during the post-processing of the preceding sheet bunch on the collecting tray 29 and at least two succeeding sheets reside in the upstream image forming apparatus A or the like, at least two succeeding sheets need to stand by on the second switchback conveying path SP2. In this case, as described above, the conveyance control means 64*a* lays the second sheet SA2 on top of the first sheet SA1 with the sheet discharging rollers 30 separated from each other as shown in FIG. 11. The sheet discharging rollers 25 are then brought into pressure contact with each other with the sheets offset from each other by the predetermined amount ho. Then, the conveyance control means 64*a* moves the path switching piece 27 to the position shown in FIG. 11 and rotationally drives the sheet discharging roller 30 in a reverse direction (counterclockwise in FIG. 11). The first and second sheets SA1 and SA2 are then held on the conveying roller 36 on the second switchback conveying path SP2 so as to overlap like scales. Then, after the post-processing operation of the first processing section 29 is completed, the conveyance control means 64*a* drivingly rotates the conveying roller 36 and the sheet discharging roller 30 in the sheet discharging direction (clockwise in FIG. 11) to transfer the plurality of succeeding sheets standing by on the second switchback conveying path SP2, to the first switchback conveying path SP1. The sheets are then loaded and housed on the collecting tray 29.

As described above, the first sheet SA1 standing by on the second switchback conveying path SP2 is offset from the second sheet SA2 fed through the sheet carry-in path P1, by the predetermined amount ho, or the plurality of sheets, the first and second sheets SA1 and SA2, are arranged on the second switchback conveying path SP2 offset from each other like scales by the predetermined amount ho. This is because to allow the sheets to abut against the trailing end regulating member 32, located on the collecting tray 29, for alignment, the aligning means (the above-described caterpillar belt) 31 allow the sheets to sequentially abut against the trailing end regulating member 32 for alignment starting with the lowermost sheet. Thus, as shown in FIG. 12, the offset amount ho for the succeeding sheet is set to be greater than the distance z between the trailing end regulating member 32 and the contact point at which the caterpillar belt (aligning means) 31 contacts the sheets (ho>z). This operation allows the post-processing apparatus B to continuously execute the stapling process without the need to stop the image forming apparatus A.

In the sheet bunch folding finish mode, the image forming apparatus A forms images on sheets, for example, in the order described with reference to FIG. 5. The post-processing apparatus B finally forms the sheets into a booklet. The post-processing apparatus B then retracts the buffer guide 26 of the sheet carry-in path P1 upward as shown in FIG. 3 to move the path switching piece 27 as depicted by the solid line in FIG. 3. The sheet fed to the sheet carry-in path P1 is thus guided to the sheet discharging roller 30. The sheet sensor S1 detects the sheet trailing end and issues the corresponding signal. Then, on the basis of the signal, the control CPU 61, shown in FIG. 9, stops the sheet discharging roller 30 at the timing when the sheet trailing end passes through the path switching piece 27. Simultaneously, the control CPU 61 moves the path switching piece 27 to a position shown by a dashed line in FIG. 3. The sheet discharging roller 30 then reversely rotates the sheet discharging roller 30 (counterclockwise in FIG. 3). Then, the sheet having entered the sheet carry-in path P1 has the conveying direction thereof reversed and is guided to the second switchback conveying path SP2 via the path switching piece 27. The sheet is then guided to the collecting guide 35 by the conveying rollers 36 and 37, arranged on the second switchback conveying path SP2.

At the timing when the sheet is carried into the collecting guide 35 through the second switchback conveying path SP2, the control CPU 61 moves the leading end regulating member 38 to the lowermost Sh1 position. The whole sheets are then supported by the collecting guide 35. In this condition, the control CPU 61 operates the sheet side edge aligning member 39 to align the sheets (the alignment need not be performed for the first sheet or for every arrival of the sheet).

The control CPU 61 then moves the leading end regulating member 38, shown in FIG. 4, to the position Sh3, at which the sheet trailing end enters the switchback approaching path 35*c*, described above. The sheet trailing end supported on the collecting guide 35 moves backward to the switchback approaching path 35*c*. In this condition, the succeeding sheet is fed to the collecting guide 35 through the second switchback conveying path SP2 and stacked on the preceding sheet. When the succeeding sheet is carried in, the leading end regulating member 38 is moved from the position Sh3 to the position Sh1.

As previously described, the sheet side edge aligning member 39 is operated to align the carried-in sheet with the sheet supported on the collecting guide. This operation is repeated to allow the sheets with images formed thereon by the image forming apparatus A to be set on the collecting guide 35 via the second switchback conveying path SP2. Upon receiving the job end signal, the control CPU 61 moves the leading end regulating member 38 to the position Sh2 to align the sheet center with the staple position X for setting.

The control CPU 61 then operates the saddle stitching staple means 40 to staple the sheets at one position or a plurality of positions in the center thereof. In response to a completion signal for this operation, the control CPU 61 moves the leading end regulating member 38 to the position Sh1 and aligns the sheet center with the fold position Y for setting. The control CPU 61 then executes the folding process on the sheet bunch in accordance with the sequence shown in FIGS. 8(*a*) to 8(*d*), and further carries out the resultant sheet bunch to the sheet discharging tray 22.

Further, to continuously execute the sheet bunch folding finish process described above, the control CPU 61, shown in FIG. 9, temporarily holds the succeeding sheet on the sheet carry-in path P1. This sheet buffering operation will be described with reference to FIG. 11. As previously described, the sheet carry-in path P1 has the buffer guide 26, composed of a locking member that locks the sheet trailing end in a sheet standby section (area) formed above the sheet carry-in path P1 as shown in FIG. 11.

To continuously execute the sheet bunch folding process described above, the control CPU 61 temporarily holds the succeeding sheet fed to the sheet carry-in path P1, on the buffer guide 26. As previously described, the sheets are collected on the collecting guide 35 through the second switchback conveying path SP2, shown in FIG. 4. After the image forming job is finished, the saddle stitching staple means 40 executes the stapling process on the sheet bunch collected on the guide. After the stapling process, the folding blade 46 and the folding roll means 45 are actuated to fold the sheet bunch on the collecting guide 35 into a booklet, which is then carried out to the second sheet discharging tray 22.

If the succeeding sheet is carried in by the image forming apparatus A while the stapling operation and/or the sheet bunch folding operation is being performed on the sheet bunch on the collecting guide 35, the control CPU 61 uses the sheet sensor S1 to sense the succeeding sheet. At the time when the sheet trailing end is expected to pass through the buffer guide 26 of the sheet carry-in path P1, the control CPU 61 stops the sheet discharging roller 30. Simultaneously, the control CPU 61 moves the buffer guide 26 to the position shown in FIG. 11. The control CPU 61 subsequently reversely rotates the sheet discharging roller 30. The trailing end of the sheet on the sheet carry-in path P1 is then guided to the buffer guide 26. At the time when the sheet trailing end is expected to reach the buffer guide 26, the control CPU 61 stops the sheet discharging roller 30. The sheet on the sheet carry-in path P1 is then stopped with the trailing end thereof locked by the buffer guide 26.

After the sheet bunch on the collecting guide 35 is discharged to the second sheet discharging tray 22, the succeeding sheet is carried in by the image forming apparatus A and laid on top of the residing (standby) sheet. At this timing, the control CPU 61 rotates the sheet discharging roller 30 clockwise in FIG. 11 and simultaneously moves the buffer guide 26 to a position shown by a dashed line in the figure. The sheets overlapping in the vertical direction are fed downstream by the sheet discharging roller 30. The sheet discharging roller 30 is then reversely rotated to guide the sheets to the second switchback conveying path SP2. The sheets overlapping in the vertical direction are then guided to the collecting guide 35 and aligned with each other in order and in the vertical direction. Sheets succeeding the sheets overlapping in the vertical direction are sequentially loaded and housed on the collecting guide 35 via the sheet carry-in path P1 and the second switchback conveying path SP2. This operation allows the post-processing apparatus B to continuously execute the sheet bunch folding process without the need to stop the image forming apparatus A. Preferably, for the sheet overlapping, as shown in FIG. 11, the sheet discharging roller 30 is composed of a pair of rollers that can freely come into pressure contact with each other and leave each other. To lay the succeeding sheet from the carry-in port 23 on top of the sheet standing by on the sheet discharging roller 30, the sheet discharging rollers 30 are preferably separated from each other by the actuating means such as an electromagnetic solenoid.

According to an embodiment of the present invention, as described above, the first and second switchback conveying paths SP1 and SP2 are arranged on the sheet carry-in path P1 so as to lie at a distance from each other in the vertical direction. The collecting tray 29 is located on the first switchback conveying path SP1 so that the stapling process can be executed on the collecting tray 29. The collecting guide 35 is located on the second switchback conveying path SP2 so that the bunch folding process can be executed on the sheets on the collecting guide 35. Thus, if the stapling finish operation and the bunch folding finish operation are to be consecutively performed, the succeeding post-processing can be executed without the need to wait for the preceding post-process to be finished. Furthermore, even if a trouble such as a jam occurs during the execution of the preceding post-processing, the sheet residing in the system for the succeeding post-processing can be conveyed to the position of the succeeding post-processing.

Further, the saddle stitching staple means 40 is located at the staple position X on the collecting guide 35. However, the sheet processing path may extend through the collecting guide, the staple position, and the fold position respectively, and the collecting guide means may be followed by the staple device, with the sheet folding means located downstream of the staple device. Moreover, the sheet bunch may be folded and then carried out onto the second sheet discharging tray 22 without being stapled by the staple means.

Alternatively, a third sheet discharging tray 21*b* may be provided as shown in FIG. 1 so that the sheet carried into the sheet carry-in path P1 can be carried out onto the third sheet discharging tray 21*b*. This configuration allows the sheet to be carried out to a position different from those of the first and second switchback paths, for example, to the exterior of the apparatus.

In the above-described embodiment, the end surface staple means 33 for stapling the sheets at the edge and saddle stitching staple means 40 are arranged in the vertical direction in the space surrounded by the sheet carry-in path P1, the first switchback conveying path SP1, and the second switchback conveying path SP2. Therefore, the apparatus is compact.

Now, with reference to FIGS. 10(*a*) to 10(*e*), description will be given of how the sheets are folded by the folding roll means 45 and the folding blade 46. The sheet bunch supported on a curved guide section 35*b* as shown in FIG. 10(*a*) is locked by the sheet leading end regulating means 38, the sheet bunch stapled at the fold line position thereof is placed at the fold position Y. At this time, the sheet bunch is supported so as to roll back and project toward the folding roll. The folding blade 46 is at a standby position Wp (home position). The first roll 45*a* is at a retract position located away from the second roll 45*b* (as shown in FIG. 12(*a*)).

The driving control means (which corresponds to a sheet folding operation control section described below; this also applies to the description below) 64*d* obtains a sheet bunch set end signal to actuate the blade driving motor M7. The folding blade 46 then moves from the standby position Wp to a nip position Np corresponding to a state shown in FIG. 12(*b*). The movement of the folding blade 46 separates a cam member 42 from a bracket 44 and brings the first roll 45*a* into pressure contact with the second roll 45*b* (as shown in FIG. 10(*b*)). Simultaneously with the actuation of the blade driving motor M7, the driving control means 64*d* turns off the clutch means 45*c*. With the configuration of the one-way clutch described above, the roll driving motor M6 is stopped or rotated at a speed lower than the moving speed of the folding blade 46. This is because the sheet bunch inserted to the nip position by the folding blade 46 sets conditions for rotating the first and second rolls 45*a* and 45*b* in conjunction with the sheet bunch.

The driving control means 64*d* moves the folding blade 46 from the standby position toward the nip position at a predetermined speed. The rotating peripheral speed VR of the rolls 45*a* and 45*b* is set at zero or lower than the moving speed VB (VB>VR). Thus, as shown in FIG. 10(*b*), the sheet bunch is bent at the fold line position. The bent sheet bunch is then inserted between the rolls. When the sheet bunch is inserted to the position NP between the roll nips as shown in FIG. 10(*c*), the first folding roll 45*a* and the second folding roll 45*b* rotate in conjunction with the sheets moved by the folding blade 46. At the time when the sheet bunch is expected to reach the predetermined nip position, the driving control means 64*d* stops the blade driving motor M7 to bring the folding blade 46 to rest at a position shown in FIG. 10(*d*).

The driving control means 64*d* then switches on the clutch means 45*c* to drivingly rotate the rolls 45*a* and 45*b*. The sheet bunch is then fed in the delivery direction (leftward in FIG. 10). The driving control means 64*d* subsequently delivers the sheets to a sheet discharging roller 43 while the sheet bunch is being delivered by the rolls 45*a* and 45*b*, as shown in FIG. 10(*e*). The driving control means 64*d* then returns the folding blade 46 from the nip position NP to the standby position Wp.

When the folding blade 46 returns to the standby position Wp, cam shift means (rack gear) 46S rotates a fan-shaped gear 42*g* in conjunction with the cam shift means 46S to allow the cam member 42 to swing the bracket 44 upward. The movement of the bracket 44 to the retract position allows the roll 45*a*, attached to the bracket 44, separates from the second folding roll 45*b* (as shown in FIG. 8(*e*)). The sheet bunch is thus carried out to the second sheet discharging tray 22 by the sheet discharging roller 43, located downstream of the folding roll means 45. At this time, the trailing end of the sheets (bunch) is prevented from being subjected to image rubbing by the rolls 45*a* and 45*b*.

Figure 13:
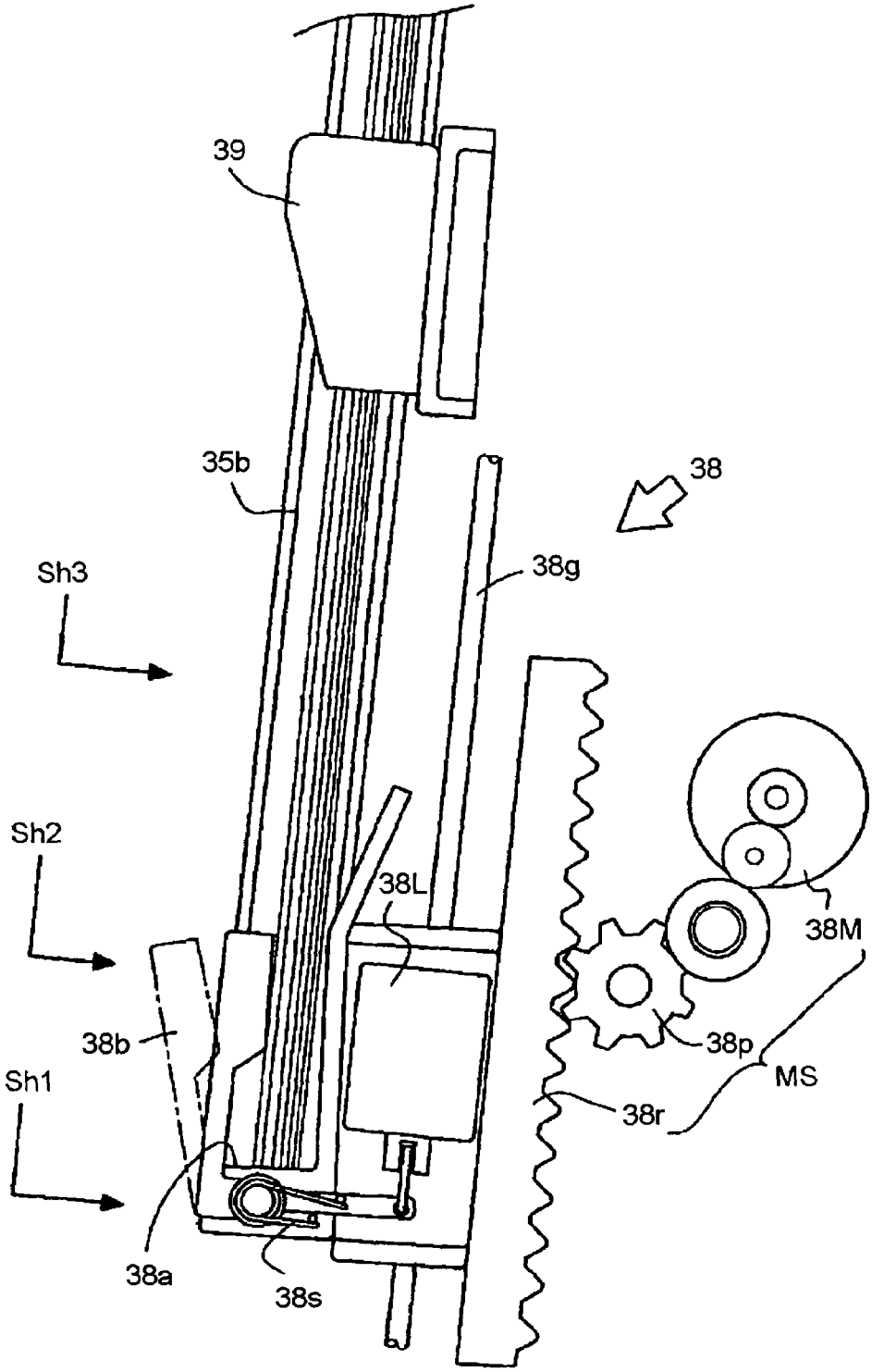
FIG. 13 is a diagram showing the configuration of sheet leading end regulating means of the device in FIG. 4.
Figure 14A:
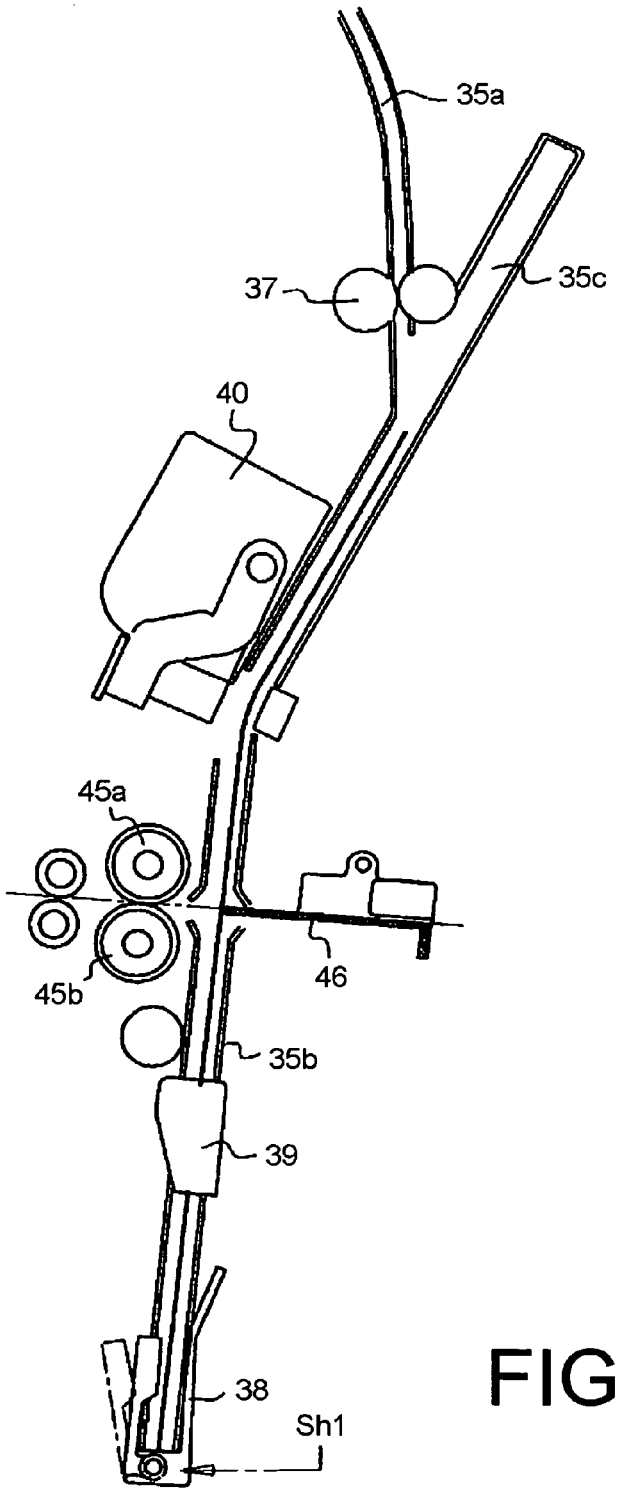
FIG. 14(*a*) is a state diagram showing that the first sheet has reached a collecting guide, to describe an operating state of the sheet leading end regulating means of the device in FIG. 4.
Figure 14B:
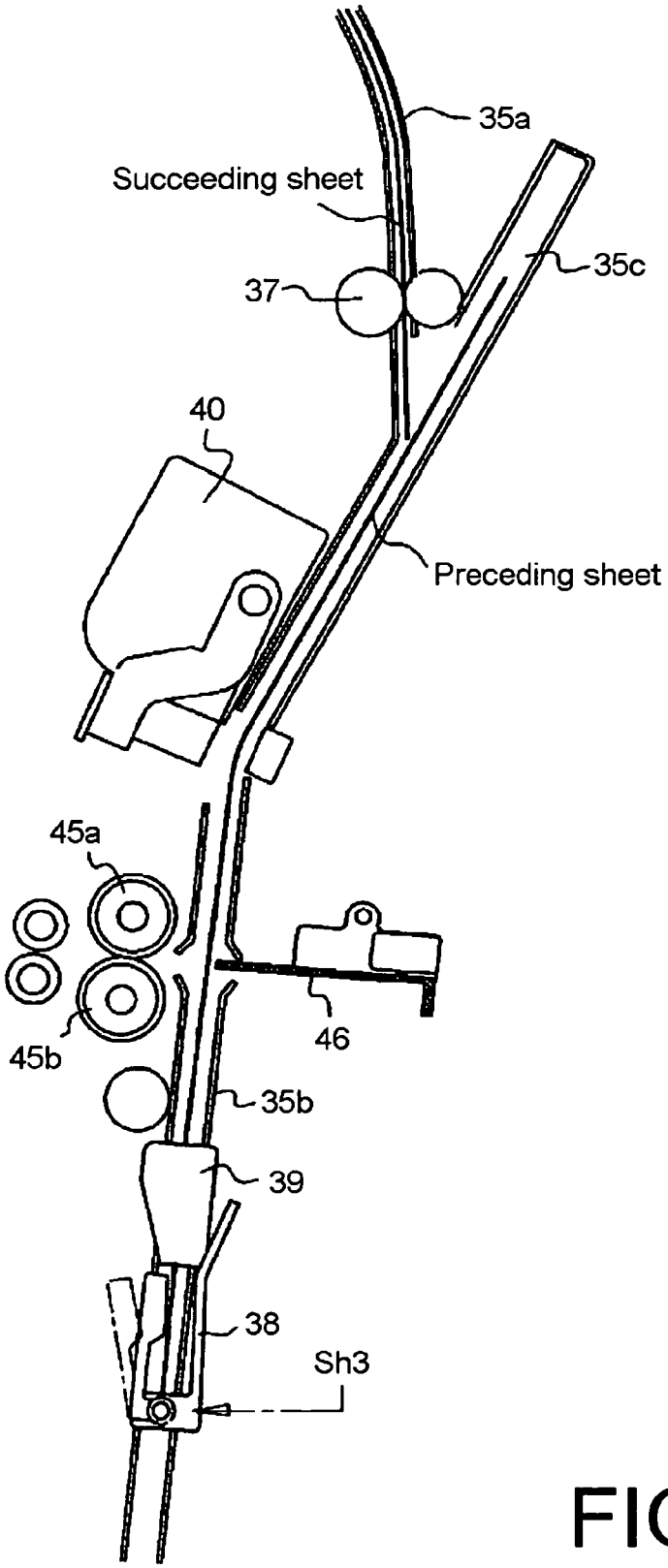
Figure 14C:
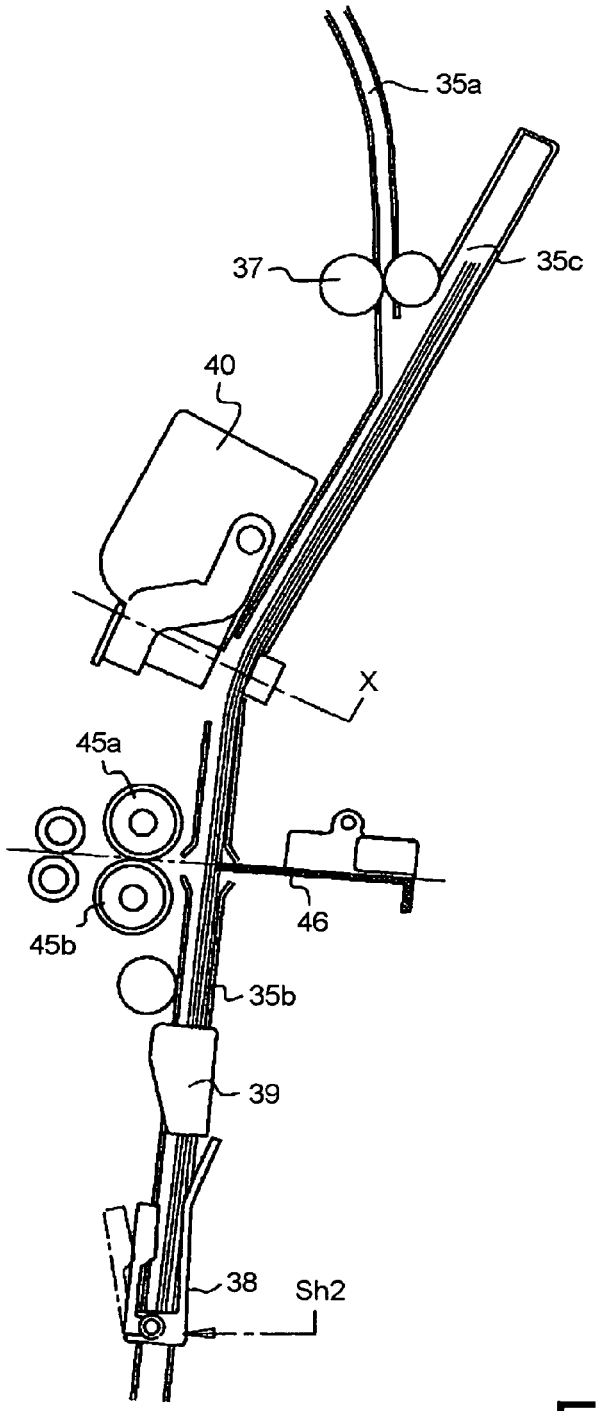
Figure 14D:
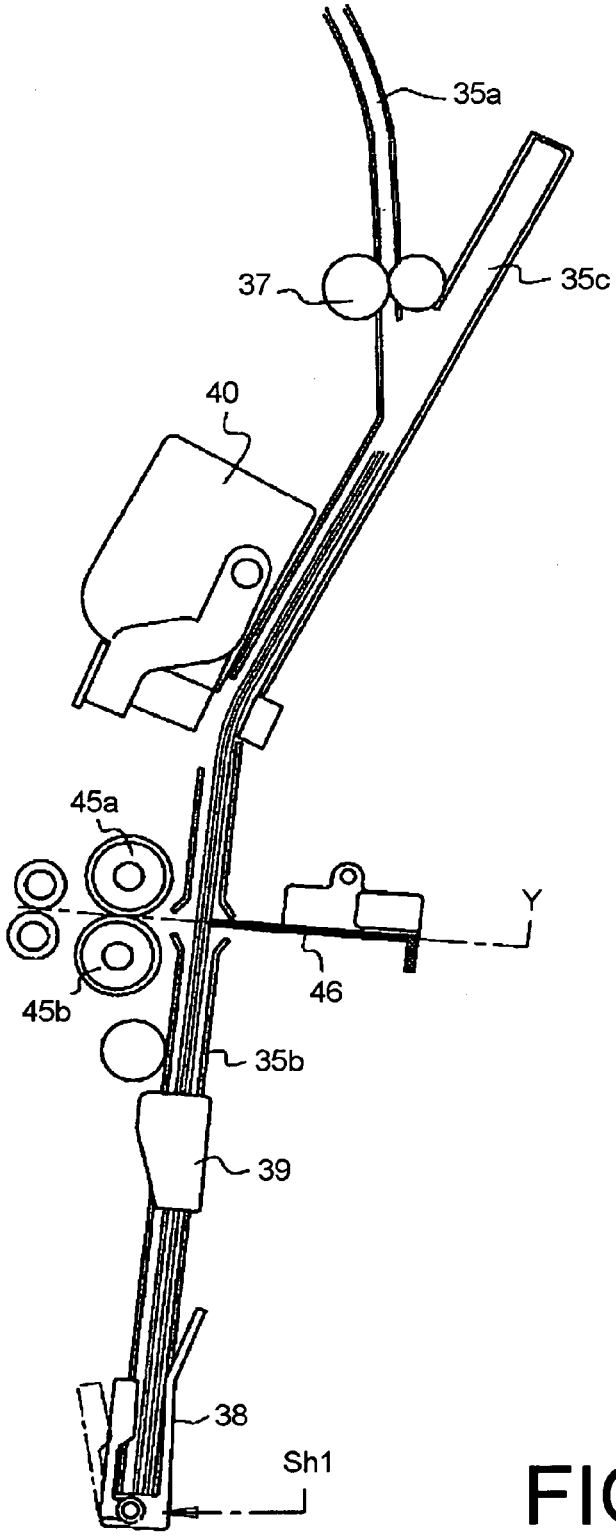

Now, the sheet leading end regulating means 38 will be described with reference to FIG. 13. As shown in FIG. 13, the sheet leading end regulating means 38 is composed of a locking member 38*a* that locks the leading end of the sheets carried in along the curved guide section 35*b* and a grip member 38*b* that grips the sheet bunch loaded and supported on the locking member 38*a*. The sheet leading end regulating means 38 is supported on a guide rail 38*g* so as to be movable along the curved guide section 35*b*. The grip member 38*b* is supported on the locking member 38*a* via a shaft to nip the sheets supported on the locking member 38*a*. A bias spring 38*s* and an actuating solenoid 38L are coupled to the grip member 38*b*. The bias spring 38*s* always acts in a sheets ungripping direction. The grip member 38*b* grips the sheets when the actuating solenoid 38L is energized.

The sheet leading end regulating means 38 configured as described above is configured so that the position of the sheet leading end regulating means 38 can be moved between Sh1 and Sh2 and Sh3. Shift means MS is composed a stepping motor 38M, a pinion 38*p* coupled to the motor 38M, and a rack gear 38*r* formed integrally with the sheet leading end regulating means 38. The shift means MS is configured to rotationally drive the stepping motor 38M by a predetermined amount in response to a sensing signal from the home position sensor to move the sheet leading end regulating means 38 between Sh1 and Sh2 and Sh3. The grip member 38*b* turns on and off the actuating solenoid 38L to grip the sheet bunch collected on the curved guide section 35*b*. In this case, to move the sheet leading end regulating means 38 from upstream side to downstream side (Sh3-Sh1 or the like), control is performed such that the actuating solenoid 38L is turned on to grip the sheet bunch. As shown in the figure, the locking member 38*a*, which supports the sheet leading end, is integrated with the grip member 38*b*, which grips the sheet bunch supported on the locking member 38*a*. However, the locking member 38*a* and the grip member 38*b* may be separately and individually mounted on the apparatus frame.

The shift means MS moves the position of the sheet leading end regulating means 38 at least between the illustrated positions Sh1 and Sh2 and Sh3. When the sheets are to enter the curved guide section 35*b* through the sheet approaching path 35*a*, the sheet leading end regulating means 38 is moved to the illustrated position Sh3 so as to move the sheet trailing end back to the switchback approaching path 35*c*. When the sheets are to be stapled by the saddle stitching staple device 40, the sheet leading end regulating means 38 is moved to the illustrated position Sh2 so as to place the sheets supported on the collecting guide 35, at the staple position X. When the sheets are to be folded together by the folding roll means, the sheet leading end regulating means 38 is moved to the illustrated position Sh1 so as to place the sheets supported on the collecting guide 35, at the fold position Y.

That is, when the sheet leading end regulating means 38 is placed at the illustrated position Sh3, then as shown in FIG. 14(*b*), the trailing end of the sheets (bunch) supported on the collecting guide 35 reaches the switchback approaching path 35*c*. In this condition, the succeeding sheet fed through the sheet approaching path 35*a* is reliably stacked on the collected sheets. When the sheet leading end regulating means 38 is placed at the illustrated position Sh2, then as shown in FIG. 14(*c*), the center of the sheets (bunch) supported on the collecting guide 35 is placed at the staple position X on the saddle stitching staple device 40. Similarly, when the sheet leading end regulating means 38 is placed at the illustrated position Sh1, then as shown in FIG. 14(*d*), the center of the sheets (bunch) supported on the collecting guide 35 is placed at the fold position Y on the folding roll means 45. Accordingly, the illustrated positions Sh1, Sh2, and Sh3 are set at the optimum positions depending on the sheet size (the length in the conveying direction). These positions are prestored in a memory table or the like.

The curved guide portion 35*b* has the sheet side edge aligning means 39 located downstream in the sheet conveying direction. The sheet side edge aligning means 39 aligns, with a reference, the widthwise position of the sheets carried into the curved guide section 35*b* and supported on the sheet leading end regulating means 38. That is, with the sheet leading end regulating means 38 placed at the position Sh3 and the whole sheets supported on the collecting guide 35, the side edges of the sheets are aligned with the pair of aligning plates (sheet side edge aligning means) 39. Since the illustrated device aligns the sheets using the center thereof as a reference, the sheet side edge aligning member 39 is composed of the lateral pair of aligning plates, the aligning plates are arranged at an equal distance from the sheet center as a reference to align the sheet bunch supported on the collecting guide 35. Thus, the sheet side edge aligning member 39 is coupled to the aligning motor M5 (not shown).

That is, the sheet side edge aligning means 39 is composed of the pair of aligning plates engaging the sheet side edges and the actuating means (aligning motor M5, described above) for allowing the aligning plates to approach and leave each other. The aligning motor M5 allows the paired aligning plates to approach and leave each other so as to align the sheets, while the sheet leading end regulating means 38 is regulating the position of the sheets supported on the collecting guide 35, to the sheet staple position X or the fold position Y.

Now, the configuration of blade driving means BM of the folding blade 46 will be described with reference to FIG. 7 (*d*). As shown in FIG. 7 (*d*), the folding blade 46 is supported on the apparatus frame so as to be movable along the guide rail 46*g* in the sheet folding direction. The folding blade 46 is supported so as to be able to reciprocate between the standby position Wp, where the folding blade 46 retracts from the sheets supported on the curved guide section 35*b*, and the nip position Np on the rolls 45*a* and 45*b*. The blade driving means BM, which reciprocates the folding blade 46, is composed of the blade driving motor M7 and the transmission means 46V, which transmits the rotation of the blade driving motor M7. The illustrated blade driving means BM transmits the rotation to the transmission rotating shaft 46X via a transmission belt. The transmission rotating shaft 46X has a transmission pinion 46*p* that meshes with the rack gear 46L, attached integrally to the folding blade 46.

Consequently, rotating the blade driving motor M7 forward and backward allows the folding blade 46 to reciprocate between the standby position Wp and the nip position Np along the guide rail 46*g*. The folding blade 46 is composed of a plate-like member having a knife edge in the sheet width direction. The leading end of the folding blade 46 is shaped so as to have recesses and protrusions as shown in the figure. As described above, the cam shift means (rack gear) 46S is integrally attached to the folding blade 46, which reciprocates between the standby position Wp and the nip position Np.

Now, with reference to FIGS. 12(*a*) to 12(*c*), description will be given of the interlocking between the first roll 45*a* and the folding blade 46, which are interlocked via the cam member 42 and the cam shift means 46S. FIG. 12(*a*) shows that the folding blade 46 is at the standby position Wp. FIG. 12(*b*) shows an initial operation of inserting the sheet bunch between the rolls. FIG. 12(*c*) shows that the folding blade means is at the nip position. When the folding blade 46 is at the standby position Wp, the cam shaft means 46S moves the cam member 42 to the illustrated position. The bracket 44 is at an elevated position, and the first roll 45*a*, attached to the bracket 44, is shifted away from the second roll 45*b*. In this condition, as described below, the first roll 45*a* retracts from the sheet bunch sandwiched between the rolls as described below. When the folding blade 46 moves from the standby position Wp toward the nip position Np, the cam member 42 is rotated clockwise in FIG. 12 via the fan-shaped gear 42*g* to lower the bracket 44.

This brings the first roll 45*a* into pressure contact with the second roll 45*b* by the force of the bias spring 45*a*S. Moreover, when the folding blade 46 moves to the nip position Np, the cam member 42 rotates clockwise at a position located away from the bracket 44. The first roll 45*a* is kept in pressure contact with the second roll 45*b*. Consequently, when the folding blade means inserts the sheets between the nips of the paired folding rolls, the sheets are brought into pressure contact with one another by a predetermined pressure contact force to form a fold line. Further, when the sheets with the fold line formed thereon are carried out from the folding roller, the pressure contact force is reduced or released to carry out the sheets downward after the sheets have been delivered to the sheet discharging roller 43.

Now, with reference to FIGS. 11 (*a*) and 11(*c*), description will be given of how the rolls 45*a* and 45*b* discharge the sheets in conformity to the curvature of a carry-out guide 48. As shown in FIGS. 11(*a*) and 11 (*c*), if the carry-out guide 48 is curved, then to set different feeding amounts for the first and second rolls 45*a* and 45*b* to allow the sheets to be discharged in conformity to the curvature of the carry-out guide 48, at least two methods are set forth, in that, (1) the peripheral speed of the folding roll inside the curvature is set lower than that of the folding roll outside the curvature as previously described or (2) the rotation speed of the folding roll inside the curvature is set lower than that of the folding roll outside the curvature.

The method (1) will be described. The rolls 45*a* and 45*b* are rotationally driven so that the peripheral speed of the roll 45*a* or 45*b* positioned inside the carry-out guide 48 in the curving direction is lower than that of the roll 45*a* or 45*b* positioned outside the carry-out guide 48 in the curving direction. That is, in the first embodiment (shown by a solid line in FIG. 11(*a*)), rotational control is performed such that in FIG. 4, the peripheral speed of the second roll 45*b* positioned inside in the curving direction is lower than that of the first roll 45*a* positioned outside in the curving direction. Likewise, in the second embodiment (shown by a chain line in FIG. 11(*a*)), rotational control is performed such that in FIG. 4, the peripheral speed of the first roll 45*a* positioned inside in the curving direction is lower than that of the second roll 48*b* positioned outside in the curving direction.

Now, the method (2) will be described. To carry out the folded sheets, the driving control means, described below, intermittently rotationally drives the folding roll positioned inside in the curving direction, while continuously rotationally driving the folding roll positioned outside in the curving direction. Alternatively, the driving control means intermittently rotationally drives the first and second rolls 45*a* and 45*b* with intermittent driving length (time) set shorter for the inside roll 45*a* or 45*b* than for the outside roll 45*a* or 45*b*.

As shown in FIGS. 10 (*b*) and 10 (*c*), the above-described control naturally curves the layered sheet bunch fed from between the paired rolls 45*a* and 45*b*, as a result of the difference in feeding amount between the inside roll and the outside roll (the difference in speed or conveying amount). Settings are made such that the curvature of the sheet bunch resulting from the difference in feeding amount (the difference in speed or conveying amount) conforms to the curvature of the carry-out guide 48. This enables a significant reduction in the conveying load of the sheet bunch carried out along the carry-out guide 48.

A supplementary description will be given of the configuration of the sheet carry-in guide 37' with reference to FIG. 15. As described above, the sheet carry-in guide 37' is provided at a sheet discharging port 37*a* of the sheet approaching path 35*a* (the second discharge port) in order to stack the sheet carried out of the sheet discharging port 37*a* on the sheets supported on the collecting guide 35. The carry-in guide 37' guides the sheet leading end onto the sheets collected on the collecting guide 35. After the carry-in guide 37' guides the sheet leading end onto the collecting guide 35 and the sheet is carried in, the carry-in guide 37' pivots above the collecting guide 35 in order to move to above the carried-in sheet to provide for the carry-in of the succeeding sheet. Description will be given below of embodiments of the carry-in guide 37', which guides the leading end of the sheet from the sheet discharging port 37*a* to above the collecting guide 35 and which, after the sheet is carried in, returns to above the carried-in sheet.

Figure 15A:
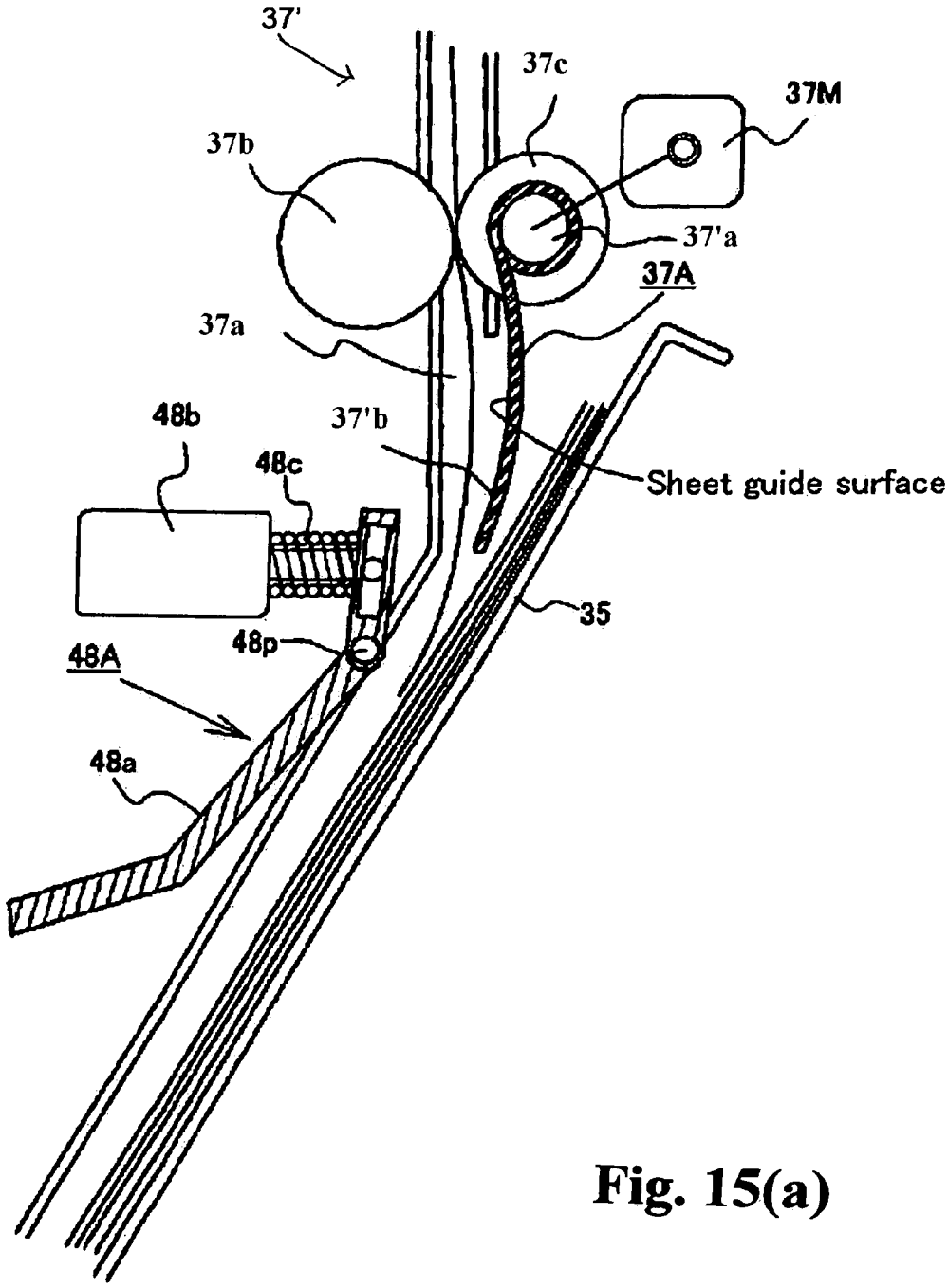
FIG. 15(*a*) is a diagram illustrating the configuration of a sheet carry-in guide and pressurizing means in the apparatus in FIG. 2 and showing an initial state.
Figure 15B:
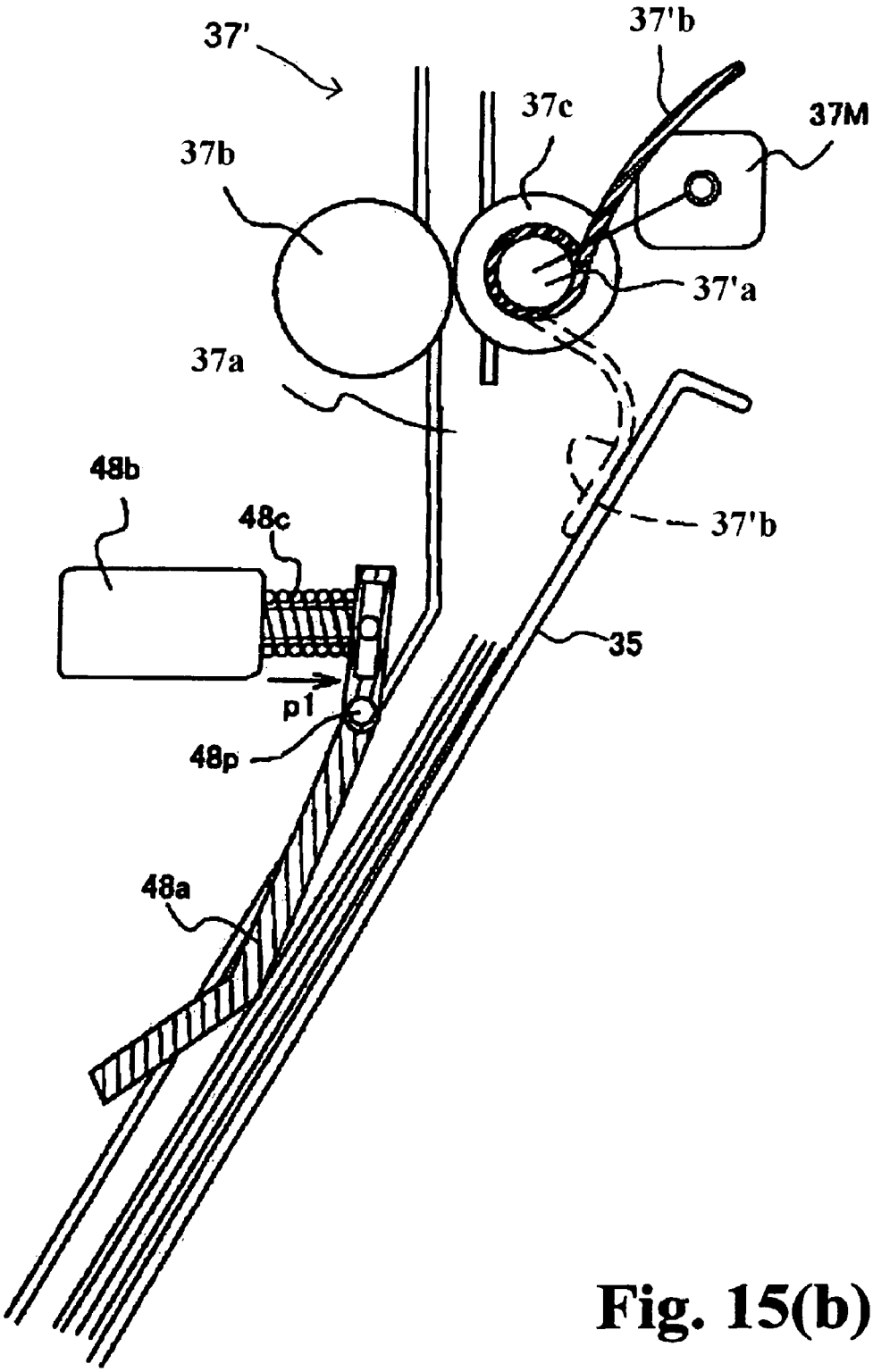

FIGS. 15(*a*) and 15(*b*) show a first embodiment of the carry-in guide 37'. The illustrated carry-in guide 37' is composed of an elastically deformable elastic guide piece 37A (hereinafter referred to as a "paddle piece"). The elastic guide piece 37A is composed of a flexible material such as a synthetic resin or rubber. A base end 37'*a* is pivotally supported via a shaft in the vicinity of the sheet discharging port 37a. A leading end 37'*b* is configured like a tongue hanging from the sheet discharging port 37*a* onto the collecting guide 35. The base end 37'*a* of the elastic guide piece 37A is coupled to the driving motor 37M (driving means). The elastic guide piece 37A is thus configured to lie above the uppermost sheet on the collecting guide 35 to guide the sheet from the sheet discharging port 37*a* as shown in FIG. 15(*a*) and to be elastically deformed to pass over the collecting guide 35 and return onto the uppermost sheet on the collecting guide 35 as shown in FIG. 15(*b*).

Figure 16A:
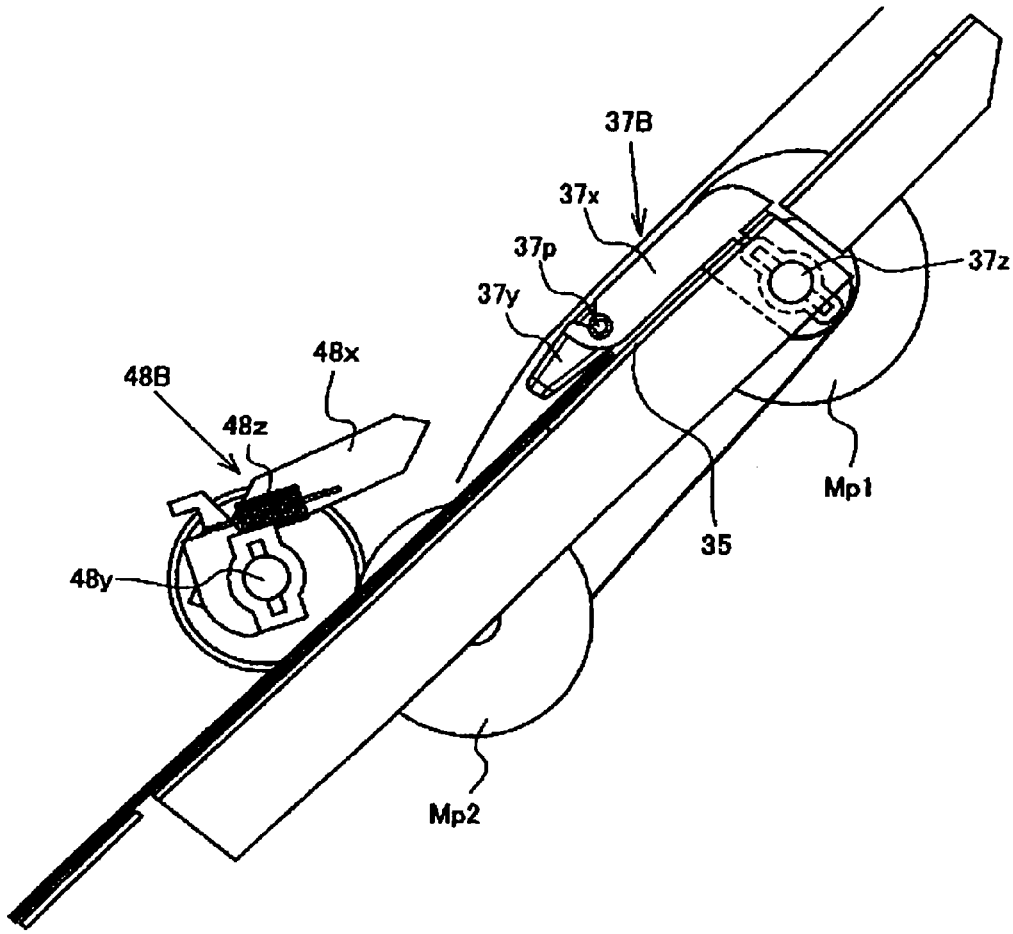
FIG. 16(*a*) is a diagram illustrating the configuration of a sheet carry-in guide and pressurizing means formed differently from those in FIG. 15.
Figure 16B:
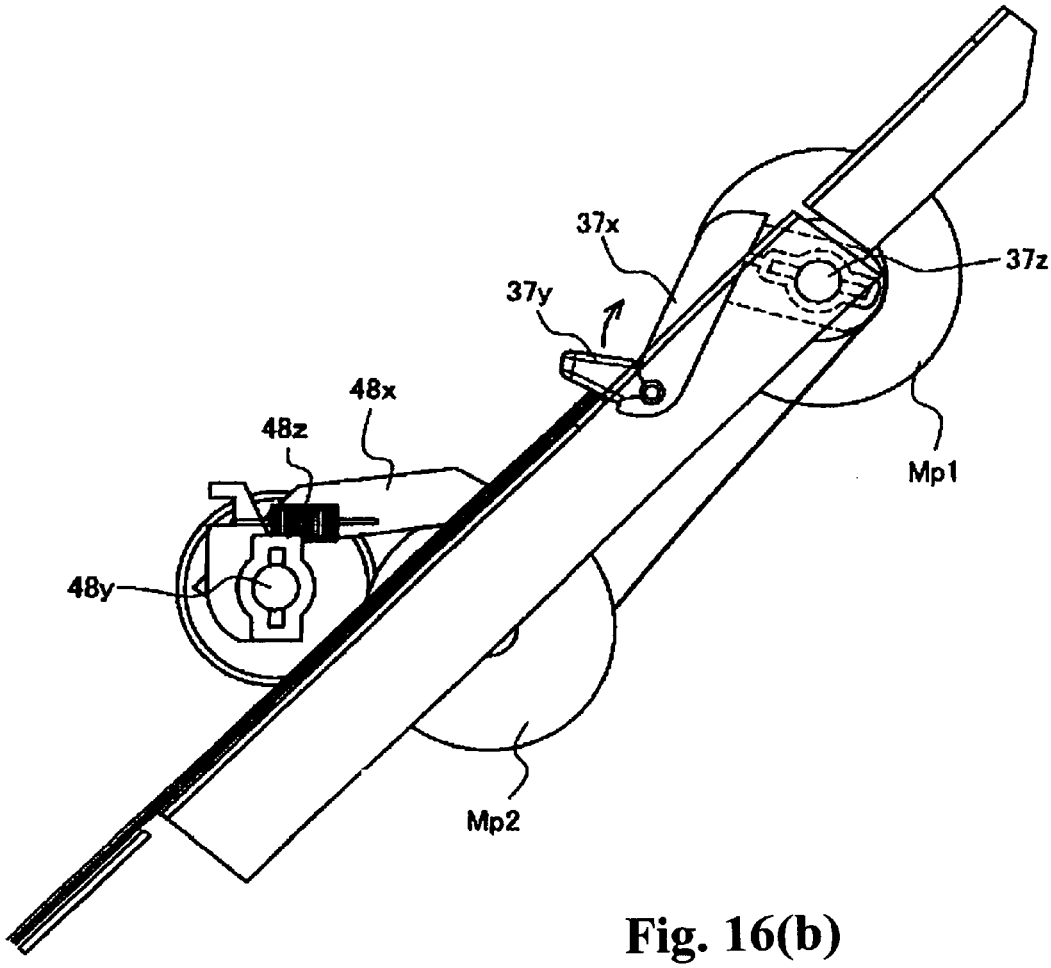
Figure 17:
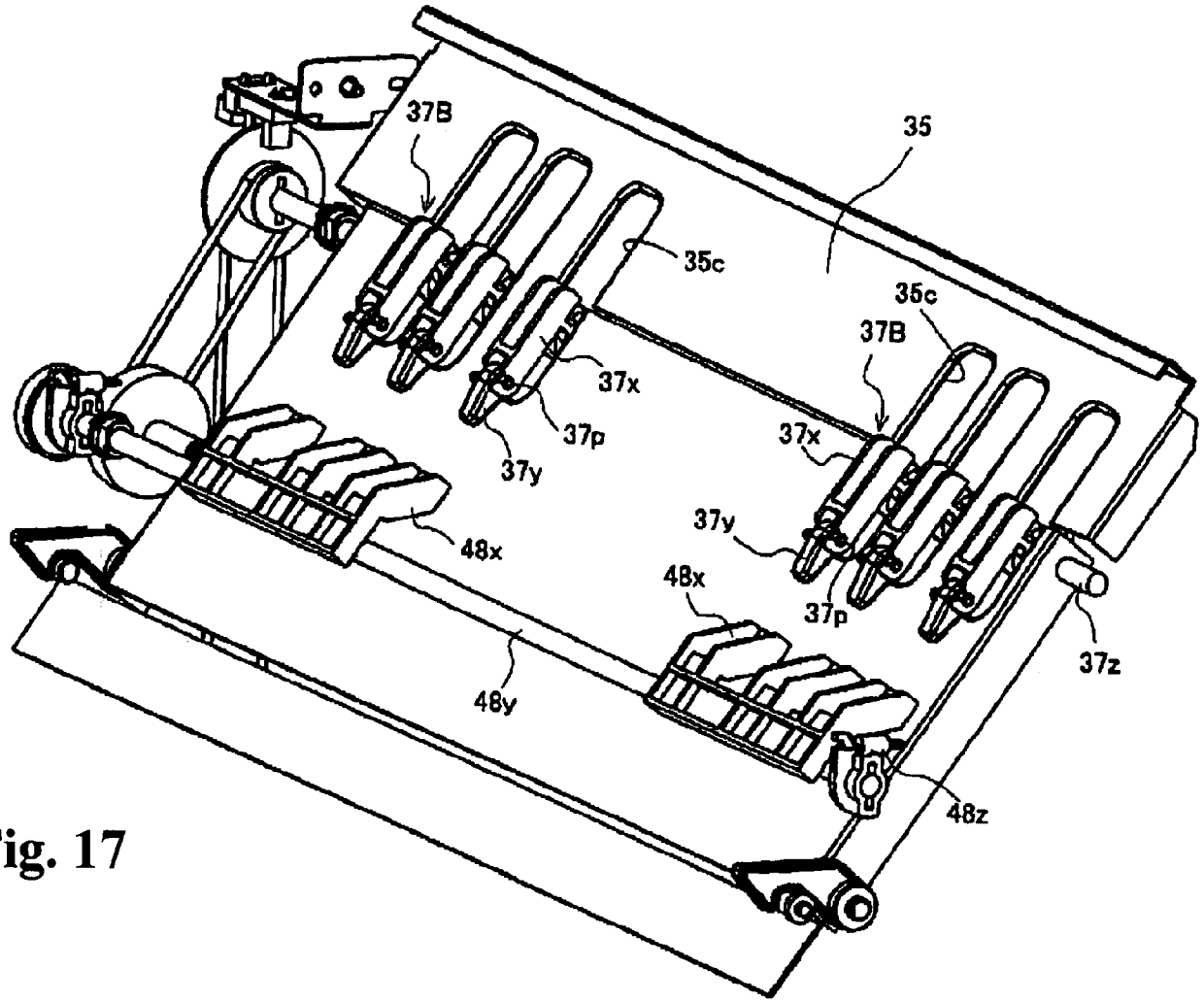
FIG. 17 is a perspective view illustrating the sheet carry-in guide and pressurizing means in FIG. 16.
Figure 18A:
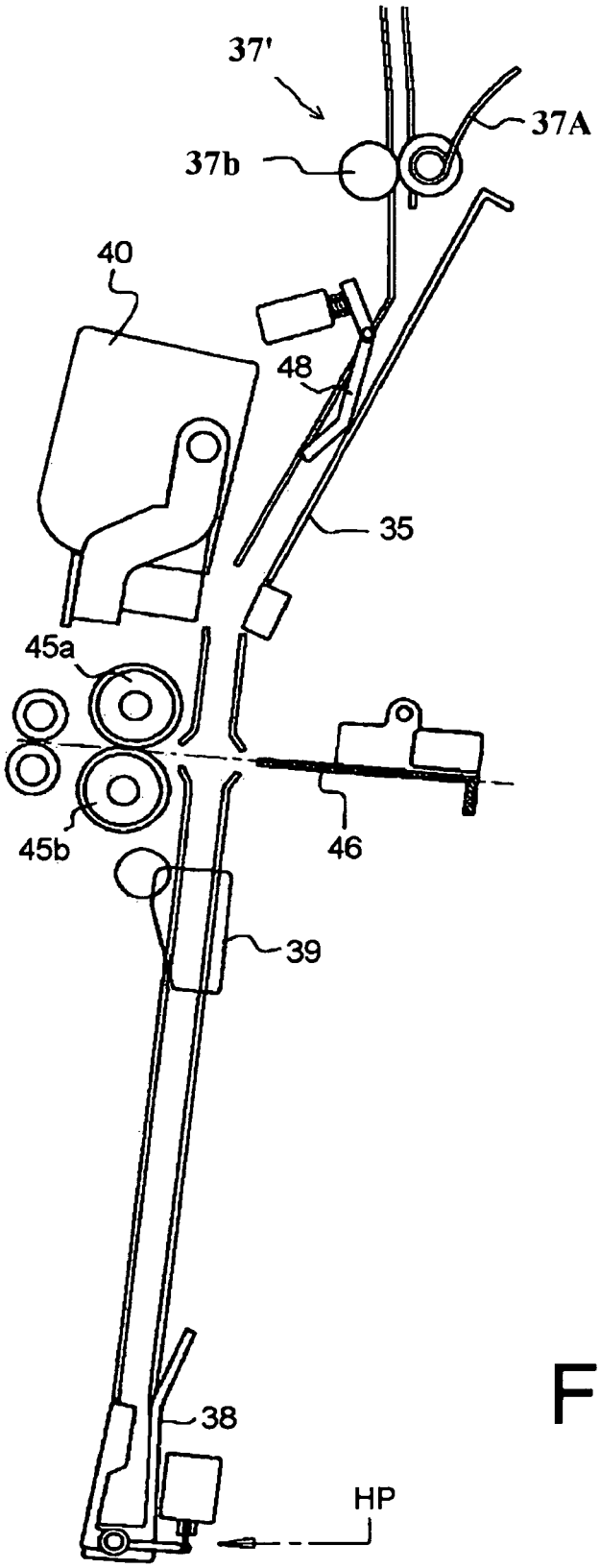
FIG. 18(*a*) is a state diagram illustrating an initial state of a sheet post-processing operation performed by the apparatus in FIG. 2.
Figure 18B:
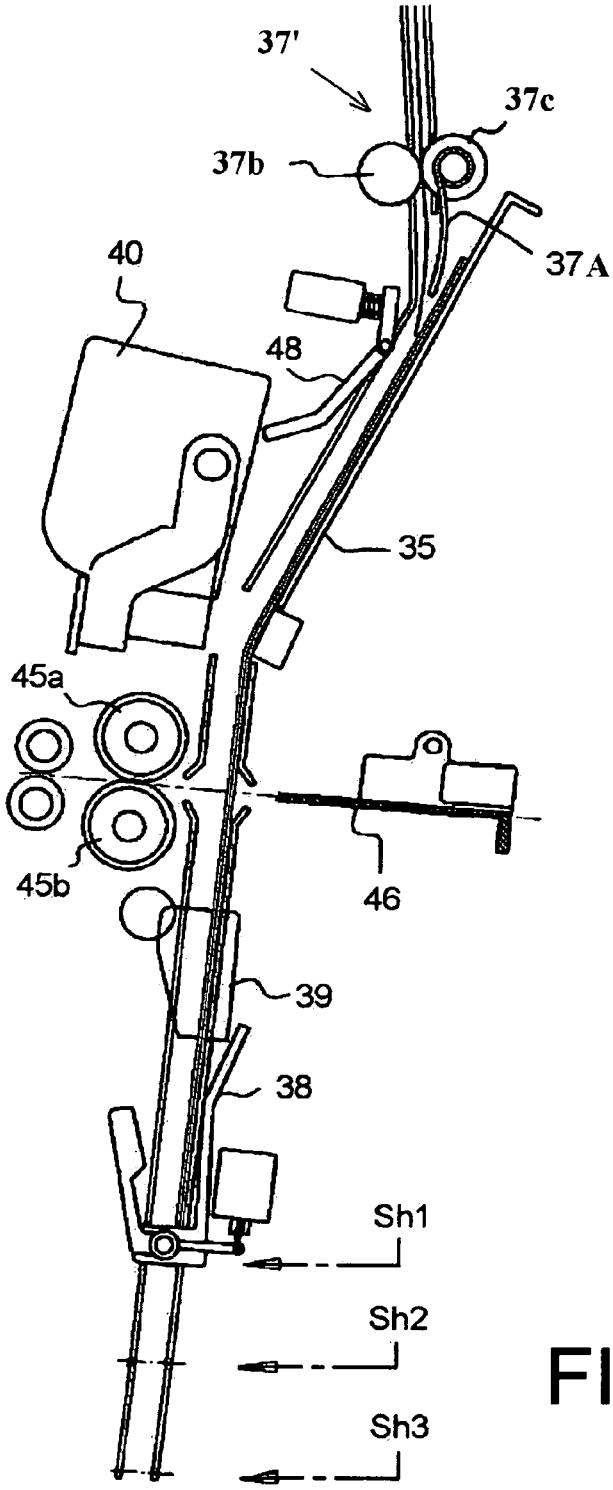
Figure 18C:
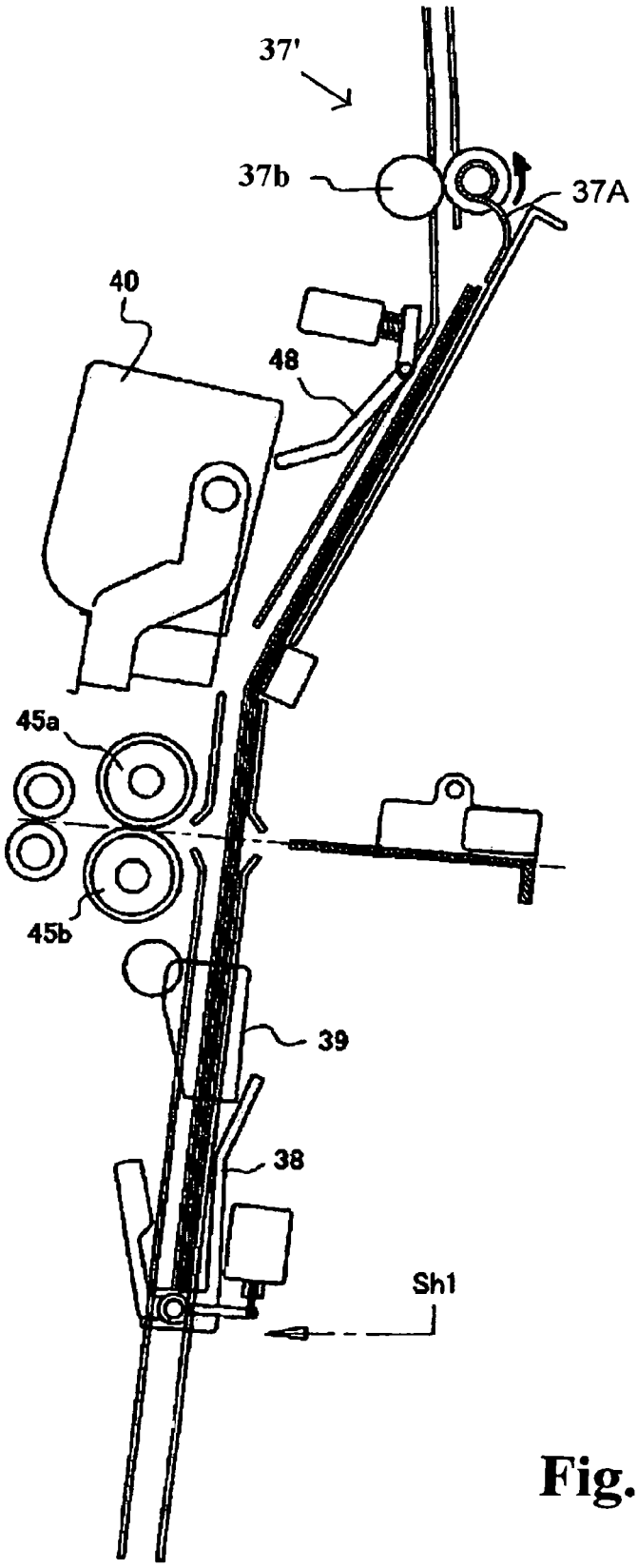
Figure 18D:
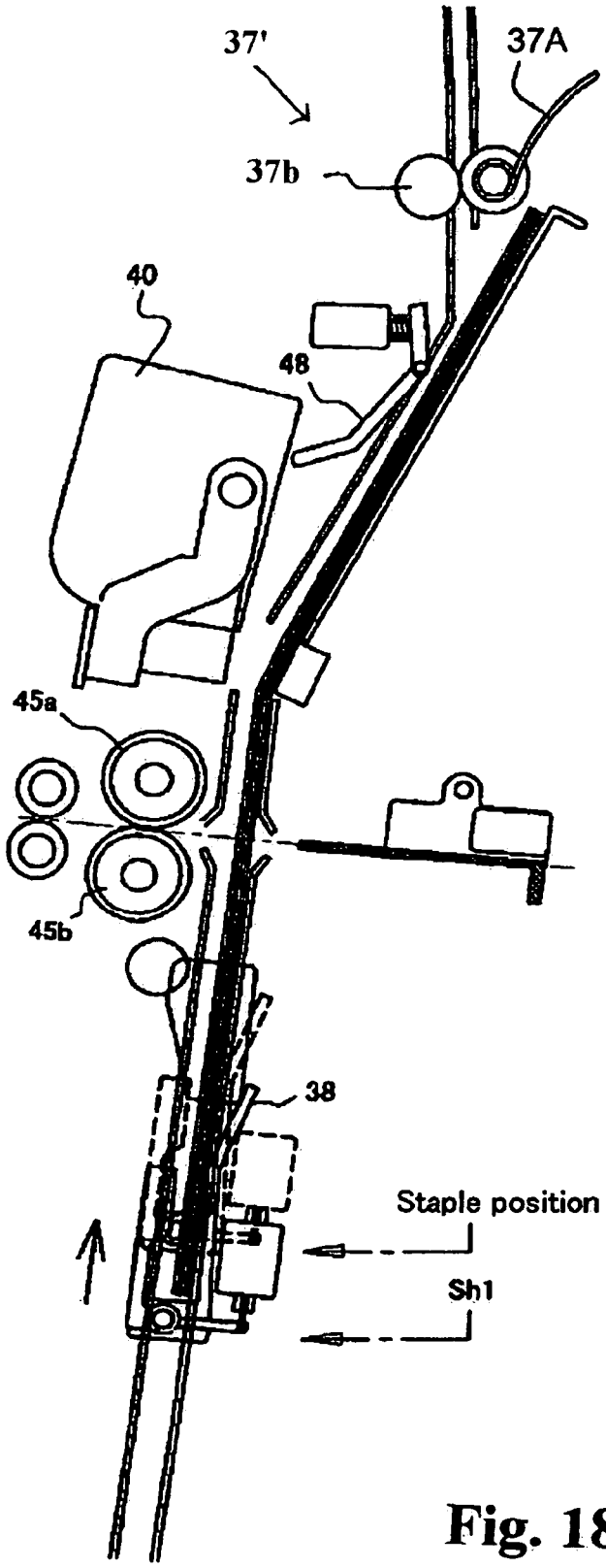
Figure 18E:
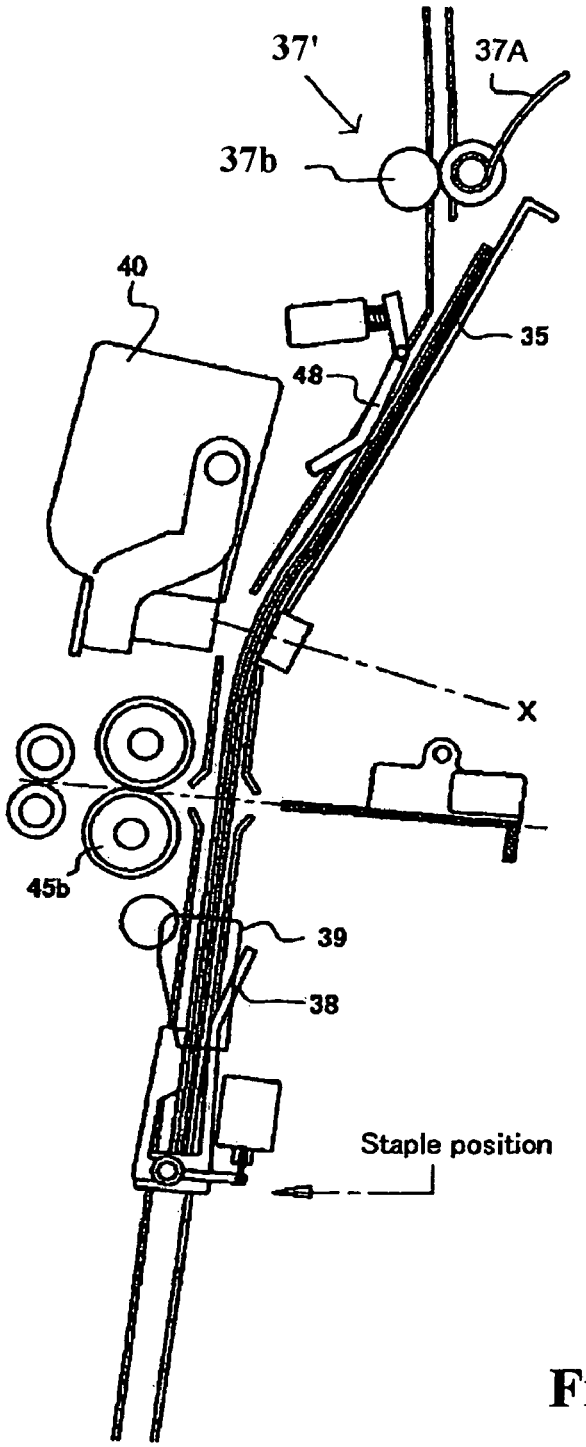
Figure 18F:
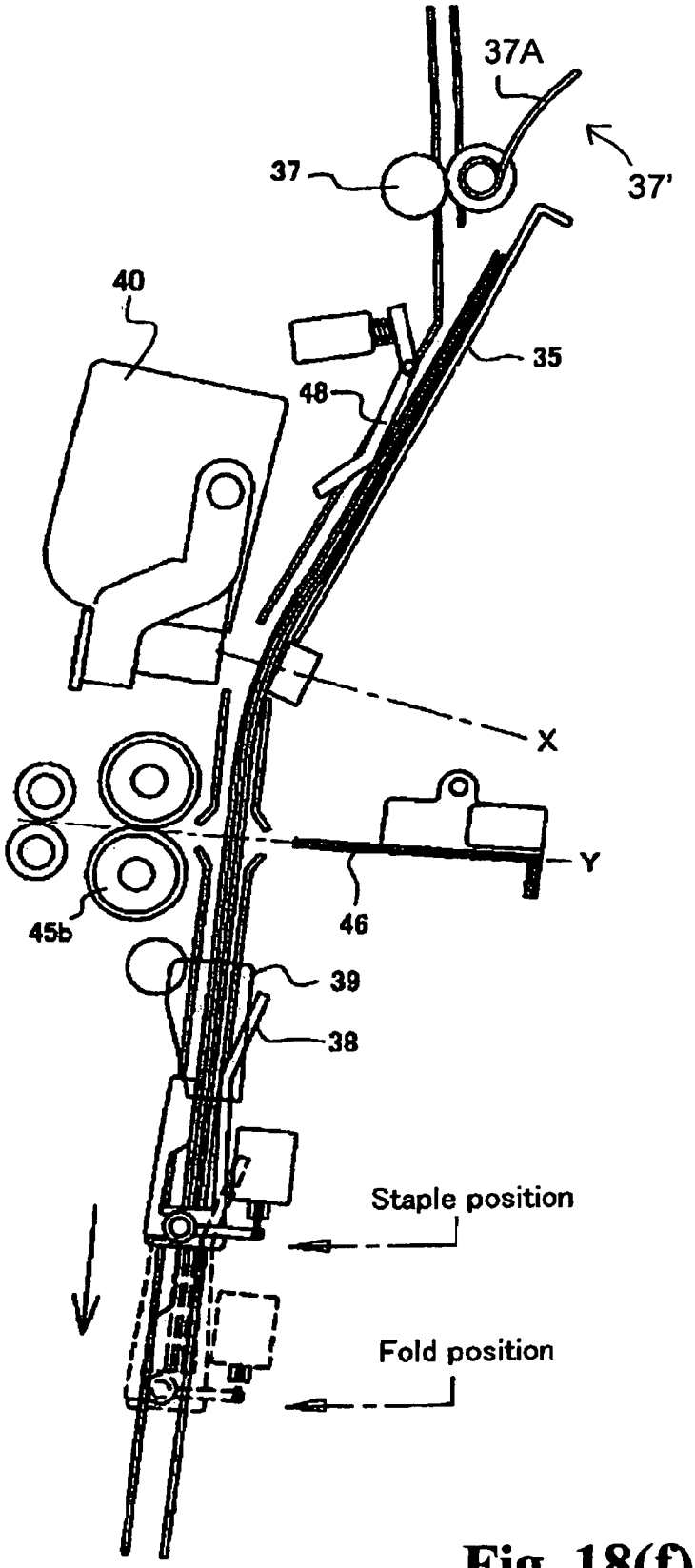
Figure 18G:
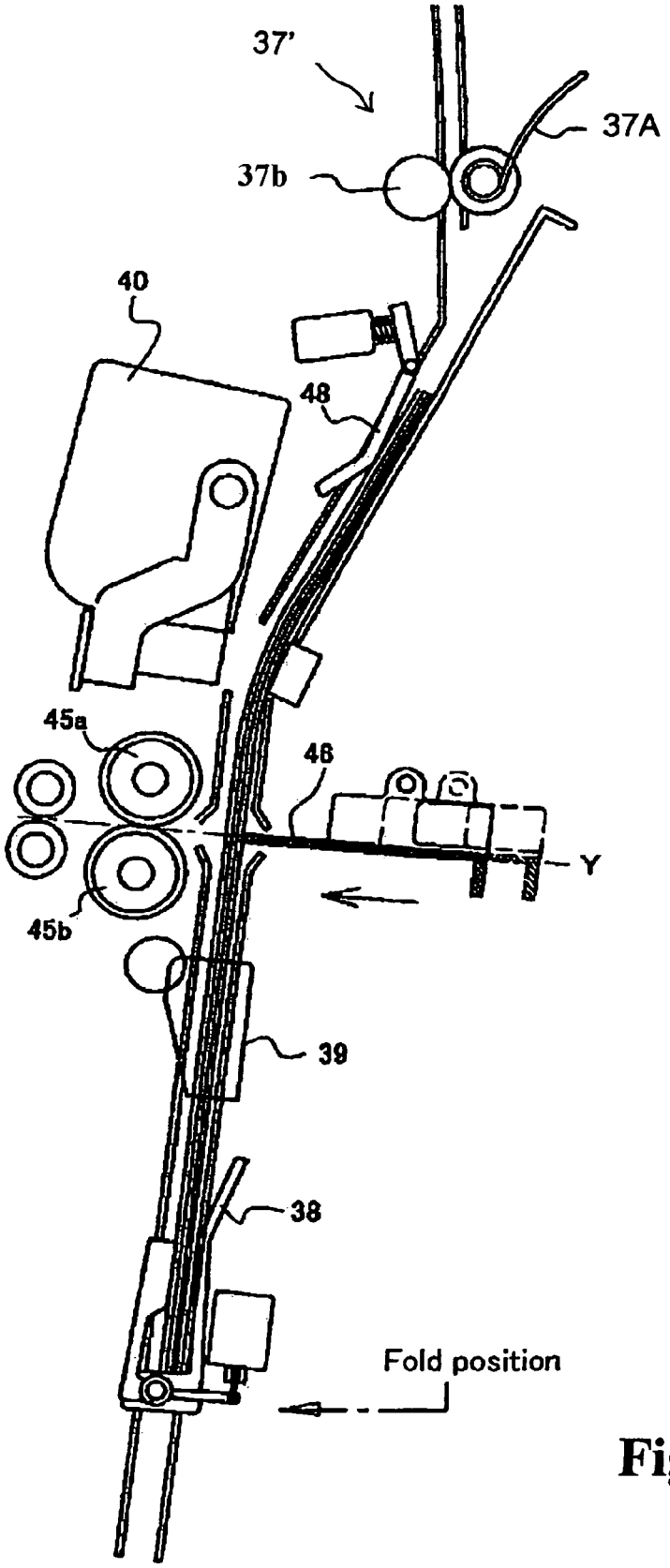
Figure 18H:
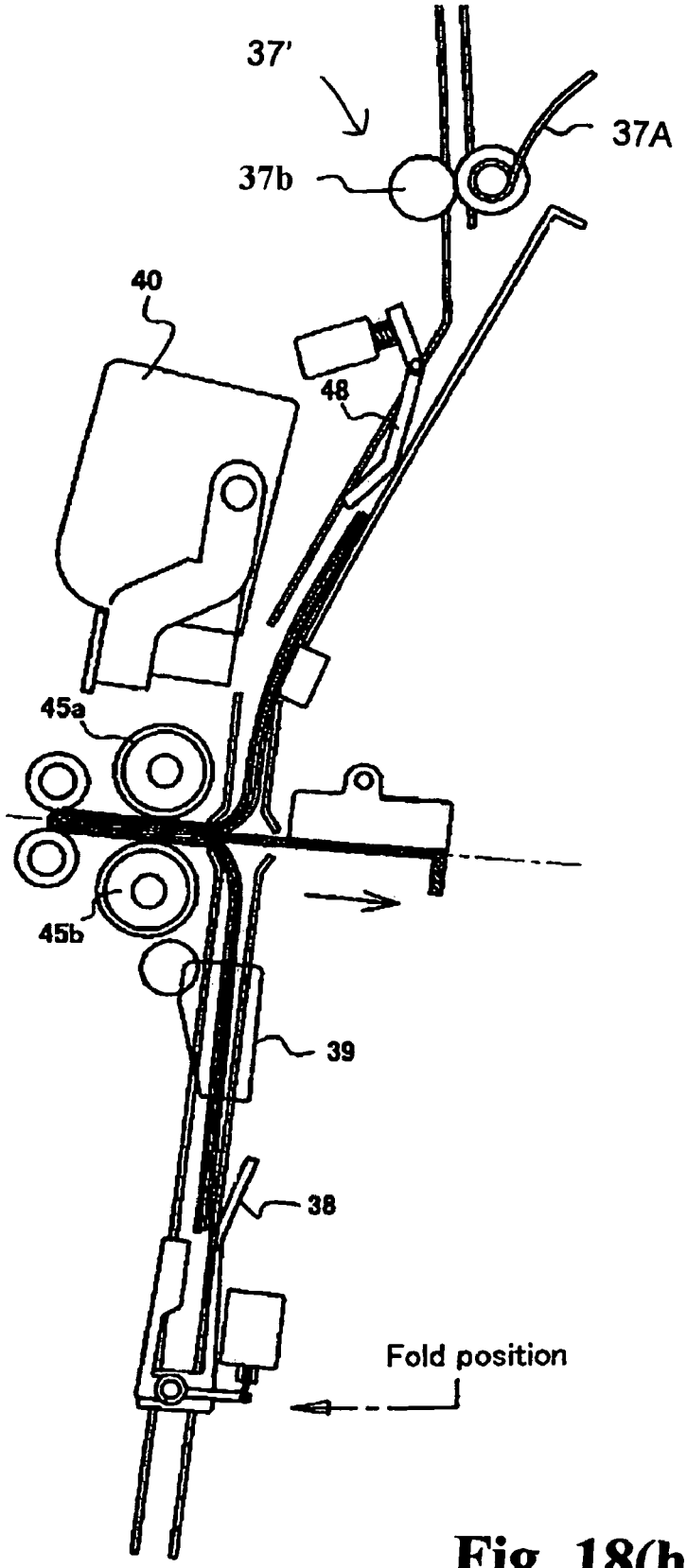

FIGS. 16(*a*), 16(*b*), and 17 show a different embodiment of the carry-in guide. In the first embodiment, the elastic guide piece 37A is elastically deformed every time the sheet is carried in. Thus, the repeated use of the guide piece may distort and deform a leading end thereof. To solve this durability problem, the second embodiment is configured as described below.

The sheet carry-in guide 37B, shown in FIGS. 16(*a*) and 16(*b*), is composed of a pivotal guide member 37*x* and a leading end guide member 37*y* attached to the pivotal guide member 37*x* via a shaft. The pivotal guide member 37*x* is pivotally supported by a rotating shaft 37*z* at a trailing end of the collecting guide 35. The pivotal guide member 37*x* is adapted to turn across an opening 35*c* formed in the collecting guide 35. A leading end guide member 37*y* is pivotally supported at a leading end of the pivotal guide member 37*x* via a shaft pin 37*p*. On the carry-in guide 37B configured as described above, a control motor Mp1 is coupled to the rotating shaft 37*z*. The control motor Mp1 rotates to turn the pivotal guide member 37*x* above the collecting guide 35. The leading end guide member 37*y* is located to engage the trailing end of the sheets on the collecting guide 35. The leading guide member 37*y* is configured to swing in the direction of an arrow around the shaft pin 37*p* as the pivotal guide member 37*x*, located at the base end thereof.

Thus, when the pivotal guide member 37*x* is positioned as shown in FIG. 16(*a*), the sheet from the sheet discharging port 36*a* is guided along a top surface of the pivotal guide member 37*x* and then a top surface of the leading end guide member 37*y* onto the uppermost sheet on the collecting guide 35. After the sheet is carried onto the collecting guide 35, the control motor Mp1 is rotated to rotate the pivotal guide member 37*x* counterclockwise in FIG. 16(*a*). The pivotal guide member 37*x* returns from the state in FIG. 16(*a*) to the state in FIG. 16(*b*). At this time, the leading end guide member 37*y* is obstructed by the sheets on the collecting guide 35 and thus swung so as to be folded around the center of the shaft pin 37*p*. The leading end guide member 37*y* thus returns to the state shown in FIG. 16(*a*).

The pressurizing means 48 is provided above the collecting guide 35 to urge the trailing end of the collected sheets together with the carry-in guide means 37'. The pressurizing means 48 urges the trailing end of the sheets when the sheets are stapled at the staple position X, described below, and/or when the sheets are folded together at the fold position Y, described below. The pressurizing means is configured as described below in a first embodiment and a second embodiment.

FIGS. 15(*a*) and 15(*b*) show a first embodiment of the pressurizing means. Illustrated pressurizing means 48A is composed of a paper urging piece 48*a* located at the trailing end of the collecting guide 35 to urge the sheet trailing end. The paper urging piece 48*a* is supported by a swing pin 48*p* so as to be pivotable above the collecting guide 35. The paper urging piece 48*a* is configured to be swingable between an urge position where the paper urging piece 48*a* pivots around the swing pin 48*p* to engage the uppermost sheet on the collecting guide 35 and the retract position where the paper urging piece 48*a* lies away from the uppermost sheet. An electromagnetic solenoid (driving means) 48*b* and a bias spring 48*c* are coupled to the paper urging piece 48*a*. The bias spring 48*c* always urges the uppermost sheet on the collecting guide 35 by a predetermined pressurizing force p1. The electromagnetic solenoid 48*b* separates the paper urging piece 48*a* from the uppermost sheet against the force of the bias spring 48*c*.

The pressuring force p1 is set to balance with a gripping force p2 exerted on the sheet leading end by the grip member 38*b*. The spring forces of the bias spring 48*c* and the bias spring 38S, acting on the grip member 38*b*, described above, are adjusted so as to exert substantially equal pressurizing forces on the sheet bunch on the collecting guide 35. Thus, when the folding blade means 46, described below, inserts the sheet bunch toward the folding roll means 45, the gripping force (pressure p2) of the grip member 38*b*, acting on the sheet bunch leading end, balances with the urging force (pressure p1) of the paper urging piece 48*a*, acting on the sheet bunch trailing end. Consequently, the spring pressures are preferably set so that the relationship between the pressure p2 of the sheet leading end and the pressure p1 of the sheet trailing end and the weight Sp of the average sheet bunch is [p1+Sp=p2].

A different embodiment of the pressurizing means will be described below.

FIGS. 16(*a*) and 16(*b*) show the configuration of the pressurizing means 48B for urging the sheet bunch on the collecting guide 35 in conjunction with the carry-in guide 37B. The paper urging piece 48*x*, which urges the sheet trailing end, is located above the collecting guide 35 so as to be swingable around a shaft 48*y*. The paper urging piece 48*x* is configured to pivot around the shaft 48*y* to move in the vertical direction between the urge position where the paper urging piece 48*x* urges the uppermost sheet on the collecting guide 35 and the retract position where the paper urging piece 48*x* lies away from the uppermost sheet. A bias spring 48*z* is provided on the paper urging piece 48*x* in a direction in which the bias spring 48*z* always urges the uppermost sheet. The shaft 48*y* has a cam member (not shown) that shifts the paper urging piece to the retract position away from the uppermost sheet against the force of the bias spring 48*z*. Thus, when a control motor Mp2 coupled to the shaft 48*y* is rotated to position the carry-in guide 37B above the uppermost sheet on the collecting guide 35, the pressurizing means 48B is synchronously placed at the standby position (located away from the uppermost sheet). When the carry-in guide 37B is positioned away from the collecting guide 35, the pressurizing means 48B is synchronously placed at the position where the pressurizing means 48B urges the uppermost sheet. The spring pressure of the bias spring 48*z* is set so that in this case, the pressure p1, exerted on the sheet trailing end by the paper urging piece 48*x*, balances with the pressurizing force p2 of the grip member 38*b*, which grips the sheet leading end.

Now, with reference to FIGS. 11(*a*) to 11(*h*), description will be given of the sheet collecting (setting) operation and post-processing operation, performed by the post-processing apparatus, in connection with another embodiment. The present embodiment differs from the process operation described with reference to FIGS. 14(*a*) to 14(*d*) in that the former involves the operation of the paper urging piece 48*a*, which urges the sheet trailing end, and of an elastic guide piece 37A.

FIG. 18(*a*) shows an initial state immediately before the carry-out of the sheets from the image forming apparatus A to the post-processing apparatus B. In this case, the carry-in guide 37'A (the carry-in guide 37" is the same as the carry-in guide 37'; this also applies to the description below) is located at a home position (shown in FIG. 18(*a*)) different from the guide position on the collecting guide. The pressurizing means 48A (the pressurizing means 48B is the same as the pressurizing means 48A; this also applies to the description below) is located at the urge position (home position; illustrated position) on the collecting guide 35. The grip means 38*b* is located at the grip position (home position; illustrated position).

Control means provided in the post-processing apparatus B and composed of, for example, a CPU (not shown), receives sheet discharging instruction signal and sheet size information from the image forming apparatus A. On the basis of the sheet size information, the control means moves the sheet end regulating means 38 from the home position to a position corresponding to the sheet length (Sh1, Sh2, or Sh3 in FIG. 18 (*b*)). The position Sh is preset so as to align the trailing end of the sheet fed by the image forming apparatus A with a predetermined position Z on the collecting guide 35.

The control means receives the sheet fed by the image forming apparatus A on the sheet carry-in path P1 and feeds the sheet to the downstream sheet discharging roller 30 via the conveying roller 24. The control means uses the sheet sensor S1 on the sheet conveying path P1 to detect the sheet trailing end. At the time when the sheet trailing end is expected to pass through the path switching piece 27, the control means actuates the path switching piece 27. At this time, the control means moves the path switching piece 27 so as to move the sheet to the second switchback conveying path SP2. The control means subsequently reverses the sheet discharging roller 30 to carry the sheet trailing end into the second switchback conveying path SP2.

Simultaneously with the above-described operation, the control means moves the carry-in guide 37', the pressurizing means 48A, and the grip member 38*b* to the sheet guide position, the retract position, and the retract position, respectively, as shown in FIG. 18(*b*). The carry-in guide 37' rotates the driving motor 37M through a predetermined angle on the basis of a home position sensor 37*hs* to move the elastic guide piece 37A to the guide position. The sheet is thus guided onto the collecting guide 35 through the sheet discharging port 37*a*. The pressurizing means 48A supplies power to the electromagnetic solenoid 48*b* to move to the retract position where the paper urging piece 48*a* lies away from the uppermost sheet on the collecting guide 35. The grip member 38*b* turns on the actuating solenoid 38L to move to an inoperative position (release position) where the grip member 38*b* is retracted from the sheets. In this condition, the control means actuates sheet discharging rollers 37*b* and 37*c* to feed the sheet (carried-in sheet) guided onto the second switchback conveying path SP2, onto the collecting guide 35.

Simultaneously when the carried-in sheet reaches the collecting guide 35 on the basis of a sheet end sensing signal from the sheet sensor S2, located at the sheet discharging port 37*a*, the control means rotationally drives the driving motor 37M for the carry-in guide 37'. The elastic guide piece 37A then turns around the base end 37'*a* thereof above the collecting guide 35. At this time, the leading end 37'*b* engaging the sheets on the collecting guide 35 is elastically deformed and turns along the collecting guide 35. The elastic guide piece 37A rotates through 360° and the leading end thereof returns onto the carried-in sheet. In this condition, when the succeeding sheet is carried in through the sheet discharging port 37*a*, the carried-in sheet is guided onto the uppermost sheet on the collecting guide 35 as described above. The repetition of this operation allows the sheets fed to the sheet discharging port 37*a* to be sequentially stacked on the collecting guide 35.

Once the series of sheets are collected on the collecting guide 35, the control means executes the post-processing on the sheet bunch on the collecting tray 29 in response to the "job end signal" from the image forming apparatus A. The illustrated apparatus is configured to execute the stapling process and then the folding process on the sheet bunch collected on the collecting guide 35. Thus, upon receiving the job end signal, the control means turns on the actuating solenoid 38L of the grip means 38*b* to grip the leading edge of the sheet bunch. At this time, the carry-in guide 37' moves to retract position (home position; illustrated position) where the carry-in guide 37' is retracted from the collecting guide 35. The pressurizing means 48A is held at the standby position (the electromagnetic solenoid 48*b* is on).

The control means uses the shift means MS to move the position of the leading end regulating unit (leading end locking member 38*a* and gripping member 38*b*). This position movement is such that the predetermined position (for example, the sheet center) of the sheet bunch positioned by the leading end locking member 38*a* and gripped by the grip member 38*b* is moved to the staple position X.

Then, the control means moves the sheet bunch on the collecting guide 35 to the staple position X and then moves the processing means 48A to the urge position. In this operation, the electromagnetic solenoid 48*b* is switched from standby position (ON state) to the urge position (OFF state) to shift the paper urging piece 48*a* from the retract position to the urge position. Then, the leading end of the sheet bunch position placed at the staple position X is gripped by the grip member 38*b*, whereas the trailing end thereof is urged and held by the paper urging piece 48*a* of the pressurizing means 48A. In this condition, the control means actuates the staple device 40 to execute the stapling operation on the sheet bunch. The stapling operation of the staple device 40 is as described above.

After the stapling operation is finished, the control means moves the staled sheet bunch to the downstream fold position Y. When the sheet bunch is moved to the downstream fold position Y, the paper urging piece 48*a* of the pressurizing means 48A is held at the position where the paper urging pierce 48*a* urges the trailing end of the sheet bunch. Furthermore, the grip member 38*b* grips the leading end of the sheet bunch. Subsequently, with the opposite ends of the sheet bunch held by the pressurizing means 48A and the grip member 38*b*, the control means allows the shift means MS to move the leading end regulating unit to move the sheet bunch to the fold position Y. The opposite ends of the sheet bunch are held to appropriately stretch the sheet bunch which improves the folding accuracy.

Once the sheet bunch moves to the predetermined fold position, the control means shifts the paper urging piece 48*a* of the pressurizing means 48A to the urge position. In this shifting operation, the electromagnetic solenoid 48*b* is turned off to allow the bias spring 48*c* to urge and bias the paper urging piece 48*a* toward the collecting guide 35. The leading end of the sheet bunch on the collecting guide 35 is held by the grip member 38*b*, while the trailing end thereof is urged and held by the paper urging piece 48*a*, as shown in FIG. 18 (*g*). The control means folds the sheet bunch in accordance with a procedure described below. As shown in FIG. 18(*h*), the sheet bunch with the leading and trailing ends thereof pressurized by the grip member 38*b* and the paper urging piece 48*a*, respectively, has the center thereof bent by the folding blade and folded by the folding rolls. FIG. 18(*g*) shows that the bending operation is started, and FIG. 18(*h*) shows that the sheet bunch has left the grip member and the paper urging piece.

Figure 19:
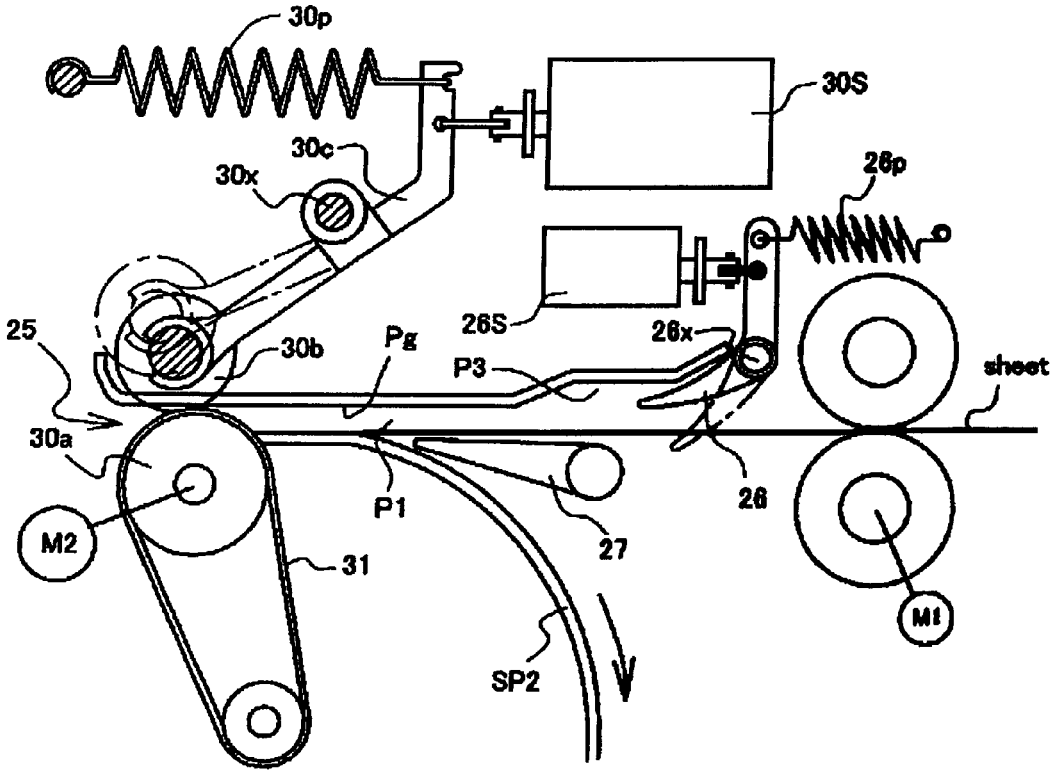
FIG. 19 is a diagram showing the configuration of an essential part of sheet conveying means of the apparatus in FIG. 2.

Now, with reference to FIG. 19, a supplementary description will be given of the sheet carry-in path. The sheet carry-in path P1 comprises the carry-in port 23 and the sheet discharging port 25 and is located in a device housing so as to extend in a substantially horizontal direction; the sheet carry-in path P1 is entirely shown in FIG. 2, and an essential part thereof is shown in FIG. 19. The carry-in roller 24 and the sheet discharging roller 30 are arranged between the carry-in port 23 and the sheet discharging port 25. A standby path P3 is located on the sheet carry-in path P1 so that sheets can stand by temporarily on the standby path P3. The carry-in roller 24 is composed of a pair of rollers that are in pressure contact with each other. The carry-in roller 24 is coupled to the driving roller M1 (not shown) to transfer the sheet from the carry-in port 23 to the sheet discharging port 25. The sheet discharging roller 30 is composed of a driving roller 30*a* and the pinch roller 30*b*. The driving roller 30*a* is coupled to the forward reverse motor M2.

The driving roller 30*a* and the pinch roller 30*b* (hereinafter collectively referred to as the "forward reverse roller 30"), constituting the sheet discharging roller 30, is connected to the forward reverse motor M2 and configured to reverse the conveying direction of the sheets for switchback conveyance. As shown in FIG. 19, the pinch roller 30*b* is configured to be movable between a position, where the pinch roller 30*b* is in pressure contact with the driving roller 30*a* (as shown by a solid line in the figure), and a retract position, (shown by a dotted line in the figure) separate from the pressure contact position. A roller support lever 30*c*, in FIG. 19, is supported so as to be able to swing around a shaft 30*x*. A bias spring 30*p* is disposed between the roller support lever 30*c* and the apparatus frame to bias the pinch roller 30*b* toward the driving roller 30*a*. An actuating solenoid 30S is coupled to the roller support lever 30*c*. The pinch roller 30*b* can be separated from the driving roller 30*a* (as shown by the dotted line FIG. 19) by energizing the actuating solenoid 30S.

The sheet carry-in path P1 has a path switching piece (path switching means) 27 located at a branching point of the second switchback conveying path SP2 and the standby path P3 located upstream of the path switching piece 27 to temporarily hold sheets traveling to the second switchback conveying path SP2. The standby path P3 is composed of a standby area formed by swelling an upper guide Pg of the sheet carry-in path P1 upward and in which sheets fed to the sheet carry-in path P1 stand by temporarily, and a flapper guide (flapper means) 26 for biasedly holding the sheet trailing end in the standby area. The flapper guide 26 is configured to be swingable between a scoop-up posture (shown by a dotted line in FIG. 19) position, at which the flapper guide 26 enters the path so as to guide the trailing end of the sheet fed into the sheet carry-in path P1, to the standby area and a standby posture (shown by a solid line in FIG. 19) position, to which the flapper guide 26 retracts upward from the sheet carry-in path P1 to hold the trailing end of the sheet in the standby area. Reference numeral 26*x* in the figure denotes a swing shaft. Reference numeral 26*p* in the figure denotes a bias spring that biases The sheet carry-in path P1 also has the post-processing unit 28 (see FIG. 2) located on the sheet carry-in path P1 between the carry-in port 23 and the carry-in roller 24, such as stamp means for stamping the sheet from the carry-in port 23 or punch means for punching the sheet. The illustrated post-processing unit 28 is located downstream of the carry-in port 23 and upstream of the carry-in roller 24 so as to be releasable from the casing 20 according to device specifications.

Figure 20:
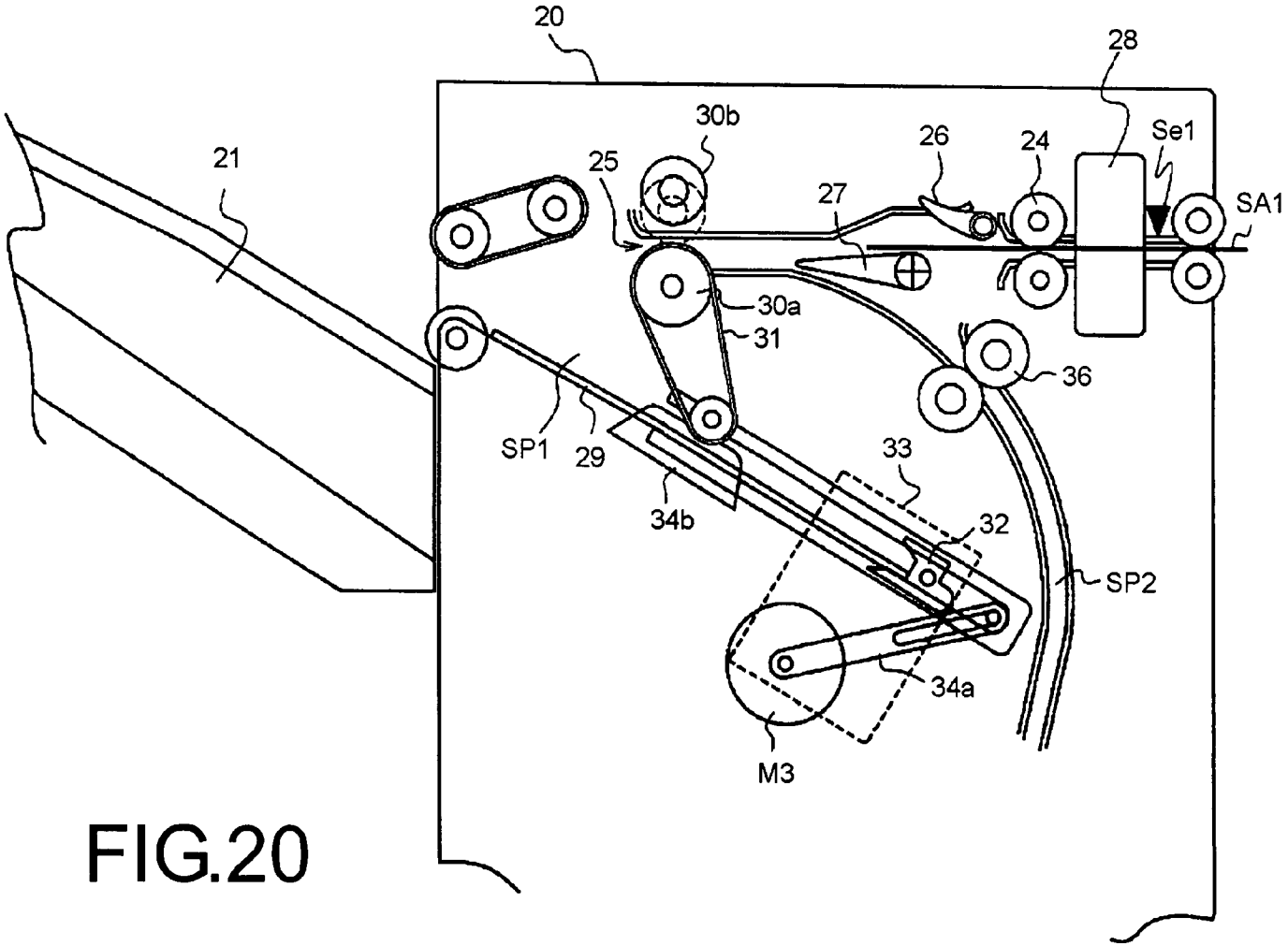
Figure 21A:
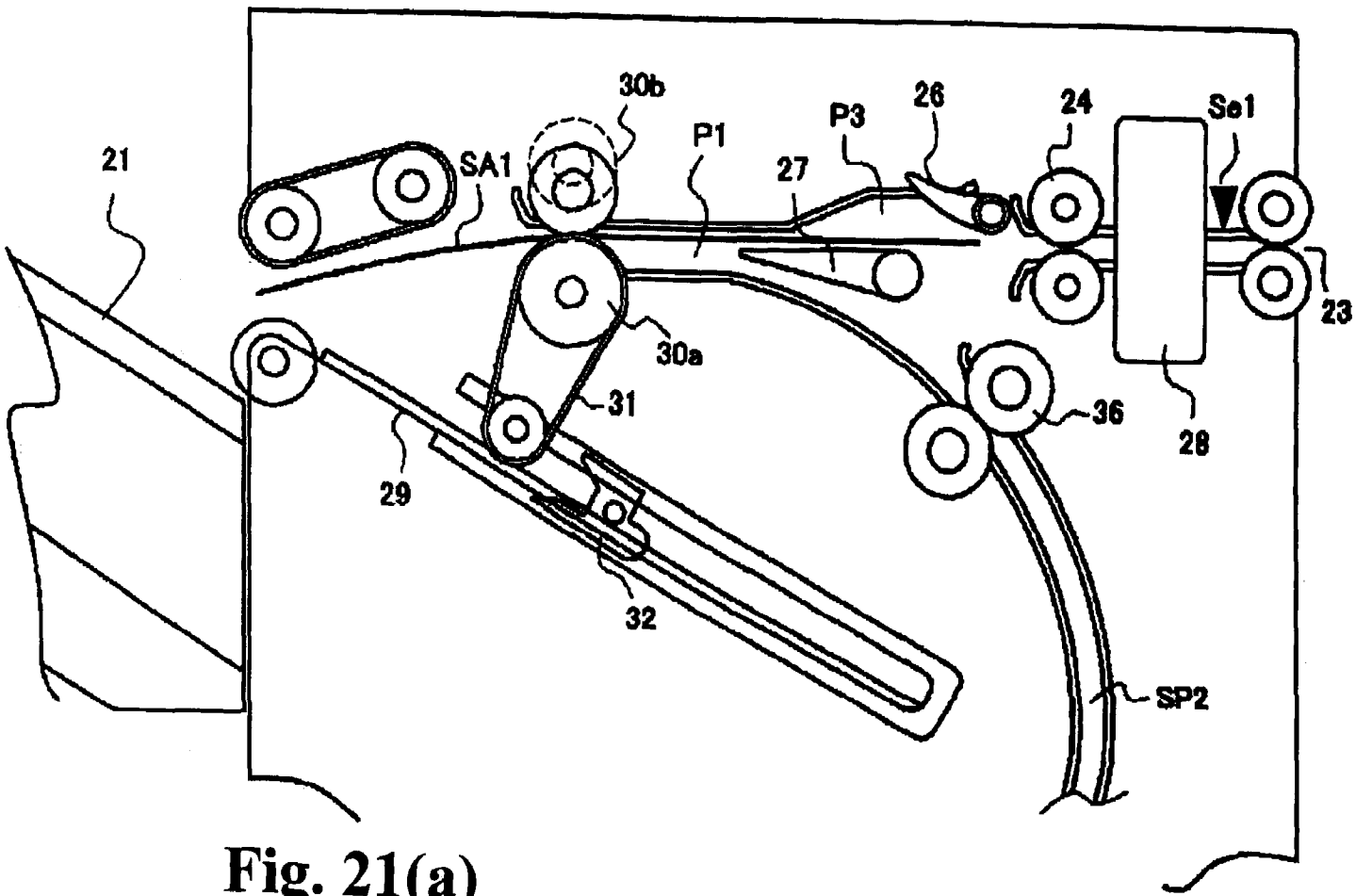
FIG. 21(*a*) is a state diagram illustrating a preceding sheet standby state and showing that the preceding sheet has reached a sheet discharging roller.
Figure 21B:
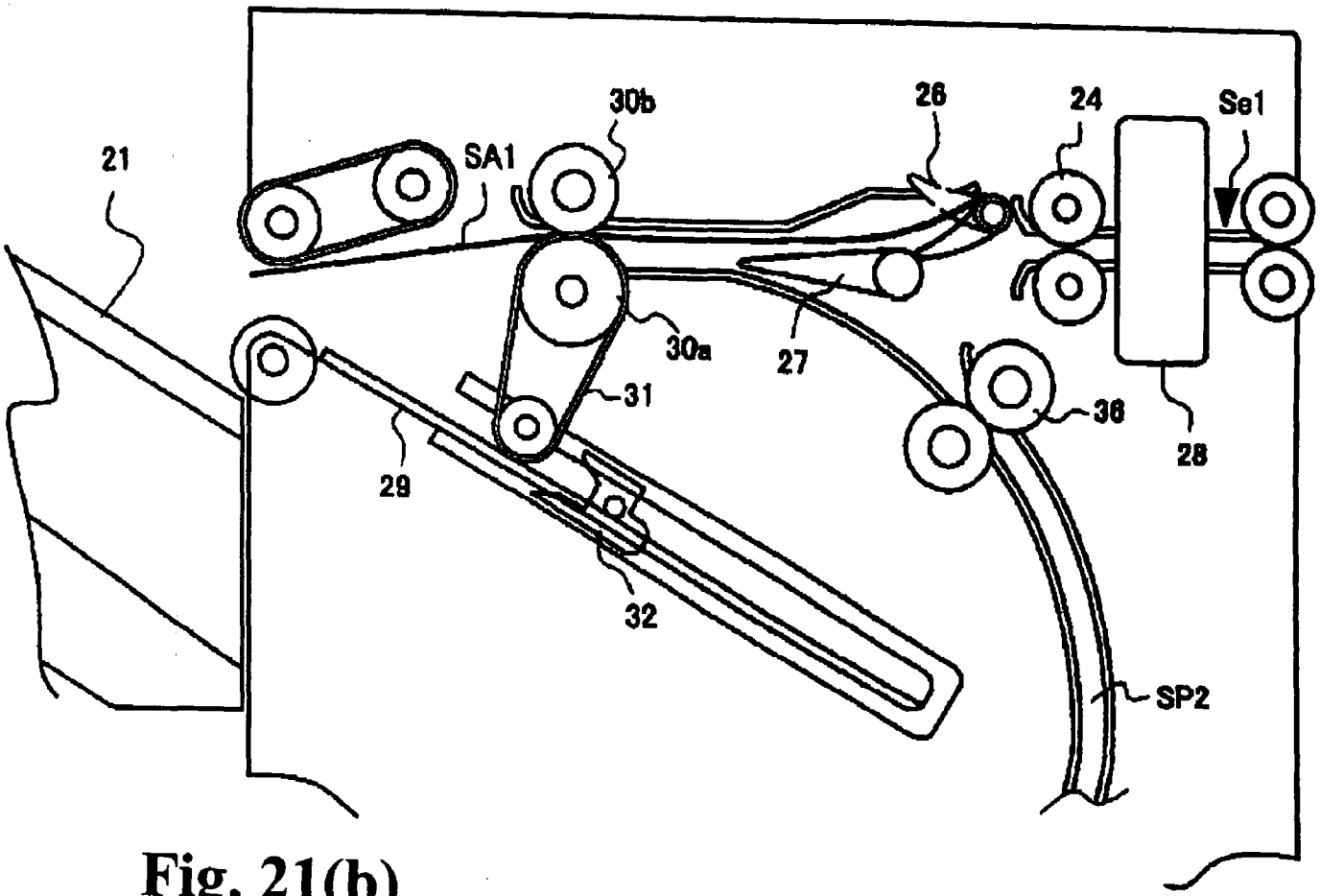
Figure 21C:
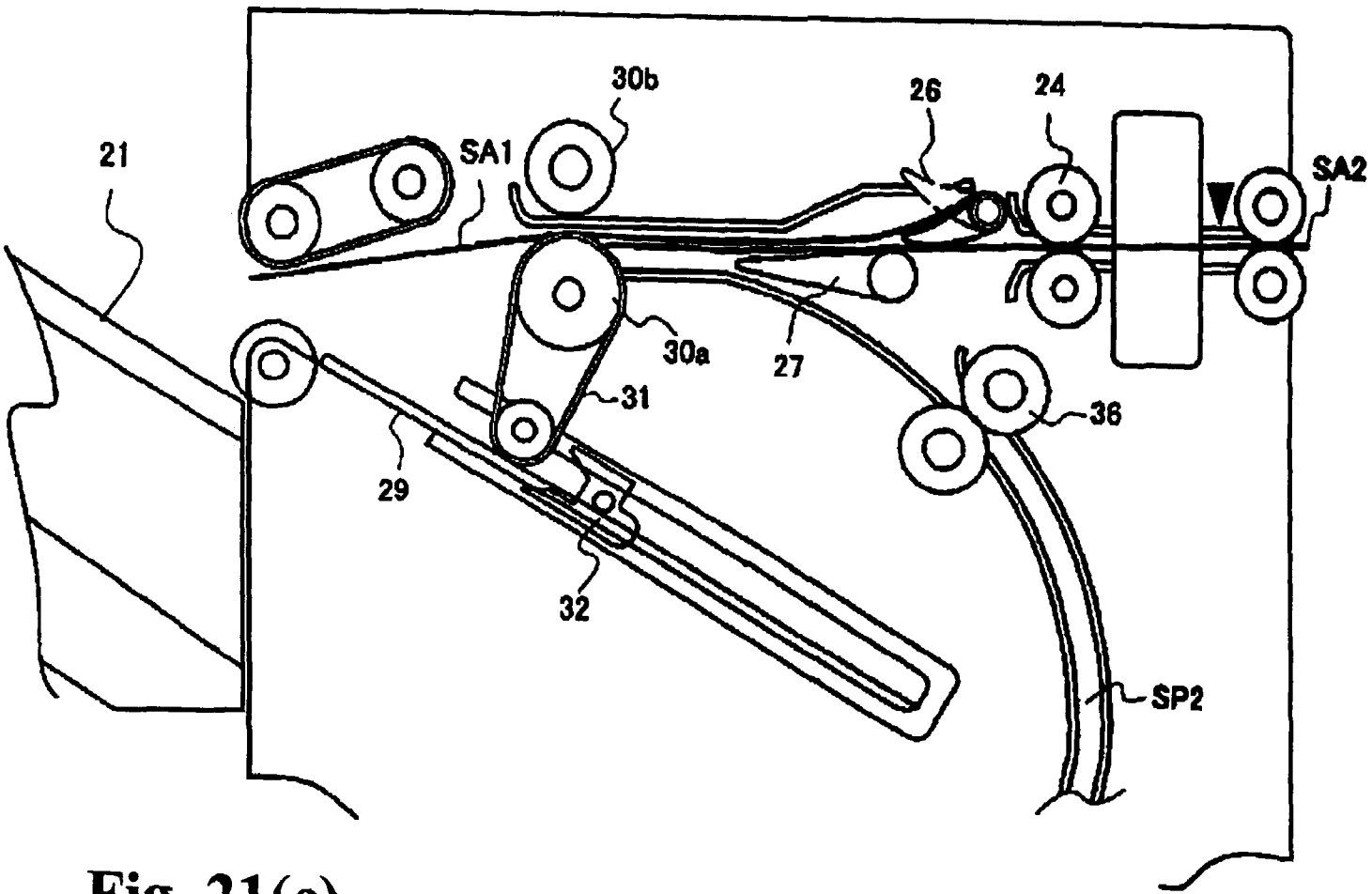
Figure 21D:
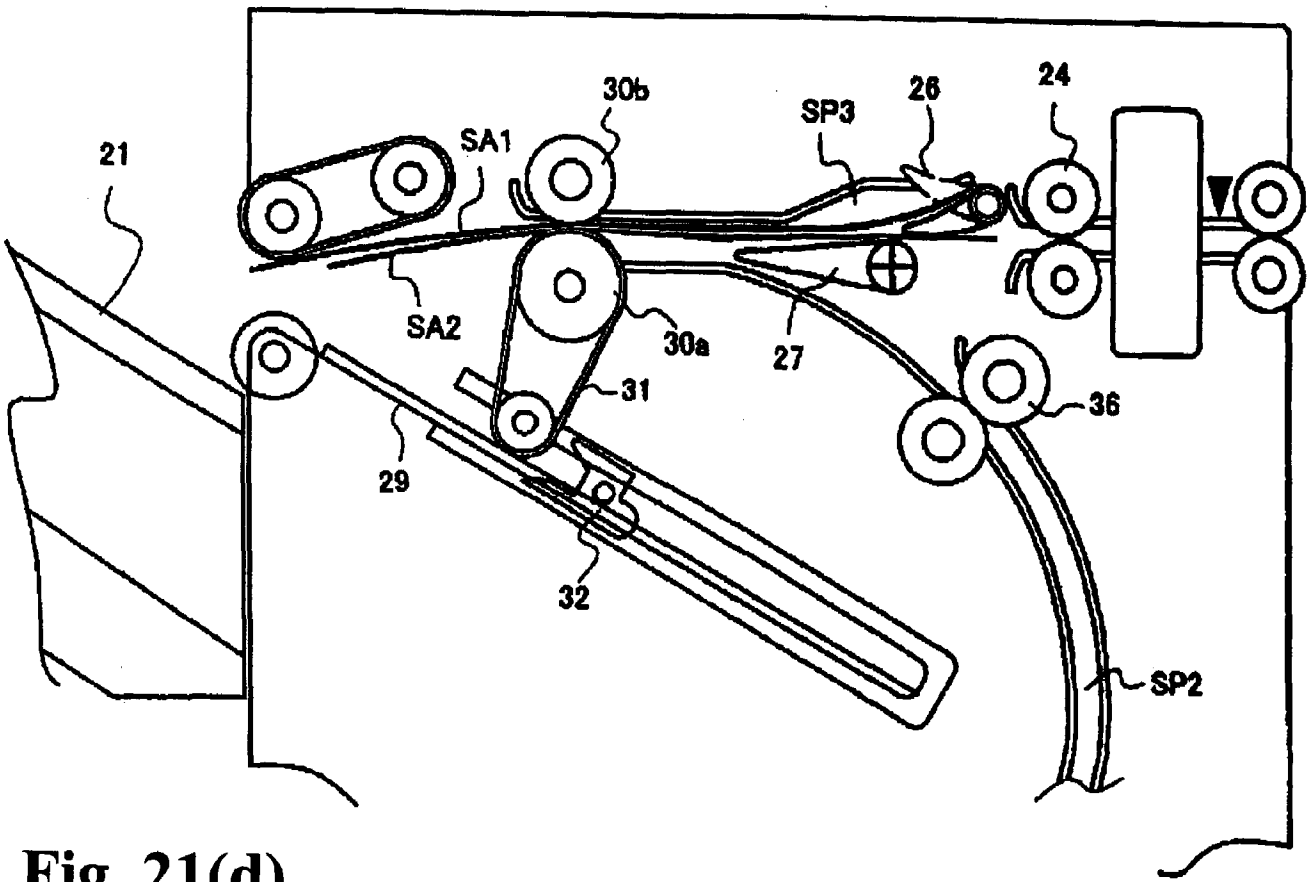
Figure 21E:
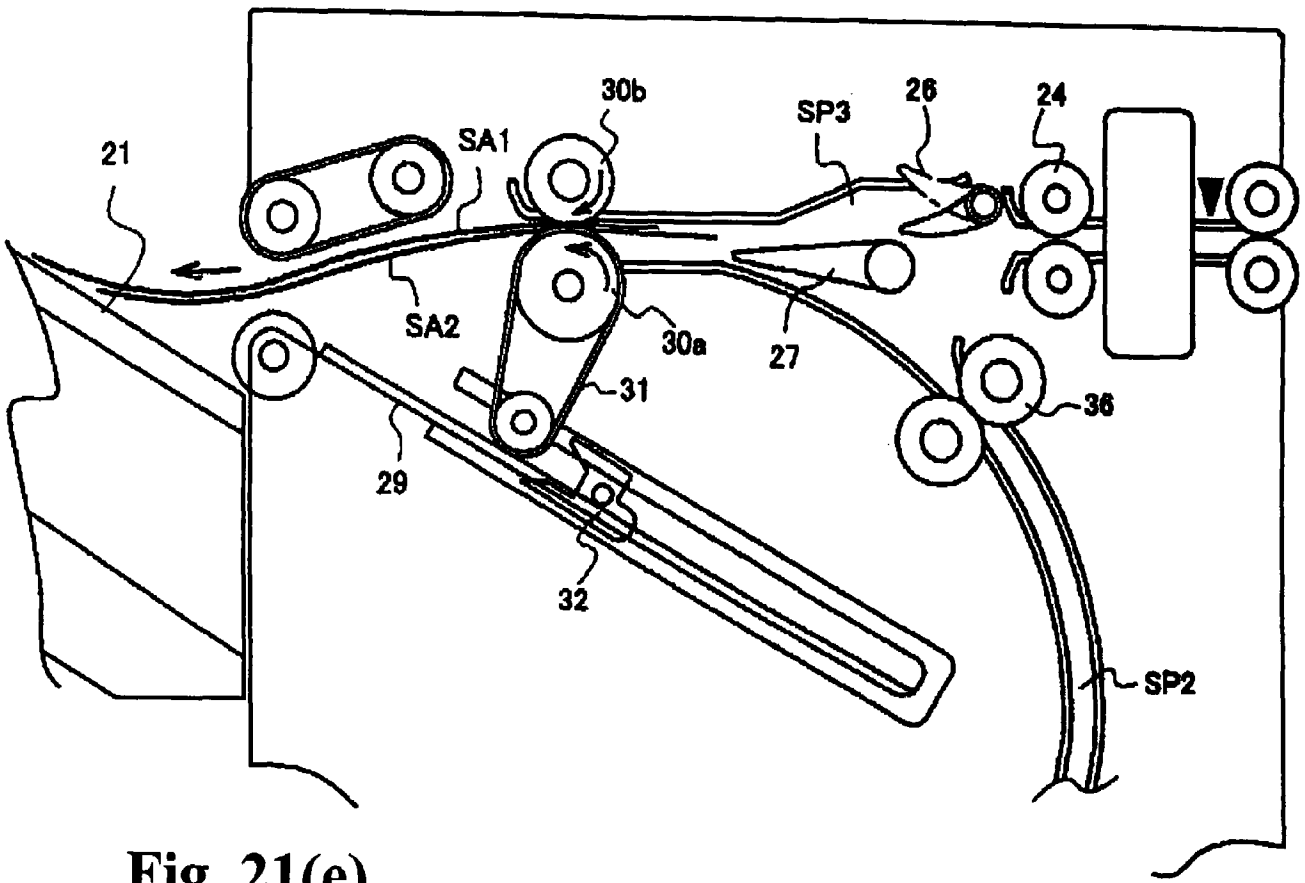
Figure 21F:
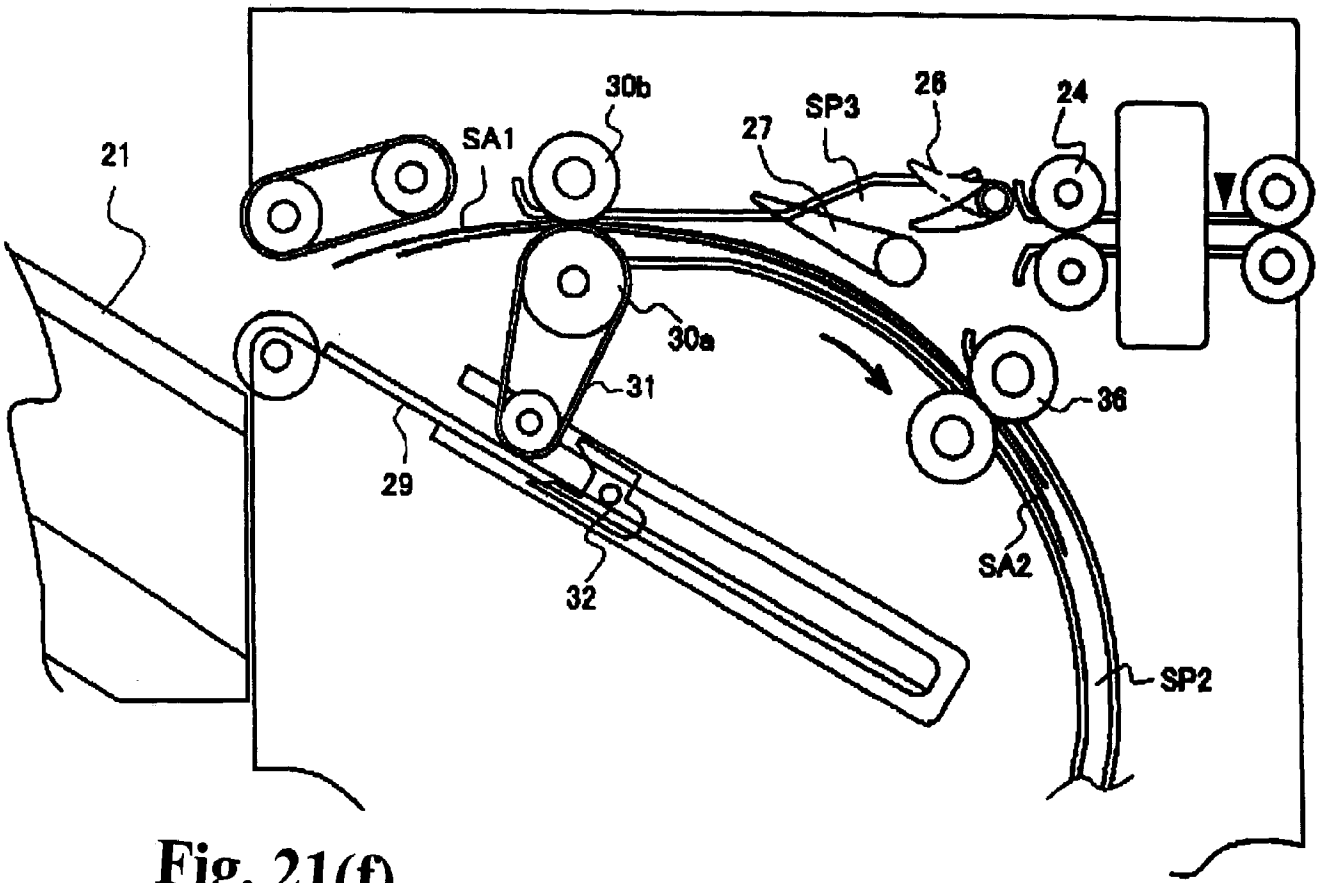
Figure 22A:
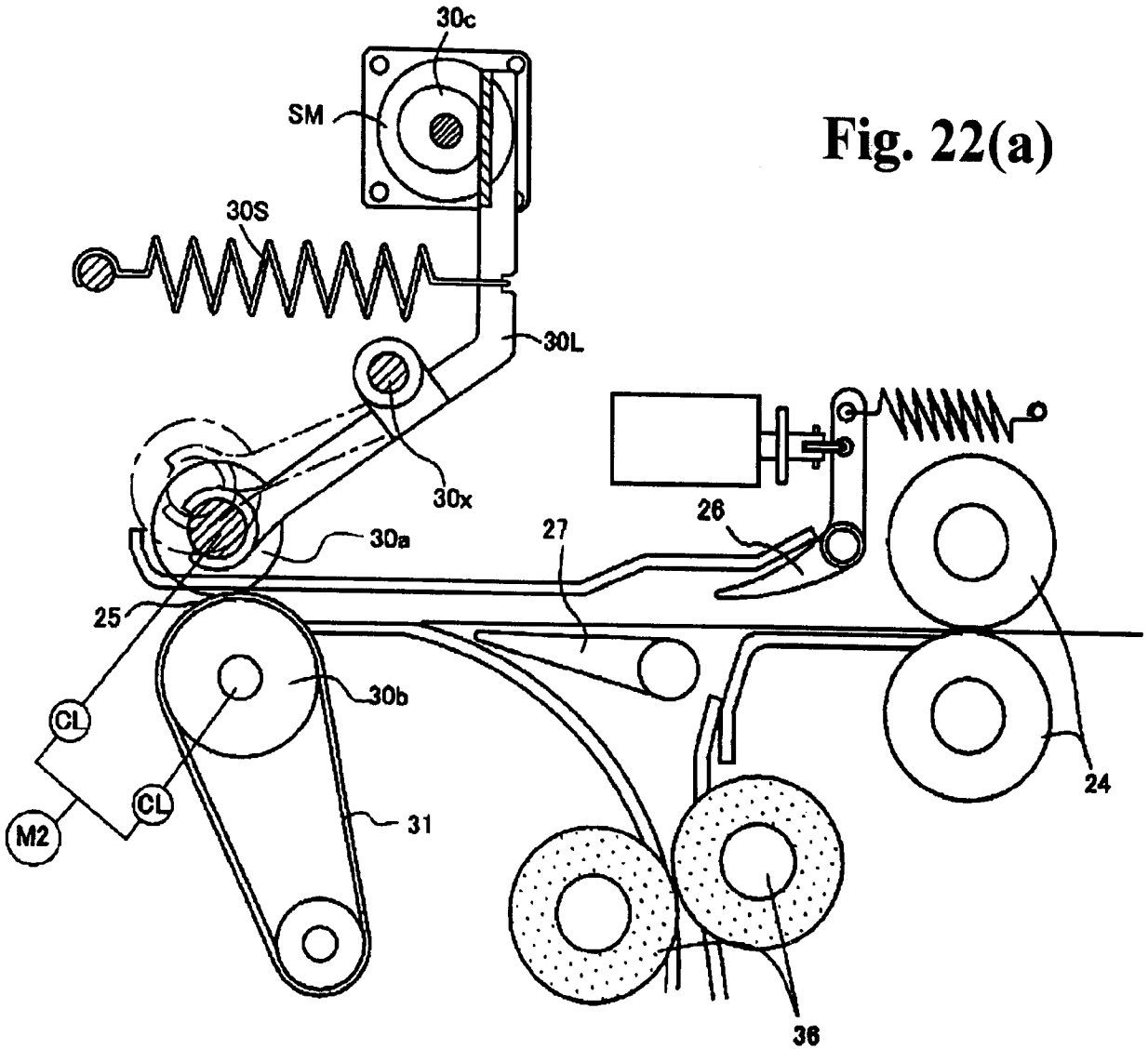
FIG. 22(*a*) is a diagram illustrating the configuration of first conveying roller means of the apparatus in FIG. 2.
Figure 22B:
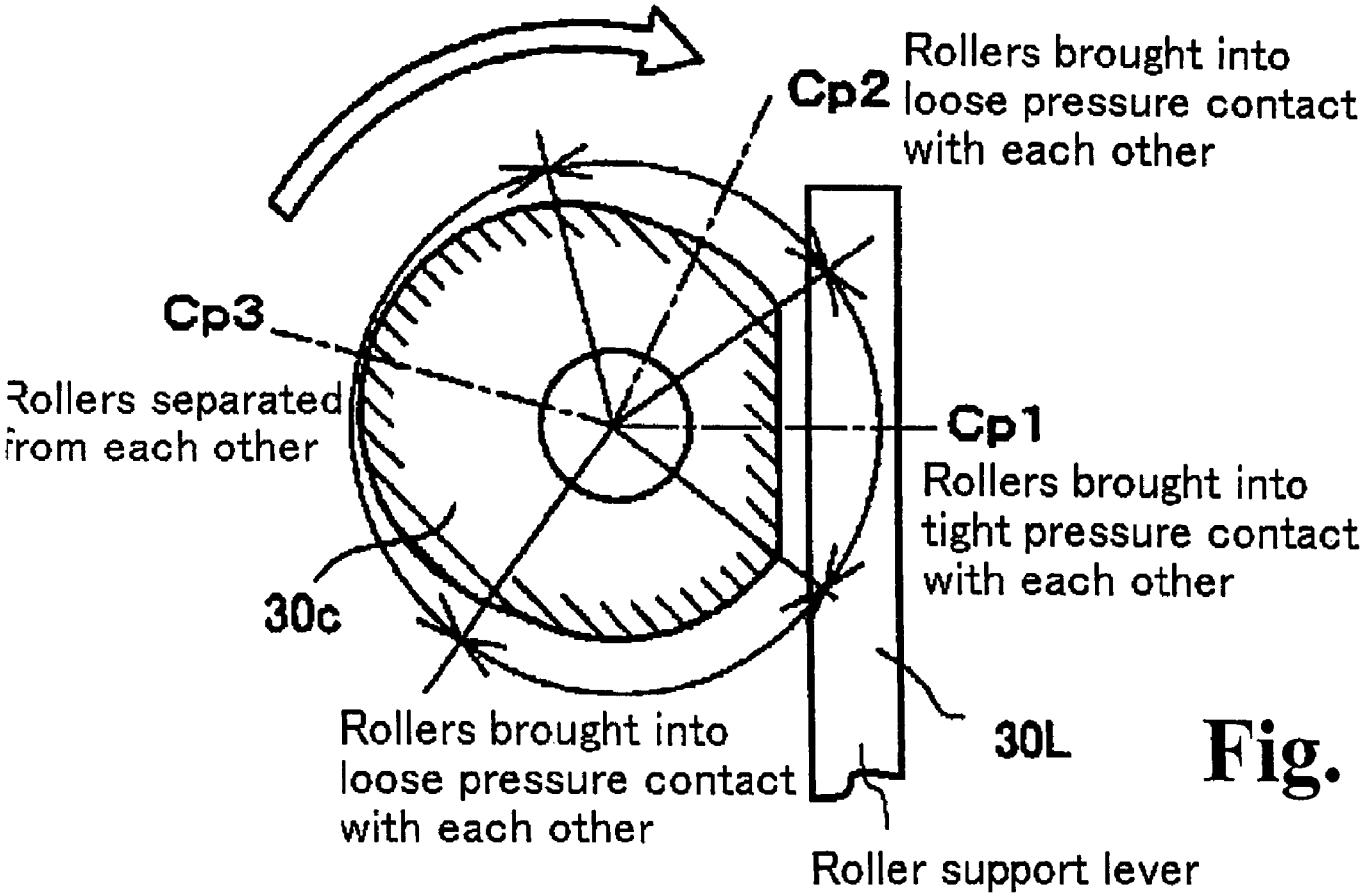
Figure 22C:
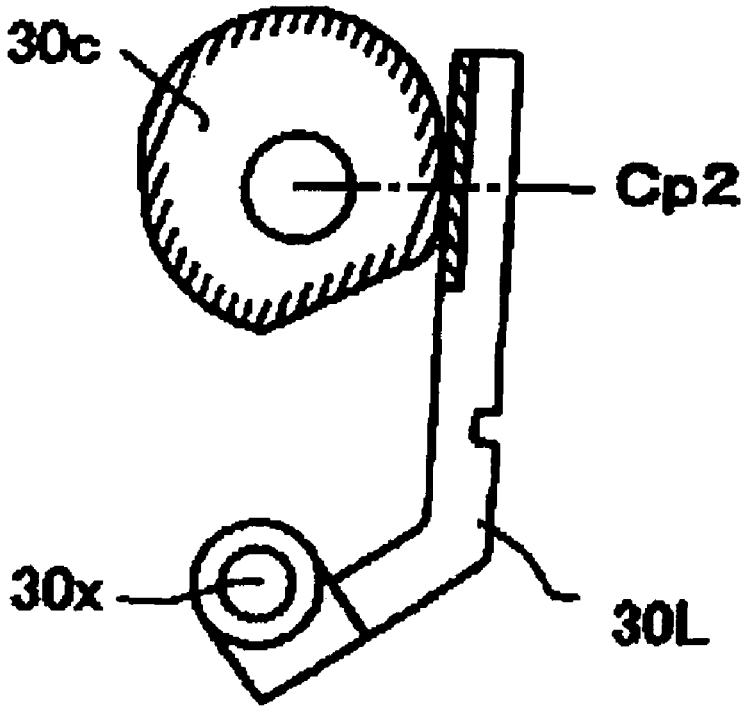
Figure 22D:
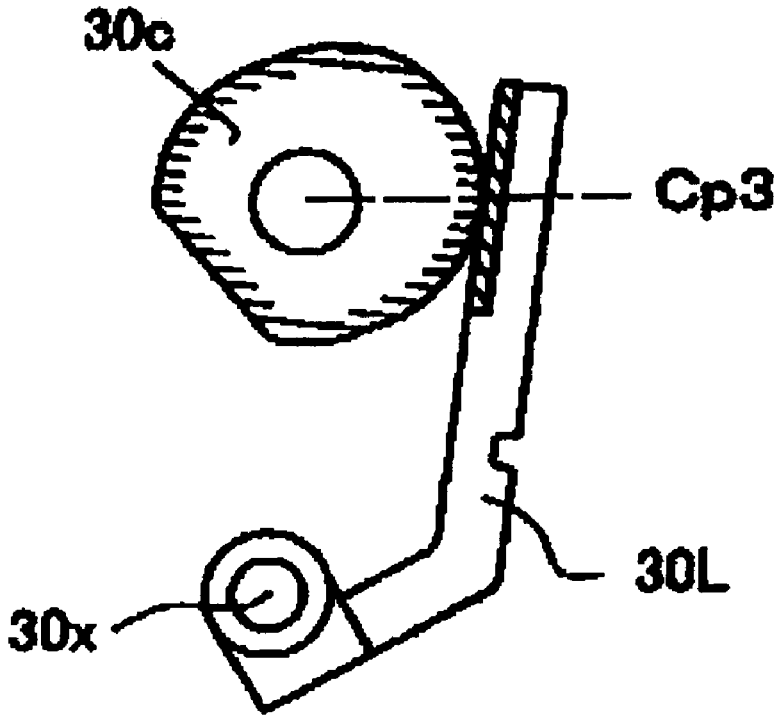

Now, a supplementary description will be given of a preceding sheet standby operation with reference to FIGS. 20 and 21 (*a*) to 21(*f*). As described above, the following conveyance control is performed when the second succeeding sheet is carried into the sheet carry-in path P1 while the post-processing operation is being performed on the switchback conveying path SP1. As shown in FIG. 21(*a*), the preceding sheet SA1 fed to the sheet carry-in path P1 is fed toward the sheet discharging roller (forward reverse roller) 30 by the carry-in roller 24. The path switching piece 27 and the flapper guide 26 guide the sheet toward the sheet discharging roller as shown by a solid line in FIG. 21(*a*).

Further, as shown in FIG. 21(*b*), the sheet sensor Se1 detects the trailing end of the preceding sheet SA1, and the conveyance control means 64*a* stops the sheet discharging roller 30 at the time when the sheet trailing end is expected to pass through the flapper guide 26. Simultaneously, the conveyance control means 64*a* moves the flapper guide 26 from a position shown by a dashed line in FIG. 21(*b*) (retract position) to a position shown by a solid line in the figure (scoop-up position). The flapper guide 26 is moved by energizing the actuating solenoid 26S. The conveyance control means 64*a* reverse the rotating direction of the sheet discharging roller 30 to move the preceding sheet backward, that is, rightward in FIG. 21 (*b*). The amount by which the preceding sheet SA1 is moved backward is preset.

The conveyance control means 64*a* moves the preceding sheet SA1 by a predetermined amount. As shown in FIG. 21(*c*), with the sheet trailing end switched back to the flapper guide 26, the conveyance control means 64*a* returns the flapper guide 26 to a standby position shown by a solid line shown in the figure. Then, the preceding sheet SA1 carried into the sheet carry-in path P1 is held by the flapper guide 26 with the trailing end P3 placed in the standby path P3. The conveyance control means 64*a* separates the rollers of the sheet discharging roller 30 from each other. To separate the rollers of the sheet discharging roller 30 from each other, the actuating solenoid 30S retracts the pinch roller 30*b* upward. The succeeding sheet SA2 thus moves to under the preceding sheet SA1, and both sheets are then fed to the sheet discharging roller 30.

Once the trailing end of the succeeding sheet SA2 leaves the carry-in roller 24, the conveyance control means 64*a* stops energizing the actuating solenoid 30S to bring the rollers of the sheet discharging roller 30 into pressure contact with each other. As shown in FIG. 21(*e*), the conveyance control means 64*a* allows the sheet discharging roller 30 to simultaneously convey the preceding sheet SA1 and the succeeding sheet SA2 to a position where the sheet trailing end passes through the path switching piece 27. The conveyance control means 64*a* stops the sheet discharging roller 30.

The conveyance control means 64*a* then moves the path switching piece 27 so as to guide the sheet trailing end to the second switchback path P2 as shown in FIG. 21(*f*). The overlapping preceding sheet SA1 and succeeding sheet SA2 are then guided to the second switchback path SP2.

If the above-described sheet bunch folding finish process is continuously executed, the control CPU 61 temporarily holds the succeeding sheet fed to the sheet carry-in path P1, on the sheet carry-in path P1. This sheet buffering operation will be described below. As previously described, the sheet carry-in path P1 has the flapper guide 26, composed of a locking member formed above the sheet carry-in path P1 and locking the sheet trailing end in the sheet standby section (area) as shown in FIG. 20.

To continuously execute the above-described sheet bunch folding process, the control CPU 61 temporarily holds the succeeding sheet fed to the sheet carry-in path P1 on the flapper guide 26. This operation will be described below. The control CPU 62 allows sheets from the second switchback conveying path SP2 to be collected on the collecting guide 35. After the image forming job is finished, the control CPU 61 allows the saddle stitching staple device 40 to staple the sheet bunch collected on the guide. After the stapling process, the control CPU 61 actuates the folding blade 46 and the folding roll means 45 to fold the sheet bunch on the collecting guide 35 and to carry out the folded sheet bunch to the second sheet discharging tray 22.

If the succeeding sheet is carried in while the stapling operation and/or sheet bunch folding operation is being performed on the sheet bunch on the collecting guide 35, the control CPU 61 uses the sheet sensor Se1 to senses the succeeding sheet. Then, at the time when the sheet trailing end is expected to pass through the flapper guide 26 on the sheet carry-in path P1, the control CPU 61 stops the sheet discharging roller 30. At the same time, the control CPU 61 moves the flapper guide 26 to a position shown in FIG. 21(*b*) and then reversely rotates the sheet discharging roller 30. The trailing end of the sheet on the sheet carry-in path P1 is then guided to the flapper guide 26. At the time when the sheet trailing end is expected to reach the flapper guide 26, the control CPU 61 stops the sheet discharging roller 35. The sheet on the sheet carry-in path P1 is then stopped with the trailing end locked by the flap guide 26.

After the sheet bunch on the collecting guide 35 is discharged to the second sheet discharging tray 22, the succeeding sheet is carried in from the image forming apparatus A. Further, when the succeeding sheet overlaps the residing (standby) sheet, the control CPU 61 rotates the sheet discharging roller 30 clockwise in FIG. 21(*d*) and simultaneously moves the flapper guide 26 to a position shown by a dashed line in FIG. 21(*d*). The vertically overlapping sheets are fed downstream by the sheet discharging roller 30. The sheet discharging roller 30 is then reversely rotated to guide the sheets to the second switchback conveying path SP2. The vertically overlapping sheets are guided to the collecting guide 35, where the sheets are orderly aligned with each other in the vertical direction. Sheets succeeding the overlapping sheets are similarly loaded and housed on the collecting guide 35 sequentially through the sheet carry-in path P1 and the second switchback conveying path SP2. This operation allows the post-processing apparatus B to continue the sheet bunch folding process without stopping the image forming apparatus A. This sheet overlapping is achieved as shown in FIG. 21 (*c*). That is, the sheet discharging roller 30 is composed of a pair of rollers that can be brought into pressure contact with each other and separated from each other. To lay the succeeding sheet from the carry-in port 23 on top of the standby sheet at the sheet discharging roller 30, the rollers of the sheet discharging roller 30 are separated from each other by actuating means such as an electromagnetic solenoid.

As described above, the switchback path branching off from the sheet carry-in path to reverse the conveying direction has the collecting section on which sheets are set and collected. The standby path and the flapper means for guiding the sheet trailing end to the standby path are arranged upstream of the branching point of the sheet carry-in path. The forward reversible conveying roller means is located downstream of the branching point. The trailing end of a sheet from the carry-in port can be transferred to the standby path by reversing the rotation of the conveying roller means, located downstream of the branching point. At the same time, the conveying roller means can lay the succeeding next sheet on top of the standby sheet and conveys the sheets to the switchback path. Thus, the conveying roller means for conveying a sheet to the switchback path can transfer the sheet to the standby path without the need for any special conveying mechanism. The sheet carry-in path can be configured to have a simple structure.

Furthermore, the configuration of the standby path is simplified by allowing the trailing end of the sheet fed to the sheet carry-in path to retract above the path. Moreover, if succeeding sheets are sequentially stacked and collected on the preceding sheets on the collecting section, each succeeding sheet from the carry-in port is slipped to under the corresponding preceding sheet before the sheets are conveyed. This prevents possible out-of-order pages. The plurality of overlapping sheets is thus collected on the collecting section.

Figure 23A:
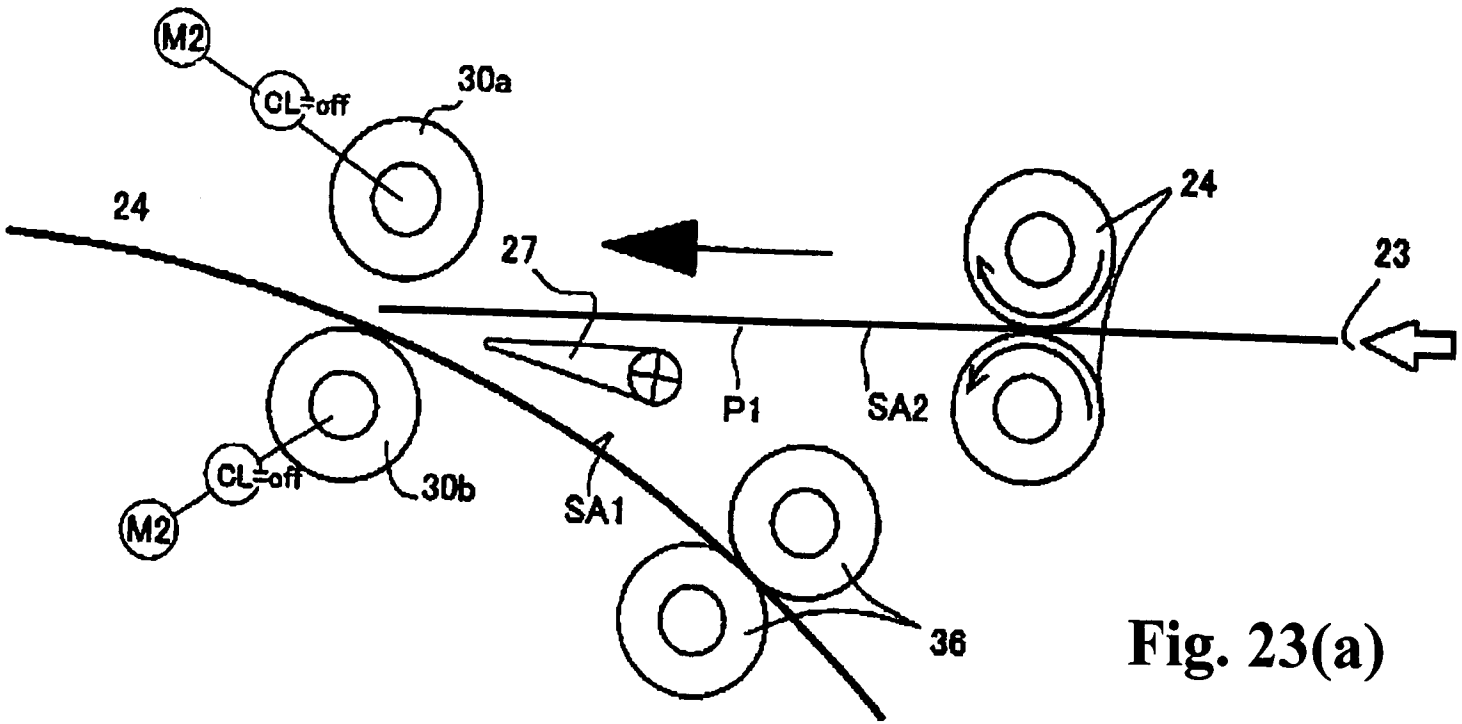
FIG. 23(*a*) is a diagram showing an operating state of the sheet discharging roller in the apparatus in FIG. 2.
Figure 23B:
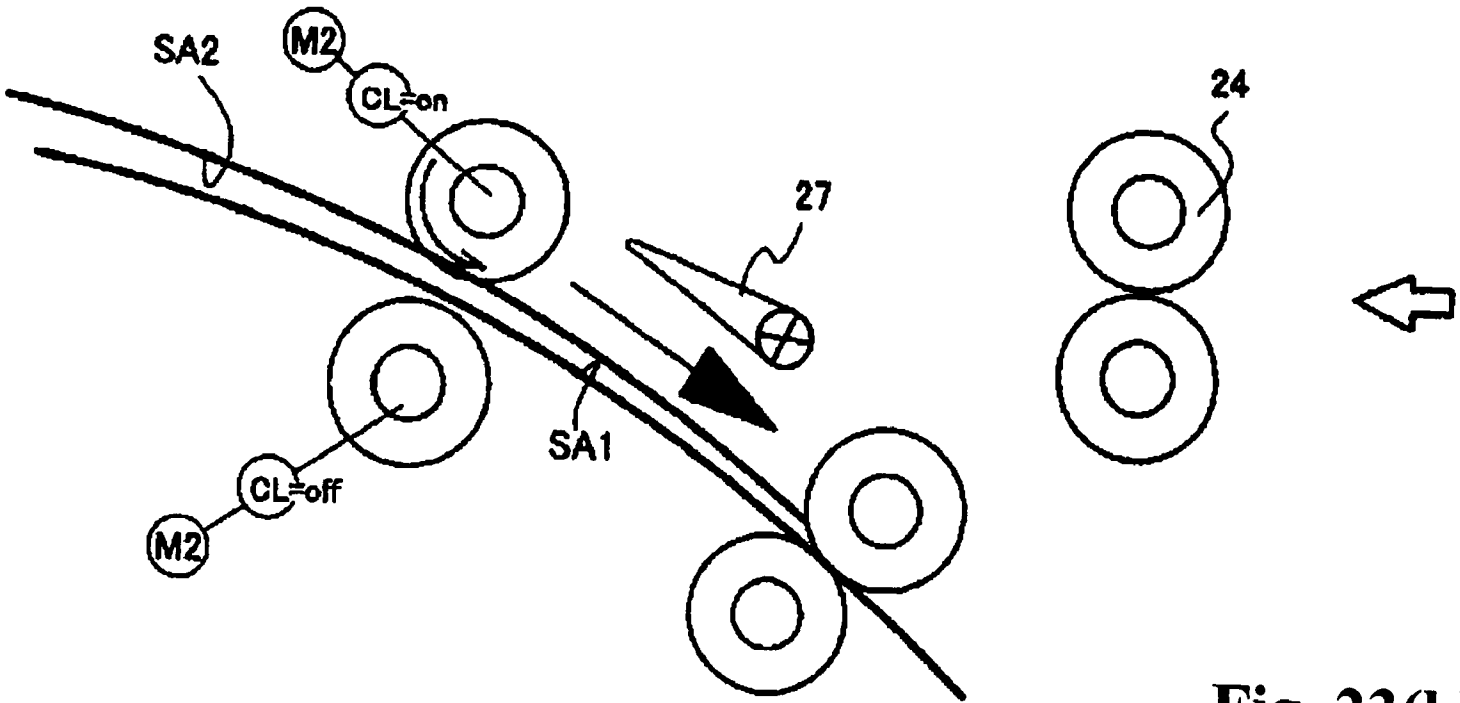
Figure 23C:
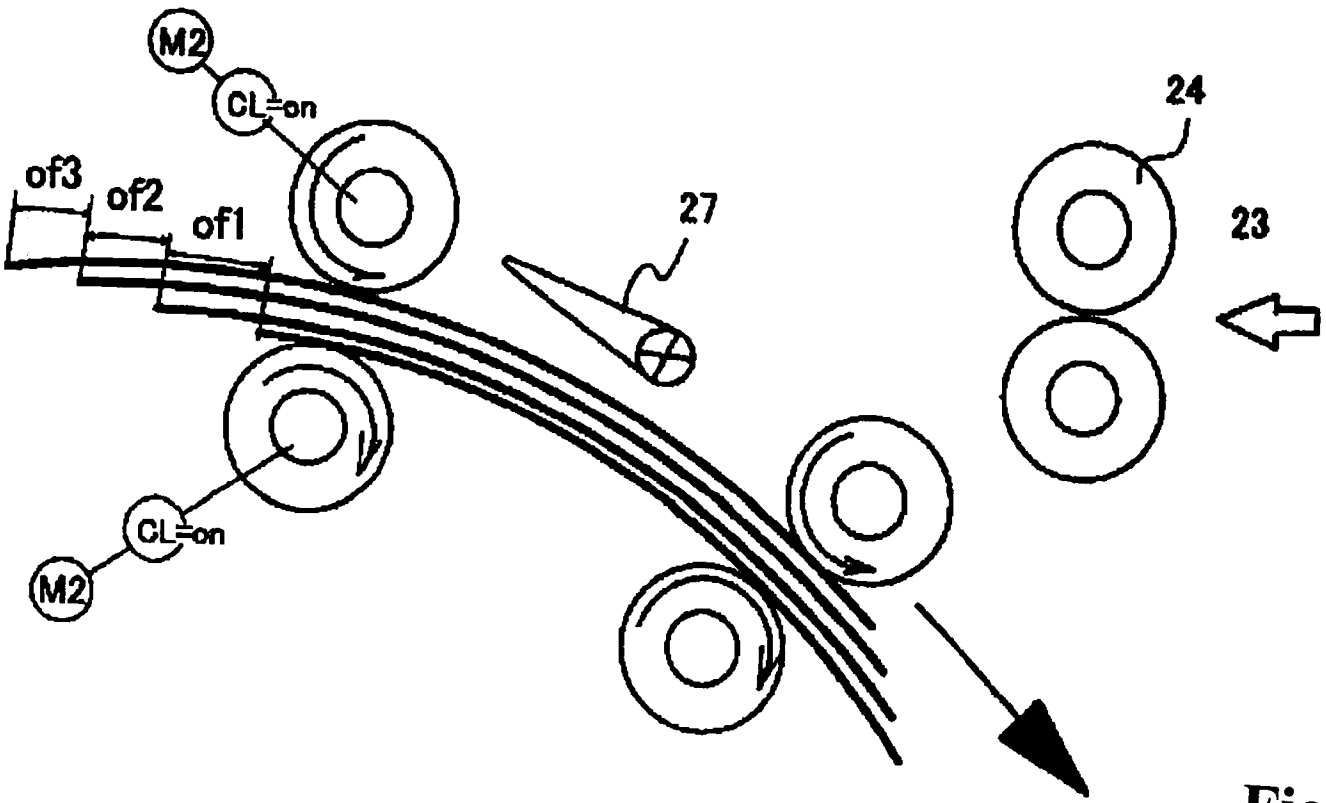
Figure 24A:
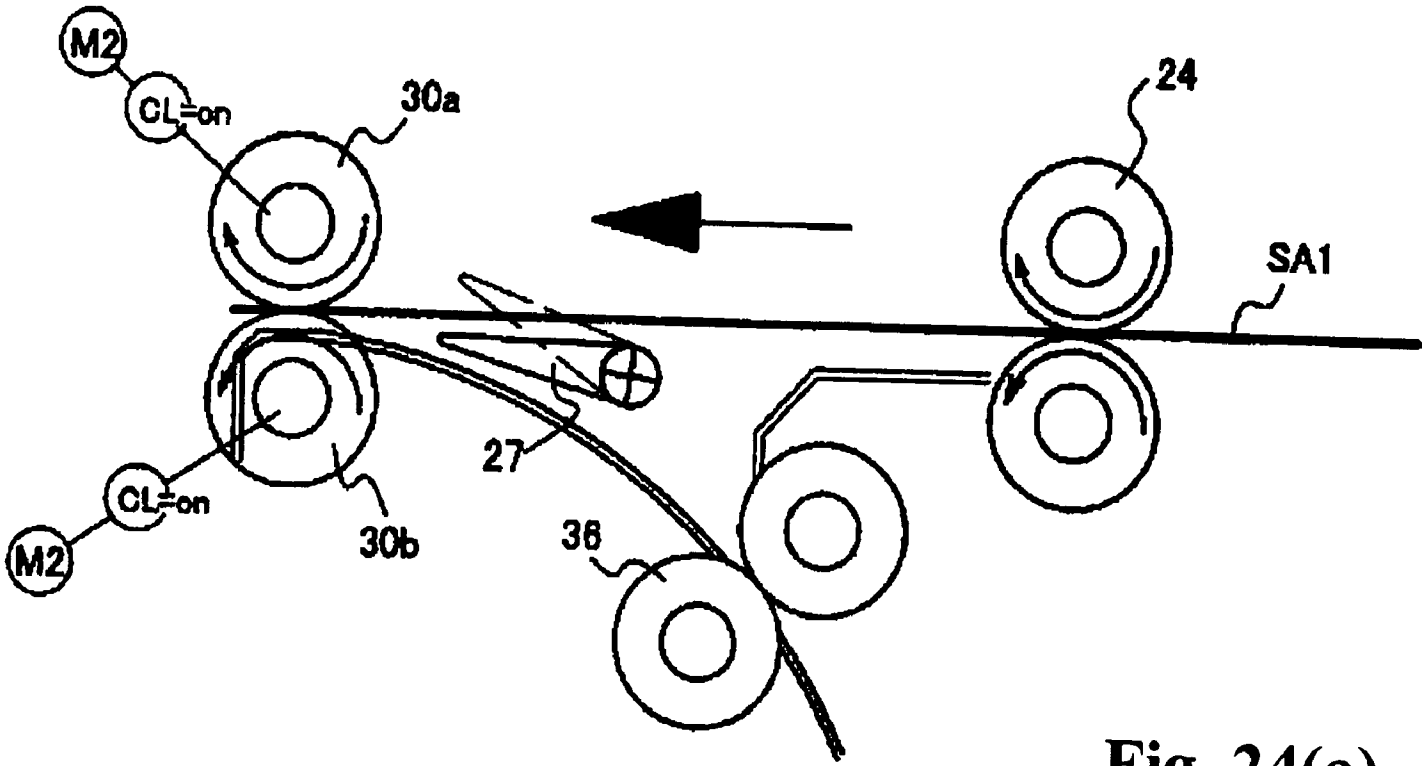
FIG. 24(*a*) is a diagram showing the relationship between sheet conveyance and the pressure contact operation of the sheet discharging roller in the apparatus in FIG. 2.
Figure 24B:
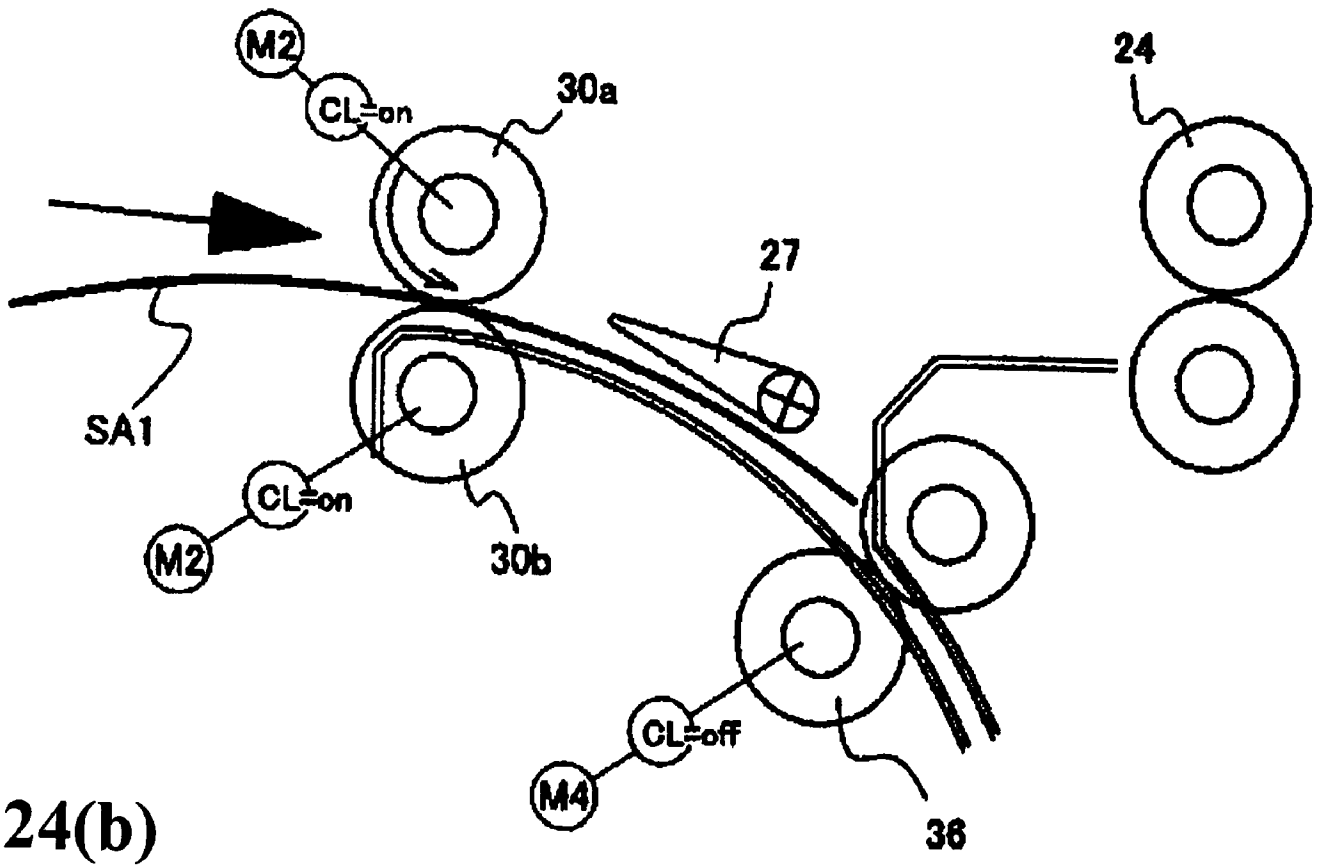
Figure 24C:
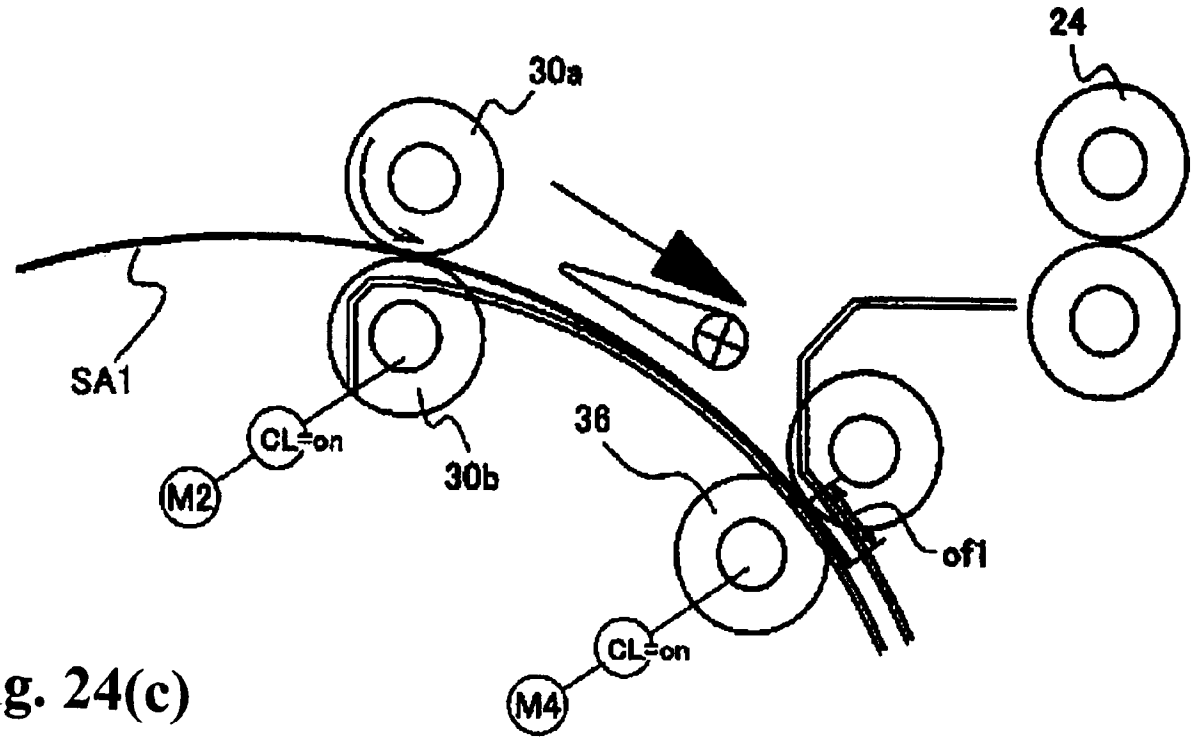
Figure 24D:
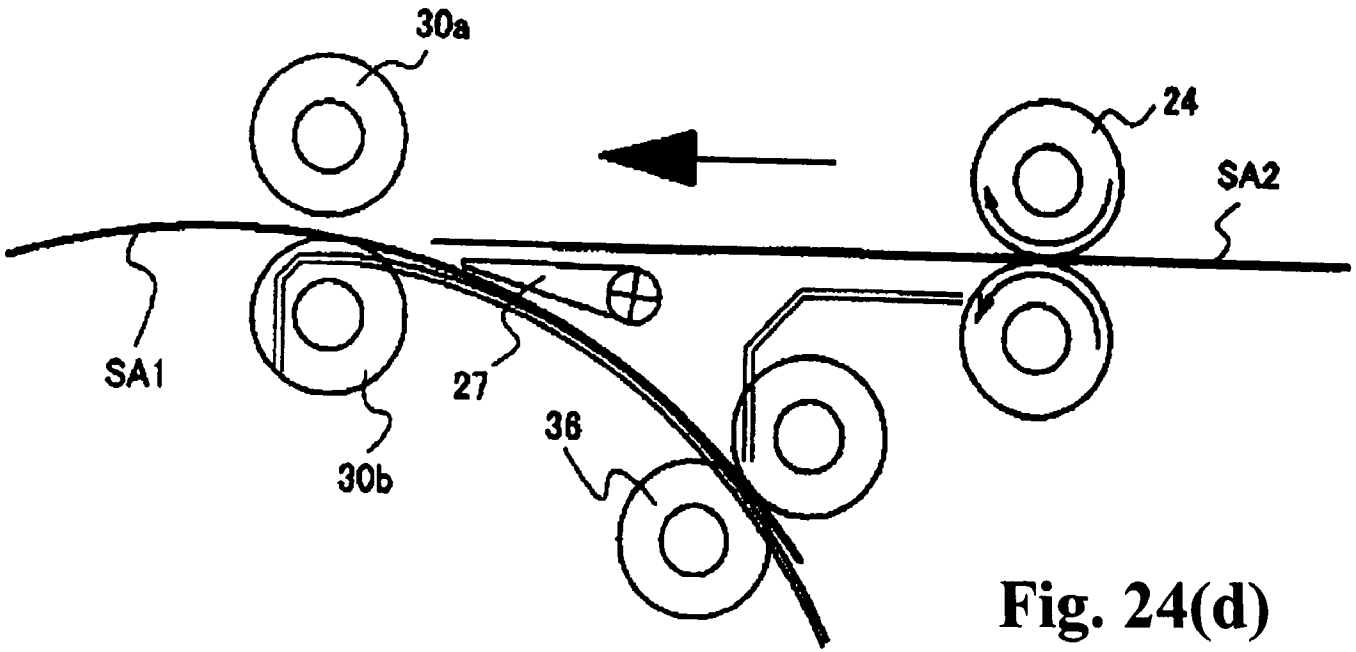
Figure 24E:
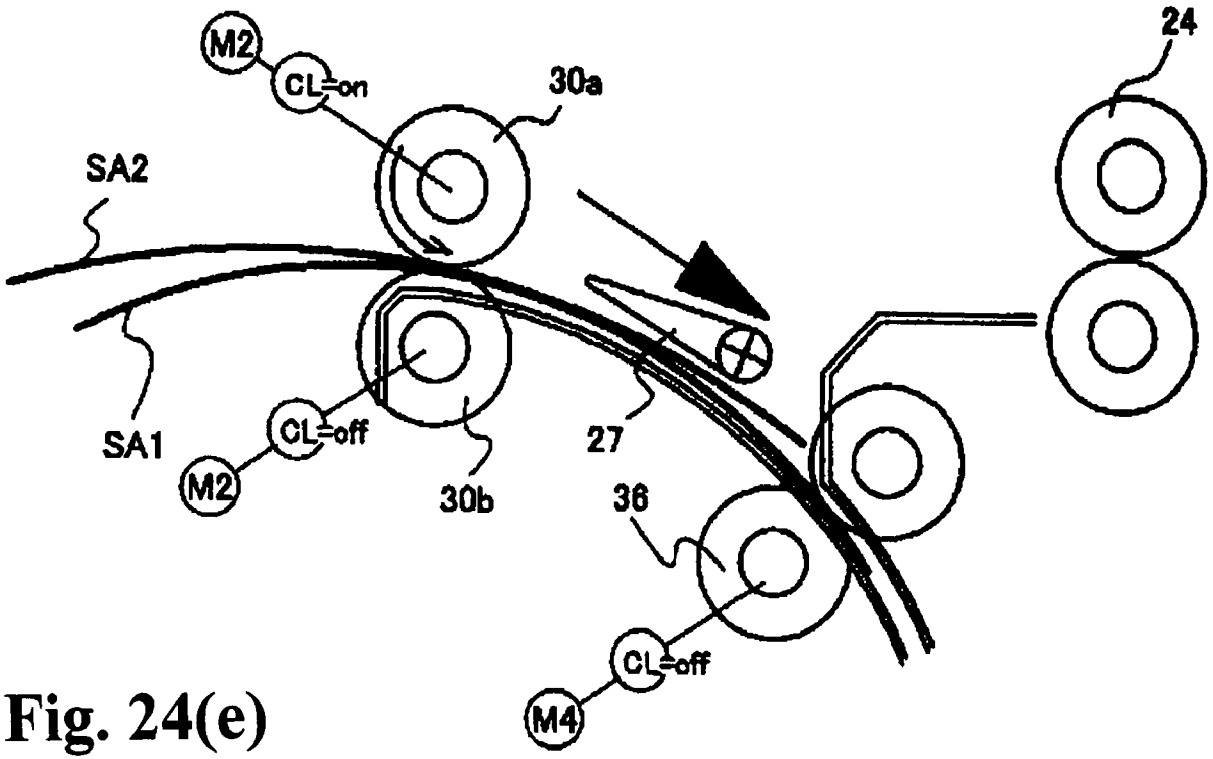
Figure 24F:
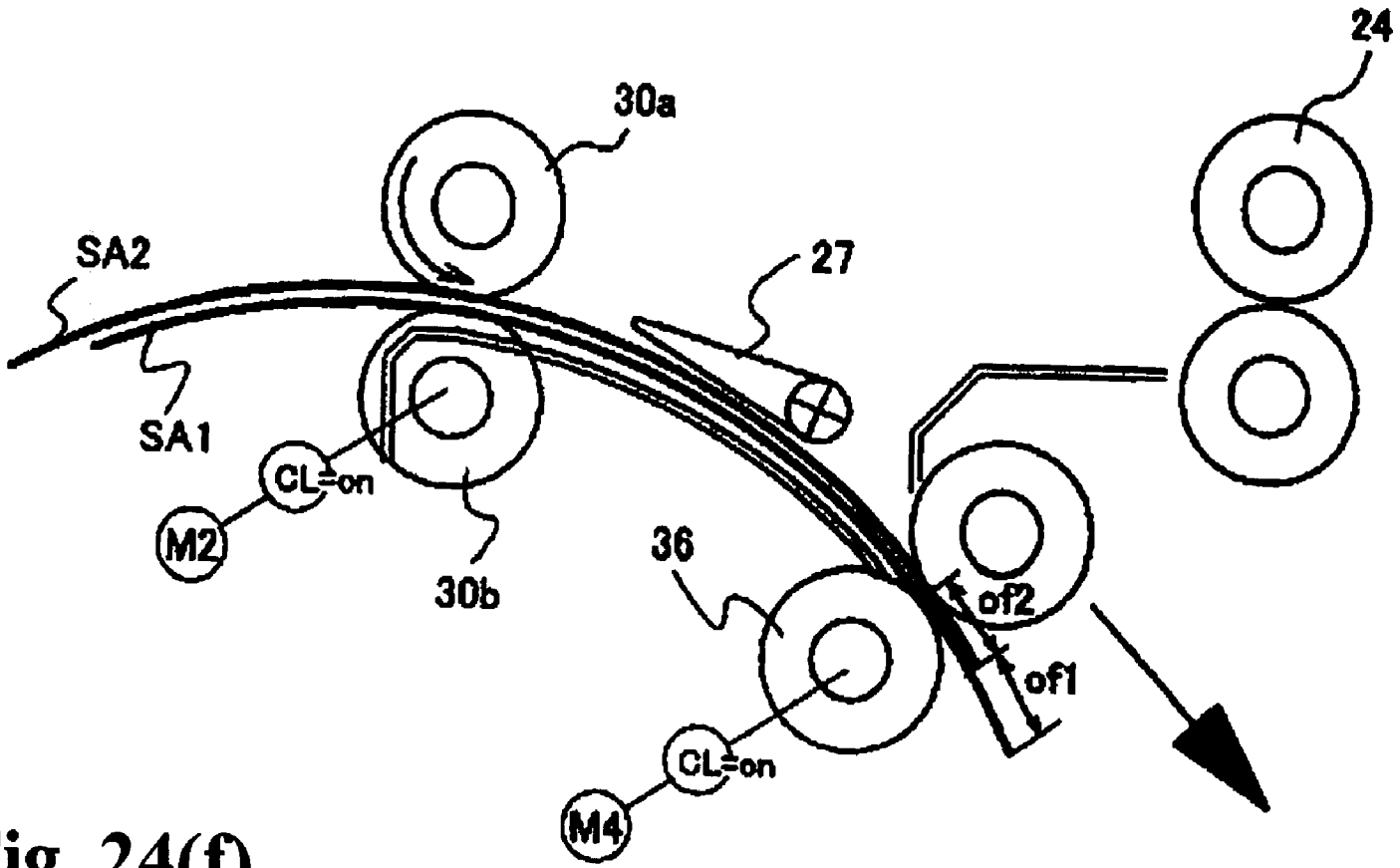
Figure 24G:
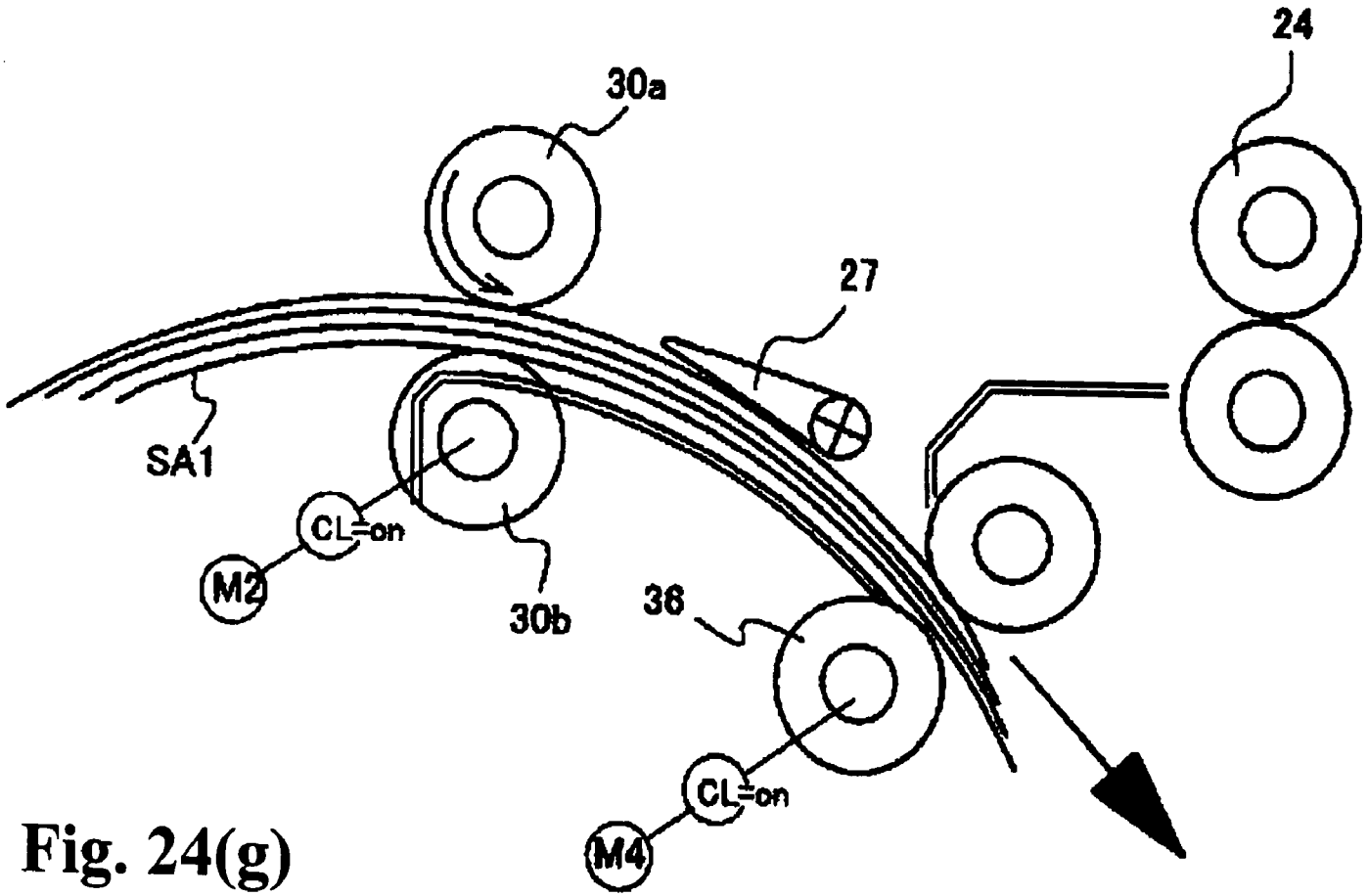
Figure 24H:
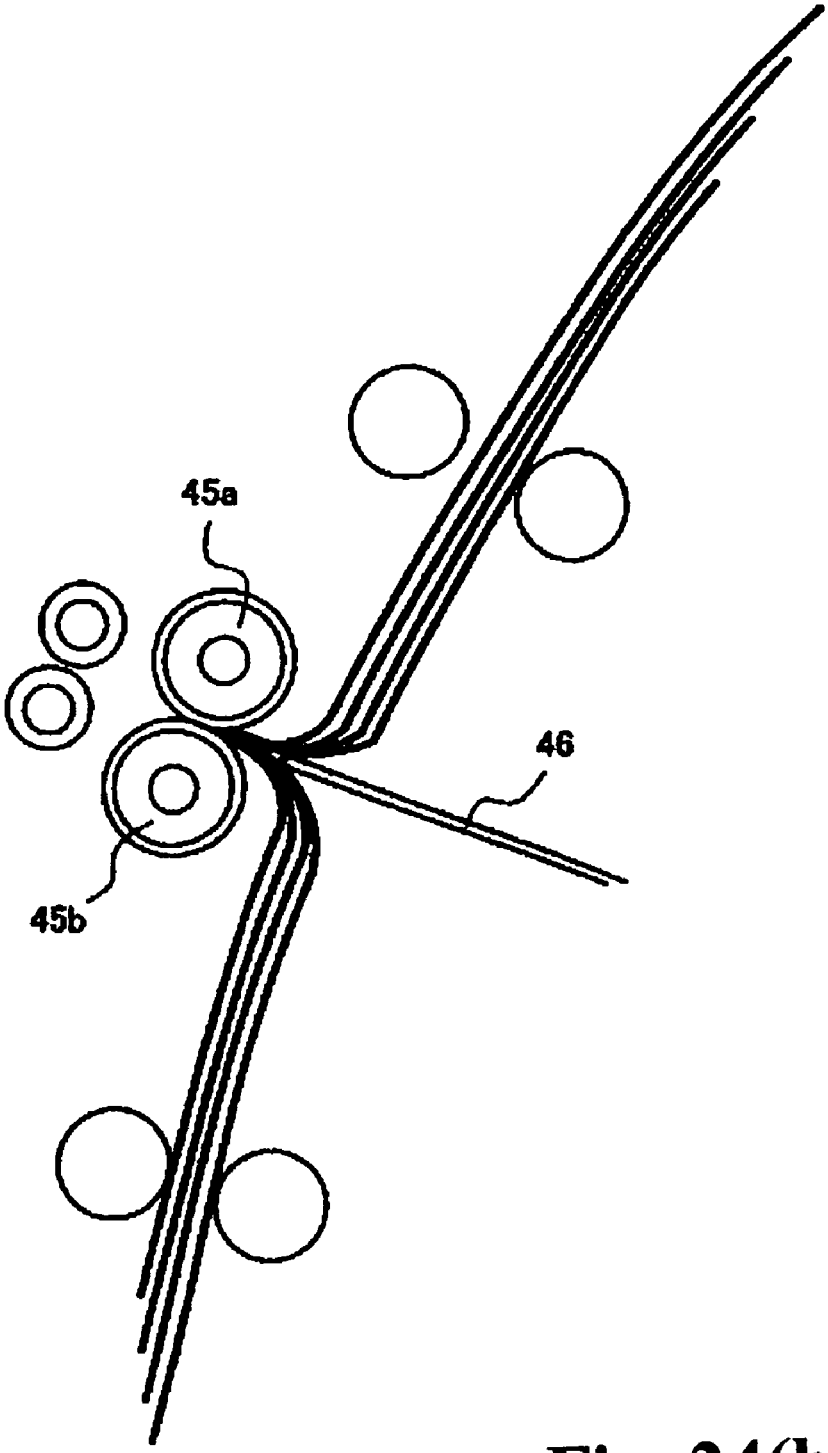
Figure 25:
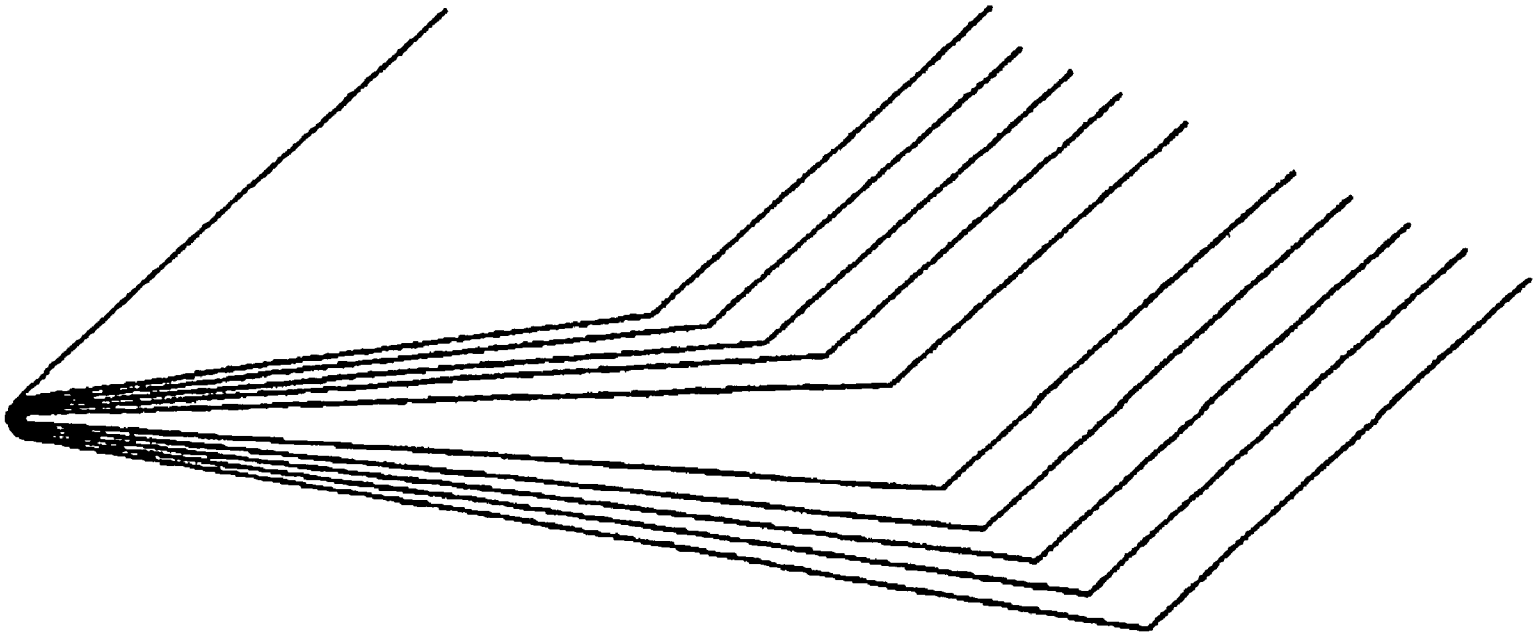
FIG. 25 is a state diagram of sheet folding in the apparatus in FIG. 2.
Figure 26A:
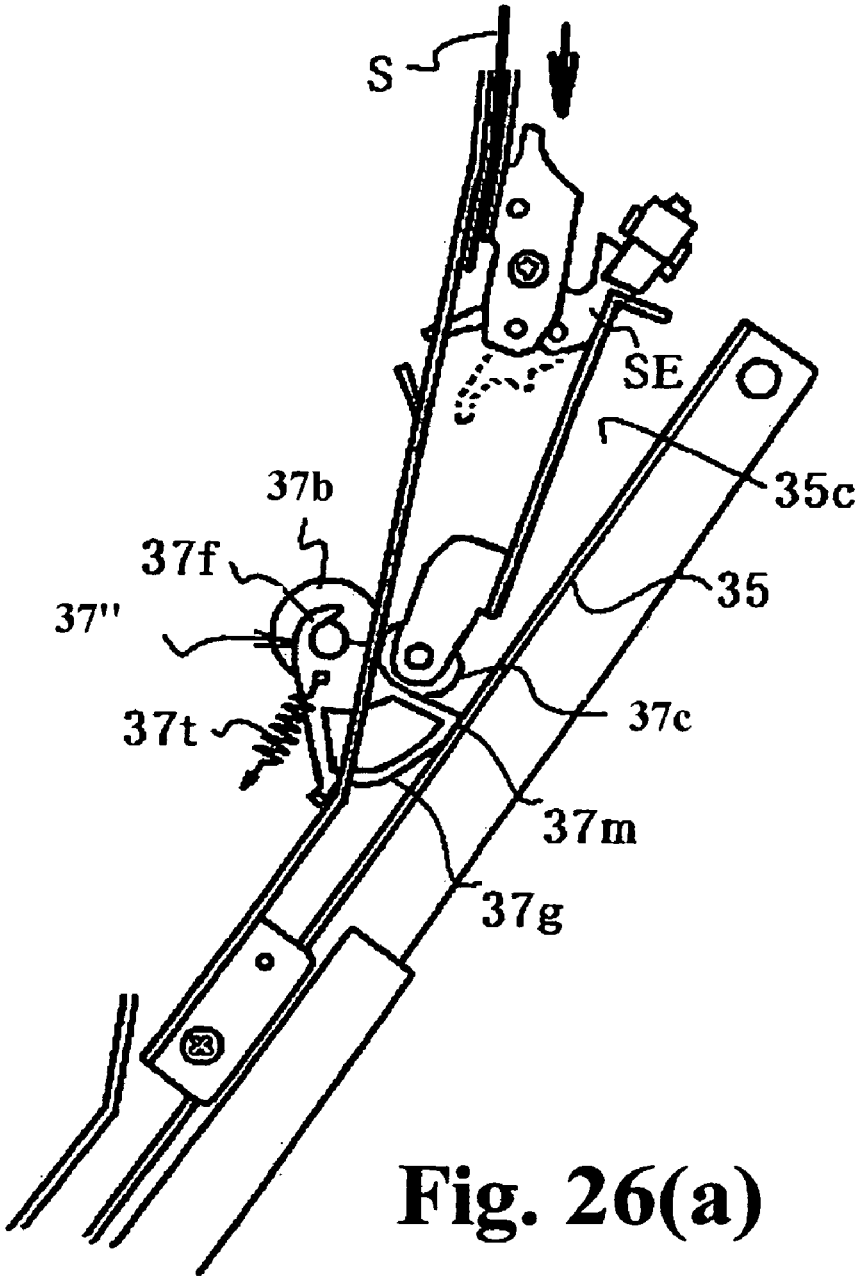
FIG. 26(*a*) is a diagram illustrating the configuration and operation of another embodiment of the sheet carry-in guide.
Figure 26B:
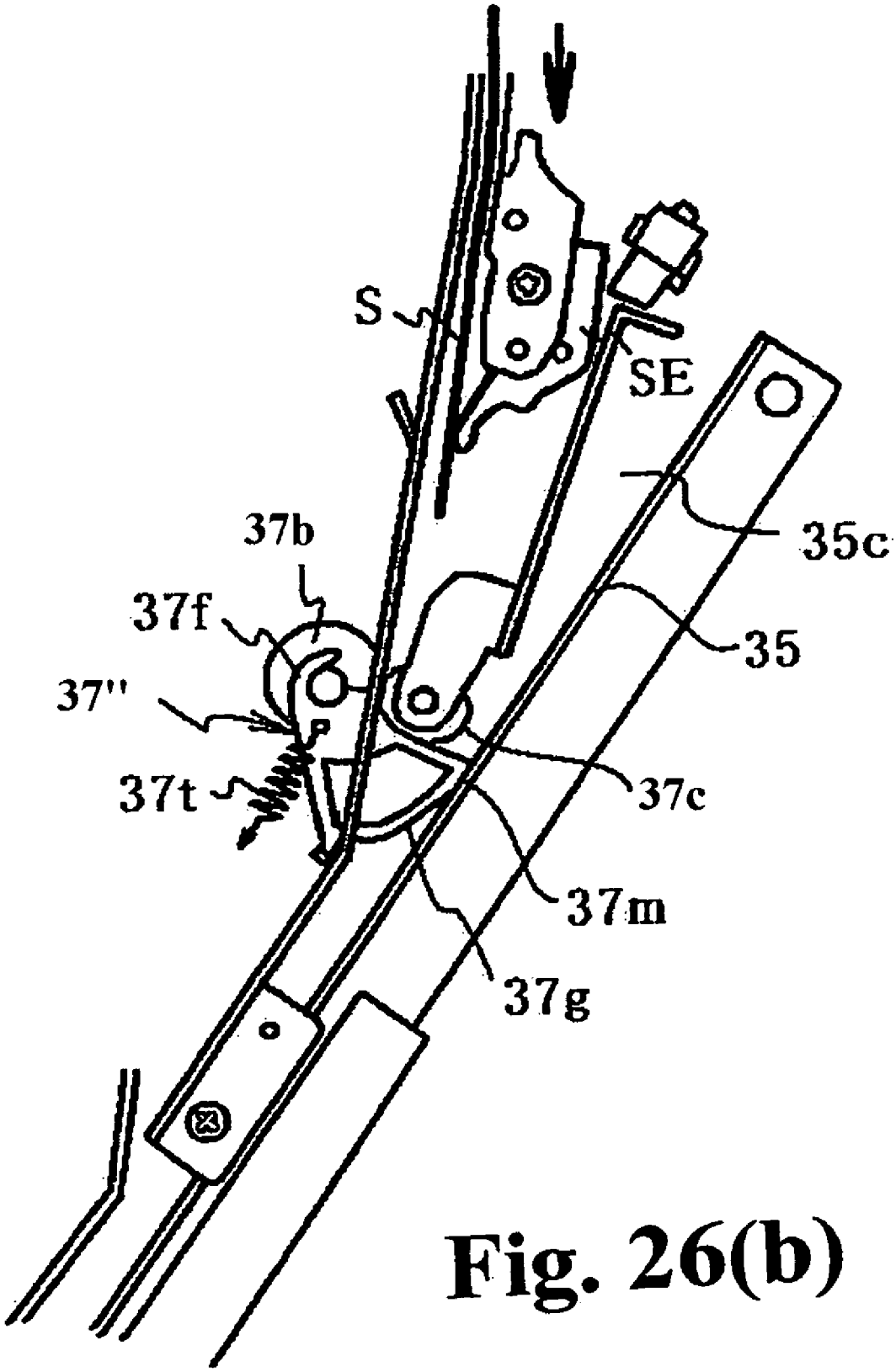
Figure 26C:
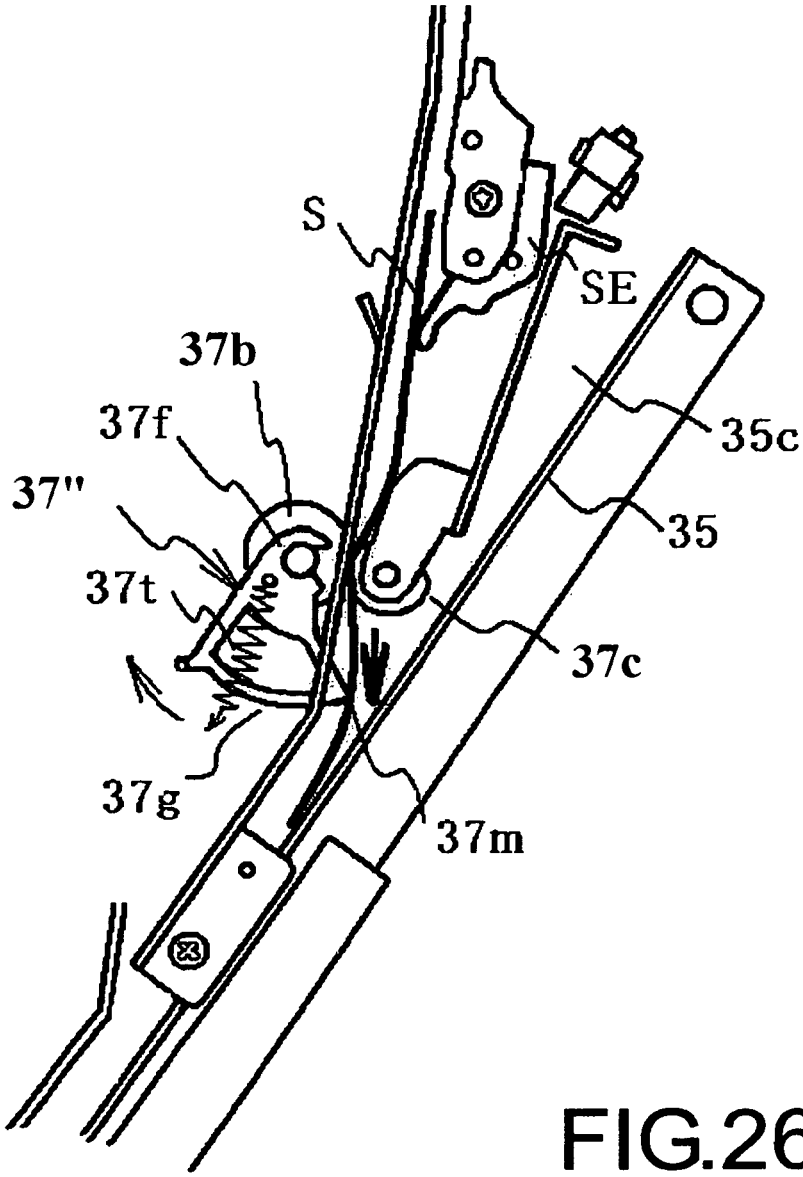
Figure 26D:
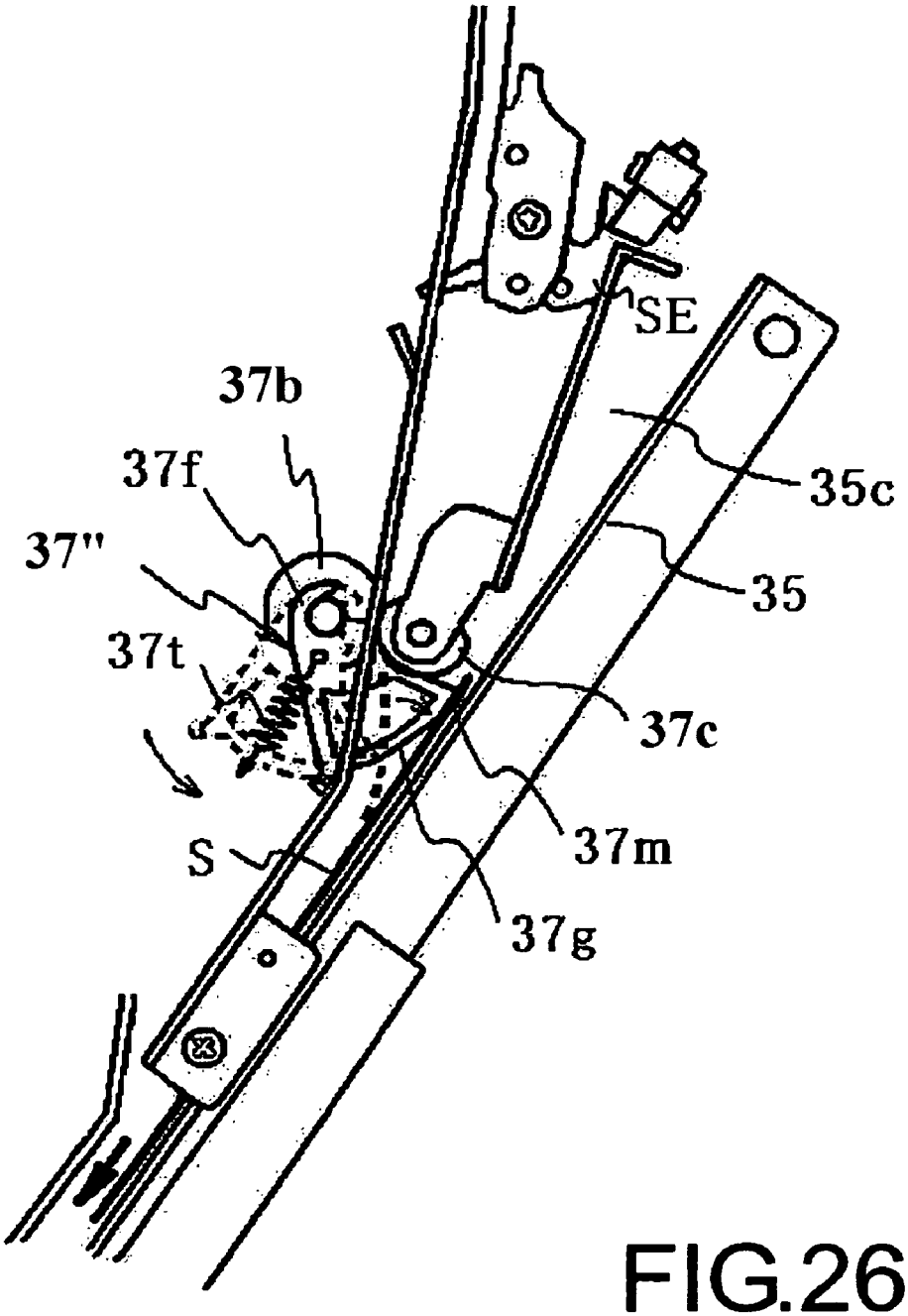
Figure 26E:
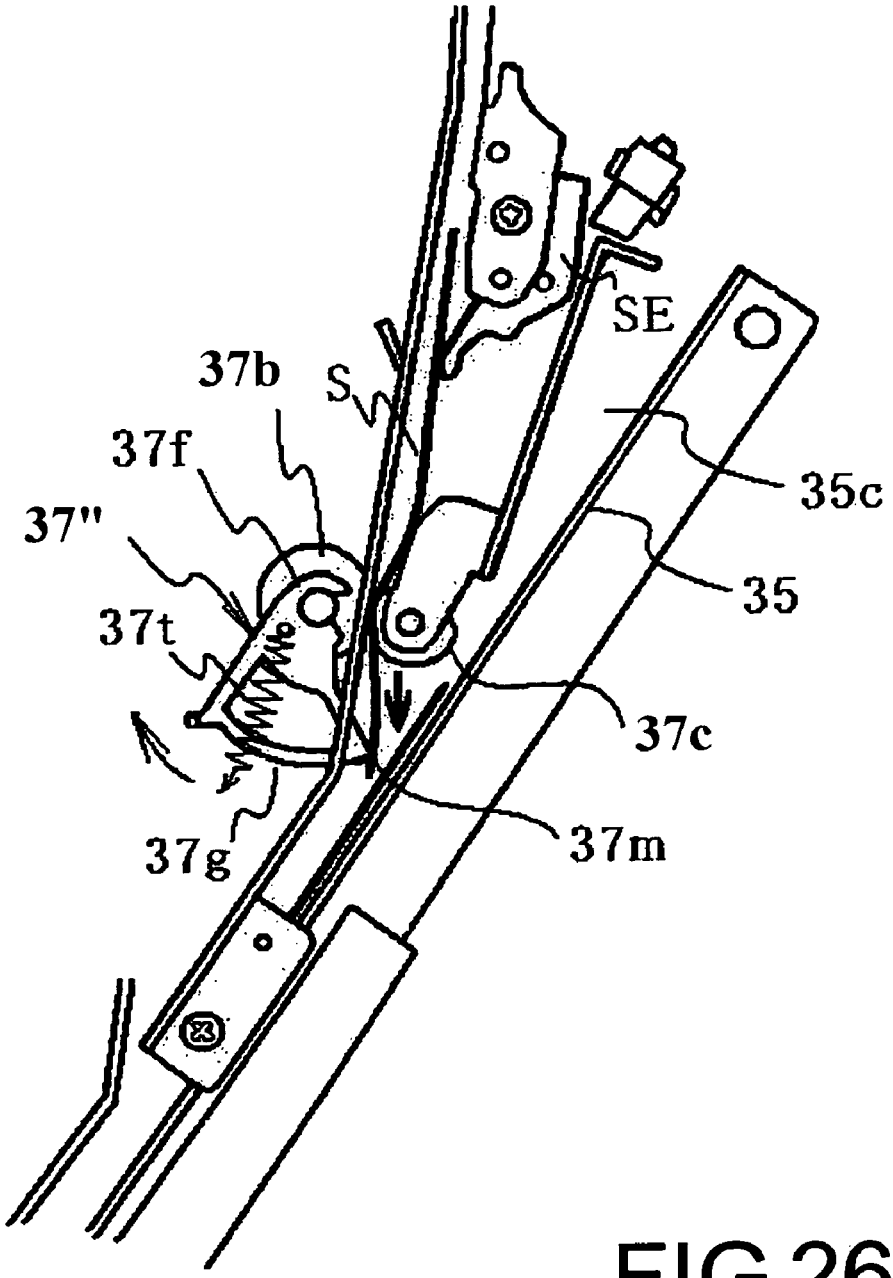

Further, caption folding as shown in FIG. 25 will be described below with reference to a center folding mechanism shown in FIGS. 22 to 24. The present embodiment is characterized in that the sheets sequentially fed to the second switchback path SP2 (the sheet conveying path; this also applies to the description below) are set and collected between the second switchback path SP2 and the upstream sheet discharging roller 30 so as to overlap one another and in that at this time, the sheets are offset from one another by predetermined amounts. Thus, the sheet discharging roller 30 (first conveying roller means which also applies to the description below), located upstream, and the conveying roller 36 (offset roller, hereinafter referred to as the "second conveying roller means"), located downstream, are configured as described below.

The first conveying roller means 30 and the second conveying roller means 36 are arranged on the sheet conveying path SP2 as described below. The distance (L1) between the first conveying roller means 30 and the second conveying roller means 36 is shorter than the length of the sheet in the conveying direction. Consequently, the sheet from the sheet carry-in path P1 is supported so as to extend between the first conveying roller means 30 and the second conveying roller means 36. The first conveying roller means 30 is composed of the pair of rollers that are in pressure contact with each other. The illustrated first conveying roller means 30 is composed of the sheet discharging rollers 30*a* and 30*b*.

Further, as shown in FIGS. 22 (*a*) to 22(*d*), the first conveying roller means is composed of the movable roller (forward reverse roller) 30*a* and the fixed roller (driven roller) 30*b*. The movable roller 30*a* is supported, via a shaft, by a roller support lever 30L swingably borne by the apparatus frame. Reference numeral 30*x* denotes the support shaft. The roller support lever 30L has the bias spring 30S, which always keeps the movable roller 30*a* in pressure contact with the fixed roller 30*b*. A shift cam 30*c* is located at a leading end of the roller support lever 30L so as to slidably contact the roller support lever 30L. The shift cam 30*c* adjusts the position of the roller support lever 30L among three states described below.

In a first state, the shift cam 30*c* abuts against the roller support lever 30L at a position Cp1 shown in the figures (the shift cam 30*c* lies away from the roller support lever 30L). In this case, the movable roller 30*a* is brought into pressure contact with the fixed roller 30*b* by the maximum tension of the bias spring 30S. In a second state, the shift cam 30*c* abuts against the roller support lever 30L at a position Cp2 shown in the figures. The movable roller 30*a* is brought into pressure contact with the fixed roller 30*b* by a weak pressure contact force. In a third state, the shift cam 30*c* abuts against the roller support lever 30L at a position Cp3 shown in the figures. The movable roller 30*a* is separated from the fixed roller 30*b*. The surface of the cam is formed so as to achieve the above-described operations. A stepping motor SM is coupled to the shift cam 30*c*. The angular position of the motor is adjusted to control the position of the movable roller 30*a* between the state in which the movable roller 30*a* is brought into pressure contact with the fixed roller 30*b* by a strong pressure contact force and the state in which the movable roller 30*a* is brought into pressure contact with the fixed roller 30*b* by the weak pressure contact force and the state in which the movable roller 30*a* is separated from the fixed roller 30*b*.

The operation of the first conveying roller means 30 configured as described above will be described with reference to FIG. 23. The preceding sheet SA1 fed to the second switchback conveying path (sheet conveying path) SP2 is supported by the first conveying roller means 30 and the second conveying roller means 36. When the succeeding sheet SA2 from the carry-in port 23 is fed to the preceding sheet SA1 in the condition described above, the stepping motor SM shifts and separates the movable roller 30*a* from the fixed roller 30*b* (see FIG. 23 (*a*)). Further, when the succeeding sheet SA2 slips in between the rollers of the first conveying roller means 30, the stepping motor SM brings the movable roller 30*a* into pressure contact with the fixed roller 30*b* by the weak pressure contact force. The forward reverse motor M2 of the first conveying roller means 30 transmits a driving rotation force to the movable roller 30*a* and not to the fixed roller 30*b*. That is, the forward reverse motor M2 is configured to selectively transmit driving to the fixed roller 30*b* and the movable roller 30*a* via a clutch CL.

Once the forward reverse motor M2 transmits the driving to the movable roller 30*a*, the succeeding sheet SA2 is conveyed toward the downstream offset roller (conveying roller) 36, while the preceding sheet SA1 that is in contact with the movable roller 30*a* remains stopped. Further, when the succeeding sheet reaches the nip point on the offset roller 36, then after registration, the offset roller 36 is rotated through a predetermined angle. The upstream sheet discharging roller 30 is controlled to be separate from the offset roller 36 or to deliver the sheet trailing end in synchronism with the offset roller 36. Repeating such control allows the sheets from the carry-in port 23 to be set and collected like scales so as to extend between the first conveying roller means 30 and the second conveying roller means 36.

In this mode, the image forming apparatus A forms images on sheets, for example, in the order described with reference to FIG. 23B, and the post-processing apparatus B completes a booklet. With caption folding set, the sheets are set between the sheet discharging roller 30 and the conveying roller 36 of the second switchback conveying path SP2 as described with reference to FIG. 3B. This operation will be described below with reference to FIG. 24.

When a sheet is carried into the sheet carry-in path P1, the sheet connecting operation control section 64*b* of the control CPU 61, described with reference to FIG. 6, allows the carry-in roller 24 to feed the sheet to the sheet discharging roller 30. At this time, with the first sheet SA1, the sheet discharging rollers 30*a* and 30*b* are rotated clockwise in FIG. 23 in tight pressure contact with each other. This state is shown in FIG. 24 (*a*). The sheet fed to the sheet carry-in path P1 is transferred from the carry-in roller 24 to the sheet discharging roller 30. The sheet sensor Se1 then detects the sheet trailing end to issue the corresponding signal. On the basis of the signal, the control CPU 61 stops the sheet discharging roller 30 at the moment when the sheet trailing end is expected to pass through the path switching piece 27. The control CPU 61 moves the path switching piece 27 to a position shown by a dashed line in FIG. 24 (*a*). The control CPU 61 then reverses the rotation of the sheet discharging roller 30 (counterclockwise in FIG. 24). Then, the conveying direction of the sheet placed in the sheet carry-in path P1 is reversed. The sheet is then guided from the path switching piece 27 to the second switchback conveying path SP2.

In the meantime, the conveying roller (second conveying roller means) 36 on the second switchback path SP2 remains stopped. The sheet trailing end thus abuts against the stopped conveying roller 36 as shown in FIG. 24 (*b*). At this moment, the control CPU 61 stops the forward reverse motor M2 for the sheet discharging roller 30. The control CPU 61 then shifts the movable roller 30*a* of the sheet discharging roller 30 to the tight pressure contact state. The control CPU 61 further synchronizes the second conveying roller means 36 with the sheet discharging roller 30 to move the sheet by a preset offset amount. The sheet trailing end is then stopped so as to project downstream from the second conveying roller means 36 by an amount of1 shown in FIG. 24(*c*) (see FIG. 24(*c*)). The control CPU 61 then holds the preceding sheet SA1 so that the sheet extends between the second conveying roller means 36 and the sheet discharging roller 30. The control CPU 61 then waits for the succeeding sheet to be carried in.

When the succeeding sheet SA2 is carried in through the carry-in port 23, the control CPU 61 separates the movable roller 30*a* of the sheet discharging roller 30 from the fixed roller 30*b*. At the same time, the control CPU 61 moves the path switching piece 27 to a position shown by a solid line in FIG. 24 (*d*). The succeeding sheet SA2 is then fed to the sheet discharging roller 30 by the carry-in roller 24 and laid on top of the preceding sheet SA1. Further, when the trailing end of the succeeding sheet SA2 passes through the carry-in roller 24, the control CPU 61 brings the movable roller 30*a* of the sheet discharging roller 30 into loose pressure contact with the fixed roller 30*b*. The control CPU 61 further turns on the clutch for the movable roller 30*a* to transfer the succeeding sheet SA2 until the trailing end thereof passes through the path switching piece 27. The control CPU 61 subsequently stops the sheet discharging roller 30.

The control CPU 61 shifts the path switching piece 27 to a state shown in FIG. 24(*e*). The control CPU 61 further reversely rotates the movable roller 30*a* of the sheet discharging roller 30 (counterclockwise) to feed only the succeeding sheet SA2 to the second conveying roller means 36. The first conveying roller means 30 is in the loose pressure contact state, and the second conveying roller means 36 remains stopped. Thus, only the succeeding sheet SA2 is fed to the conveying roller 36, with the preceding sheet SA1 left at rest by the fixed roller 30*b* and the second conveying roller means 36.

Further, when the trailing end of the succeeding sheet SA2 abuts against the stopped conveying roller 36 as shown in FIG. 24(*f*), the control CPU 61 stops the driving motor M2 for the sheet discharging roller 30. The control CPU 61 then shifts the movable roller 30*b* of the sheet discharging roller 30 to the tight pressure control state. The control CPU 61 further synchronizes the conveying roller means 36 with the sheet discharging roller 30 to move the succeeding sheet SA2 by a preset offset amount. As shown in FIG. 24(*f*), the succeeding sheet SA2 is offset so as to project downstream from the conveying roller means 36 by an amount of2. The preceding sheet SA1 is moved by an offset amount (of1+of2).

The control CPU 61 repeats the above-described operation (FIGS. 24 (*d*), 24 (*e*), and 24 (*f*)) to collect a predetermined number of sheets like scales between the sheet discharging roller 30 and the second conveying roller means 36 as shown in FIG. 24 (*g*). After setting and collecting all the sheets fed by the image forming apparatus A, so as to be offset from one another by predetermined amounts, the control CPU 61 shifts the movable roller 30*a* of the sheet discharging roller 30 to the tight pressure contact state. The control CPU 61 synchronizes the sheet discharging roller 30 with the second conveying roller means 36 to transfer the sheets downstream of the conveying roller 36.

The folding roll means 45 and saddle stitching staple means 40 of the second processing section 35, described above, are provided downstream of the conveying roller means 36. The control CPU 61 thus transfers the sheets (sheet bunch) collected at the second conveying roller means 36 to the second processing section 35. The sheets are then subjected to the saddle stitching staple process and the folding process (see FIG. 24(*h*)).

As described above, the first conveying roller means and the second conveying roller means are arranged on the sheet conveying path along which sheets are conveyed to the post-processing position so that the distance between the first conveying roller means and the second conveying roller means is shorter than the length of the sheets in the conveying direction. With the preceding sheet stopped and held between the rollers of the conveying roller means, the succeeding sheet is conveyed and laid on top of the preceding sheet. The preceding sheet and the succeeding sheet are then simultaneously conveyed downstream of the second conveying roller means by the predetermined offset amount. Likewise, the succeeding sheets to be set are sequentially offset from one another. All the sheets are then conveyed to the processing position located downstream of the second conveying roller means. Thus, for example, by controlling the rotation of a first roller pair and a second roller pair each composed of paired rollers that are in pressure contact with each other, it is possible to offset a plurality of sheets from one another to form a caption area. This eliminates the need for a special offset mechanism such as a stopper pawl as required for the conventional art.

Furthermore, the first conveying roller means and the second conveying roller means are arranged on the switchback path on which the conveying direction of the sheet is reversed. The trailing end of the sheet can thus be always offset at a fixed position regardless of the length size of the sheet. This eliminates the need to move the positions of the first conveying roller means and the second conveying roller means according to the sheet size, simplifying the offset mechanism.

Moreover, the first conveying roller means and the second conveying roller means are arranged on the curved path, and the preceding sheet is positioned inside the curve, while the succeeding sheet is positioned outside the curve. Thus, after being registered to the outer periphery of the rollers of the downstream second conveying roller means, the succeeding sheet is conveyed simultaneously with the preceding sheet so as to be offset from each other. This allows the sheets to overlap each other with an accurate offset amount without being skewed.

Now, with reference to FIGS. 26(*a*) t0 26(*e*), a supplementary description will be given of another embodiment of the sheet carry-in guide 37', described with reference to FIGS. 15(*a*) and 15(*b*). As shown in FIG. 26(*a*), the sheet carry-in guide 37" is formed of resin and comprises a hook 37*f* provided at one end and supported so as to be rotatable with respect to the rotating shaft of the sheet discharging roller 37*b* and an arm section 37*m* provided at the other end and rotated clockwise in FIG. 26(*b*) by movement of the leading end of discharged sheets against the bias force of a spring 37*t*. The arm section 37*m* has a guide surface 37G formed thereon to guide the trailing end of the collected sheet bunch to the switchback approaching path 35*c* without colliding against the sheet discharging roller 37*c* in order to move the sheet bunch to a saddle stitching position. FIG. 26(*a*) shows that a sheet S has been conveyed to the front of sheet sensing means SE provided upstream of the sheet discharging rollers 37*b* and 37*c*.

FIG. 26(*b*) shows a state diagram showing that the sheet sensing means SE has detected the leading end of the carried-in sheet S. The sheet sensing means SE detects the leading end of the sheet S and controls the conveyance of the sheet to a position where the leading end of the sheet abuts against the leading end regulating member 38, described with reference to FIG. 14(*a*).

FIG. 26(*c*) is a state diagram showing that the leading end of the sheet S pushes up the hook 37*f* of the sheet carry-in guide 37B. The hook 37*f* is rotated clockwise in the figure against the bias force of the spring 37*t*.

FIG. 26(*d*) is a state diagram showing that the trailing end of the sheet S has passed the nip point on the sheet discharging rollers 36*a* and 36*b* and pushed onto a collecting surface of the collecting guide 35 by the hook 37*f*, which is rotated counterclockwise by the bias force of the spring 37*t*.

FIG. 26(*e*) is a state diagram showing that the succeeding sheet S is loaded so as to overlap the preceding sheet without colliding against the trailing end of the preceding sheet S.

As described above, carried-in sheets can be sequentially loaded as is the case with the sheet carry-in guide 37A, described with reference to FIGS. 15(*a*) and 15(*b*).

As described above, according to an embodiment of the present invention, to carry in and load sheets on the downstream collecting guide through the sheet discharging port, the leading end regulating means places the trailing end of the sheet supported on the guide, at the predetermined position located below the sheet discharging port. Furthermore, the plate-like guide member having the base end pivotally supported via the shaft is provided at the carry-in port. The leading end of the plate-like guide member is configured to turn so as to retract along the surface of the uppermost sheet on the collecting guide to the outside of the surface and then to return to the carried-in sheet. The embodiment of the present invention thus exerts the following effects.

The trailing end of the sheets loaded on the collecting guide, which end is closer to the sheet discharging port, is aligned with the predetermined position. The plate-like guide member with the leading end thereof located at the predetermined position guides the carried-in sheet onto the loaded sheets through the sheet discharging port. The sheets can thus be set on the collecting tray with the sheet order reliably maintained. Furthermore, even if the trailing end of the sheets loaded on the collecting guide is curled and rolls back upward, the sheet from the sheet discharging port is prevented from being caught on the trailing end. The embodiment also prevents a jam that may occur when a sheet is carried in.

The position of the leading end regulating means located on the collecting guide need not be moved forward or backward in the conveying direction every time a sheet is carried in. Consecutively carried-out sheets can thus be quickly collected. The mechanism according to the embodiment of the present invention is therefore simple and easy to control compared to the conventional one, which moves the leading end regulating means forward or backward every time a sheet is carried in.

Moreover, according to the embodiment of the present invention, the collecting guide may be composed of the curved or bent guide so that loaded sheets are supported so as to roll back and project toward the folding roll means or the stapling means. That is, the sheets (sheet bunch) on the guide need not be moved forward or backward every time a sheet is carried in, which prevents the sheets from being misaligned. Collecting the sheets in curved form allows the stapling process or the folding process to be executed at the exact position.

The present application claims the priority to Japanese Patent Application No. 2007-022039, Japanese Patent Application No. 2007-050495, Japanese Patent Application No. 2007-050496, and Japanese Patent Application No. 2007-144039 which are incorporated herein by reference.

What is claimed is:

1. A sheet post-processing apparatus comprising:

a sheet carry-in path having a carry-in port and a first sheet discharge port;

a switch back conveying path for guiding a sheet from the carry-in port of the sheet carry-in path fed through the first sheet discharge port to a downstream post-processing position, said switch back conveying path having a sheet approaching path, a switch back approaching path and a sheet processing path, wherein the sheet approaching path branches off from the sheet carry-in path and extends downwardly from the sheet carry-in path to a second sheet discharge port; the sheet processing path extends further downwardly from the second sheet discharge port; and the switch back approaching path branches from the second sheet discharge port separately from the sheet approaching path, a collecting guide device for setting and collecting the sheet transferred through the sheet approaching path into a bunch of sheets, the collecting guide device being located on the sheet processing path;

a post-processing device for executing at least one of a stapling process and a folding process on the bunch of sheets collected on the collecting guide device in the sheet processing path;

a sheet leading end regulating device for regulating a position of leading end of the bunch of sheets collected on the collecting guide device, the sheet leading end regulating device being formed to be movable so that a trailing end of the bunch of sheets supported on the collecting guide device is transferred from a position of being at least placed in the second sheet discharge port to a position of being placed in the switch back approaching path to stack a carried-in sheet transferred through the sheet approaching path onto an uppermost sheet of the bunch of sheets at the collecting guide device;

a guide member provided at the second sheet discharge port so that the carried-in sheet transferred through the sheet approaching path is guided onto the uppermost sheet supported on the collecting guide device where the trailing end of the bunch of sheets is located at the second sheet discharge port; and a shift device for moving a position of the sheet leading end regulating device along the sheet processing path;

wherein the switchback approaching path is arranged so as to move the bunch of sheets supported on the collecting guide device to an overlap position where the trailing end of the bunch of sheets overlaps the leading end of the carried-in sheet from the sheet approaching path complying with a position of the sheet leading end regulating device, and wherein the guide member comprises a plate guide member, the plate guide member having a base end supported via a shaft so as to be pivotable above the collecting guide device, and a leading end configured to retract from an operative position where the carried-in sheet is guided onto the uppermost sheet on the collecting guide device, along a surface of the uppermost sheet and then to pivot onto the carried-in sheet, and a driving device for rotating the guide member is coupled to the plate guide member.

2. The sheet post-processing apparatus according to claim 1, wherein the plate guide member comprises an elastically deformable flexible member or a plate member having the base end deformably coupled to the shaft, and the plate guide member is elastically deformed or rotates around the shaft so as to pass over the uppermost sheet on the collecting guide device and return to a position of guiding the carried-in sheet onto the collecting guide device.

3. The sheet post-processing apparatus according to claim 1, wherein the guide member regulates floating of the trailing end of the bunch of sheets on the collecting guide device.

4. A sheet post-processing apparatus comprising:

a sheet carry-in path having a carry-in port and a first sheet discharge port;

a switch back conveying path for guiding a sheet from the carry-in port of the sheet carry-in path fed through the first sheet discharge port to a downstream post-processing position, said switch back conveying path having a sheet approaching path, a switch back approaching path and a sheet processing path, wherein the sheet approaching path branches off from the sheet carry-in path and extends downwardly from the sheet carry-in path to a second sheet discharge port; the sheet processing path extends further downwardly from the second sheet discharge port; and the switch back approaching path branches from the second sheet discharge port separately from the sheet approaching path, a collecting guide device for setting and collecting the sheet transferred through the sheet approaching path into a bunch of sheets, the collecting guide device being located on the sheet processing path;

a post-processing device for executing at least one of a stapling process and a folding process on the bunch of sheets collected on the collecting guide device in the sheet processing path;

a sheet leading end regulating device for regulating a position of leading end of the bunch of sheets collected on the collecting guide device, the sheet leading end regulating device being formed to be movable so that a trailing end of the bunch of sheets supported on the collecting guide device is transferred from a position of being at least placed in the second sheet discharge port to a position of being placed in the switch back approaching path to stack a carried-in sheet transferred through the sheet approaching path onto an uppermost sheet of the bunch of sheets at the collecting guide device;

a guide member provided at the second sheet discharge port so that the carried-in sheet transferred through the sheet approaching path is guided onto the uppermost sheet supported on the collecting guide device where the trailing end of the bunch of sheets is located at the second sheet discharge port; and a shift device for moving a position of the sheet leading end regulating device along the sheet processing path;

wherein the switchback approaching path is arranged so as to move the bunch of sheets supported on the collecting guide device to an overlap position where the trailing end of the bunch of sheets overlaps the leading end of the carried-in sheet from the sheet approaching path complying with a position of the sheet leading end regulating device, and wherein the post-processing device comprises a folding roll device disposed on the collecting guide device at a sheet fold position, the collecting guide device comprising a curved or bent sheet loading guide supporting the bunch of sheets so that the sheets roll back with the sheet fold position projecting toward the folding roll device.

5. The sheet post-processing apparatus according to claim 4, wherein the sheet approaching path comprises a curved guide member curving the sheet in a direction opposite to that of the collecting guide device, the guide member regulating floating of the trailing end of the bunch of sheets on the collecting guide device.

6. An image forming system comprising:

an image forming apparatus sequentially forming images on sheets; and the sheet post-processing apparatus according to claim 4, the sheet post-processing apparatus executing at least one of a stapling process and a folding process on the sheets from the image forming apparatus.

7. A sheet post-processing apparatus comprising:

a sheet carry-in path having a carry-in port and a first sheet discharge port;

a switch back conveying path for guiding a sheet from the carry-in port of the sheet carry-in path fed through the first sheet discharge port to a downstream post-processing position, said switch back conveying path having a sheet approaching path, a switch back approaching path and a sheet processing path, wherein the sheet approaching path branches off from the sheet carry-in path and extends downwardly from the sheet carry-in path to a second sheet discharge port; the sheet processing path extends further downwardly from the second sheet discharge port; and the switch back approaching path branches from the second sheet discharge port separately from the sheet approaching path, a collecting guide device for setting and collecting the sheet transferred through the sheet approaching path into a bunch of sheets, the collecting guide device being located on the sheet processing path;

a post-processing device for executing at least one of a stapling process and a folding process on the bunch of sheets collected on the collecting guide device in the sheet processing path;

a sheet leading end regulating device for regulating a position of leading end of the bunch of sheets collected on the collecting guide device, the sheet leading end regulating device being formed to be movable so that a trailing end of the bunch of sheets supported on the collecting guide device is transferred from a position of being at least placed in the second sheet discharge port to a position of being placed in the switch back approaching path to stack a carried-in sheet transferred through the sheet approaching path onto an uppermost sheet of the bunch of sheets at the collecting guide device;

a guide member provided at the second sheet discharge port so that the carried-in sheet transferred through the sheet approaching path is guided onto the uppermost sheet supported on the collecting guide device where the trailing end of the bunch of sheets is located at the second sheet discharge port; and a shift device for moving a position of the sheet leading end regulating device along the sheet processing path;

wherein the switchback approaching path is arranged so as to move the bunch of sheets supported on the collecting guide device to an overlap position where the trailing end of the bunch of sheets overlaps the leading end of the carried-in sheet from the sheet approaching path complying with a position of the sheet leading end regulating device, and wherein the post-processing device comprises a staple device for stapling the bunch of sheets collected on the collecting guide device and a folding roll device for folding the bunch of sheets, the staple device is located on the collecting guide device at an upstream sheet staple position and the folding roll device is located on the collecting guide device at a downstream sheet fold position so that the staple device and the folding roll device are arranged in this order, and the collecting guide device comprises a curved or bent sheet loading guide, and supports the bunch of sheets so that the sheets roll back with the sheet fold position projecting toward the folding roll device.

8. The sheet post-processing apparatus according to claim 7, wherein the post-processing device has:

a folding roll device for folding the bunch of sheets collected on the collecting guide device, the folding roll device being located at a fold position, the staple device is located upstream of the folding roll device, and the shift device controls a position of the sheet leading end regulating device so as to move the bunch of sheets supported on the collecting guide device to a sheet staple position when the staple device performs a stapling operation, and move the bunch of sheets supported on the collecting guide device to the fold position when the folding device performs a folding operation.

9. The sheet post-processing apparatus according to claim 7, wherein the sheet leading end regulating device comprises a locking member locking the leading end of the sheets and a grip member gripping the sheets supported on the locking member, the sheet grip member gripping the leading end of the sheet bunch when the sheet bunch on the sheet loading guide is moved from the staple position to the fold position.

10. An image forming system comprising:

an image forming apparatus sequentially forming images on sheets; and the sheet post-processing apparatus according to claim 7, the sheet post-processing apparatus executing at least one of a stapling process and a folding process on the sheets from the image forming apparatus.

11. A sheet post-processing apparatus comprising:

a sheet carry-in path having a carry-in port and a first sheet discharge port;

a switch back conveying path for guiding a sheet from the carry-in port of the sheet carry-in path fed through the first sheet discharge port to a downstream post-processing position, said switch back conveying path having a sheet approaching path, a switch back approaching path and a sheet processing path, wherein the sheet approaching path branches off from the sheet carry-in path and extends downwardly from the sheet carry-in path to a second sheet discharge port; the sheet processing path extends further downwardly from the second sheet discharge port; and the switch back approaching path branches from the second sheet discharge port separately from the sheet approaching path, a collecting guide device for setting and collecting the sheet transferred through the sheet approaching path into a bunch of sheets, the collecting guide device being located on the sheet processing path;

a post-processing device for executing at least one of a stapling process and a folding process on the bunch of sheets collected on the collecting guide device in the sheet processing path;

a sheet leading end regulating device for regulating a position of leading end of the bunch of sheets collected on the collecting guide device, the sheet leading end regulating device being formed to be movable so that a trailing end of the bunch of sheets supported on the collecting guide device is transferred from a position of being at least placed in the second sheet discharge port to a position of being placed in the switch back approaching path to stack a carried-in sheet transferred through the sheet approaching path onto an uppermost sheet of the bunch of sheets at the collecting guide device;

a guide member provided at the second sheet discharge port so that the carried-in sheet transferred through the sheet approaching path is guided onto the uppermost sheet supported on the collecting guide device where the trailing end of the bunch of sheets is located at the second sheet discharge port; and a shift device for moving a position of the sheet leading end regulating device along the sheet processing path;

wherein the switchback approaching path is arranged so as to move the bunch of sheets supported on the collecting guide device to an overlap position where the trailing end of the bunch of sheets overlaps the leading end of the carried-in sheet from the sheet approaching path complying with a position of the sheet leading end regulating device, and wherein the sheet carry-in path is located in a substantially horizontal direction, the sheet carry-in path includes a standby path located upstream of a branching point on the sheet carry-in path and along which at least the trailing end of the sheet fed through the carry-in port is retracted, and the sheet post-processing apparatus further comprises, in the sheet carry-in path, a flapper device for guiding the trailing end of the sheet to the standby path, the flapper device being located upstream of the branching point, a conveying roller device located downstream of the branching point and being rotatable forward and backward, and a control device for rotating the conveying roller device forward and backward so as to reverse a conveying direction of the sheet from the carry-in port, the control device controlling the conveying roller device to temporarily hold the sheet on the standby path so that the sheet overlaps a succeeding sheet, then transferring the trailing ends of the sheet and the succeeding sheet to the branching point, and conveying the sheets from the sheet approaching path to the collecting guide device.

12. The sheet post-processing apparatus according to claim 11, further comprising, in the sheet carry-in path, a pair of carry-in rollers for conveying the sheet from the carry-in port to downstream of the sheet carry-in path, the pair of carry-in rollers being located upstream of the flapper device, and a path switching device located at the branching point of the sheet approaching path, and the flapper device, the path switching device, and the conveying roller device being arranged downstream of the pair of carry-in rollers in this order.

13. The sheet post-processing apparatus according to claim 11, wherein the conveying roller device includes a pair of rollers capable of coming into pressure contact with each other and separating from each other, and an actuating device for contacting and separating the paired rollers relative to each other, and the control device brings the paired rollers into pressure contact with each other to retract the sheet from the carry-in port to the standby path, separates the paired rollers from each other to lay the sheet held on the standby path on top of the succeeding sheet, and brings the paired rollers into pressure contact with each other again to convey the overlapping sheets to the sheet approaching path.

14. A sheet post-processing apparatus comprising:

a sheet carry-in path having a carry-in port and a first sheet discharge port;

a switch back conveying path for guiding a sheet from the carry-in port of the sheet carry-in path fed through the first sheet discharge port to a downstream post-processing position, said switch back conveying path having a sheet approaching path, a switch back approaching path and a sheet processing path, wherein the sheet approaching path branches off from the sheet carry-in path and extends downwardly from the sheet carry-in path to a second sheet discharge port; the sheet processing path extends further downwardly from the second sheet discharge port; and the switch back approaching path branches from the second sheet discharge port separately from the sheet approaching path, a collecting guide device for setting and collecting the sheet transferred through the sheet approaching path into a bunch of sheets, the collecting guide device being located on the sheet processing path;

a post-processing device for executing at least one of a stapling process and a folding process on the bunch of sheets collected on the collecting guide device in the sheet processing path;

a sheet leading end regulating device for regulating a position of leading end of the bunch of sheets collected on the collecting guide device, the sheet leading end regulating device being formed to be movable so that a trailing end of the bunch of sheets supported on the collecting guide device is transferred from a position of being at least placed in the second sheet discharge port to a position of being placed in the switch back approaching path to stack a carried-in sheet transferred through the sheet approaching path onto an uppermost sheet of the bunch of sheets at the collecting guide device;

a guide member provided at the second sheet discharge port so that the carried-in sheet transferred through the sheet approaching path is guided onto the uppermost sheet supported on the collecting guide device where the trailing end of the bunch of sheets is located at the second sheet discharge port;

a shift device for moving a position of the sheet leading end regulating device along the sheet processing path;

a sheet conveying device for conveying the sheet from the carry-in port to the post processing position of the post-processing device, the sheet conveying device comprising a first conveying roller device and a second conveying roller device; and a control device for controlling the sheet conveying device, wherein the switchback approaching path is arranged so as to move the bunch of sheets supported on the collecting guide device to an overlap position where the trailing end of the bunch of sheets overlaps the leading end of the carried-in sheet from the sheet approaching path complying with a position of the sheet leading end regulating device, and wherein the first conveying roller device is located upstream of the sheet approaching path and the second conveying roller device is located away from and downstream of the first conveying roller device on the sheet approaching path branching off from the sheet carry-in path, a distance between the first conveying roller device and the second conveying roller device being shorter than a length of the sheet in a conveying direction, the first conveying roller device comprises a pair of rollers capable of releasing or reducing a roller pressure contact force so as to nip a preceding sheet and a succeeding sheet so that the preceding sheet and the succeeding sheet overlap, the roller pair being driven and coupled so as to apply a conveying force to the succeeding sheet, and the control device controls the first conveying roller device and the second conveying roller device so that the first conveying roller device and the second conveying roller device convey and lay the succeeding sheet from the carry-in port on top of the preceding sheet fed through the carry-in port, the preceding sheet being temporarily stopped and held; then simultaneously convey the preceding sheet and the succeeding sheet to downstream of the second conveying roller device so that the preceding sheet and the succeeding sheet are offset from each other; and subsequently convey all the sheets to be set, from the second conveying roller device to the post processing position in a condition that the sheets overlap and are offset from one another.

15. The sheet post-processing apparatus according to claim 14, wherein the control device controls the first conveying roller device and the second conveying roller device so that after the succeeding sheet is conveyed to a nip position on the second conveying roller device with the preceding sheet being held by the first and second conveying roller devices, in order to transfer the preceding sheet and the succeeding sheet to downstream of the second conveying roller device so that the preceding sheet and the succeeding sheet are offset from each other, the first conveying roller device and the second conveying roller device transfer the sheets with the first conveying roller device applying the roller pressure contact force, or the second conveying roller device transfers the sheets with the first conveying roller device releasing the roller pressure contact force.

16. The sheet post-processing apparatus according to claim 14, wherein the control device controls the first conveying roller device and the second conveying roller device so that when the first conveying roller device and the second conveying roller device convey the succeeding sheet to the nip position on the second conveying roller device with the preceding sheet being held by the first and second conveying roller devices, a roller pressure contact force of the first conveying roller device is reduced or released, and when a leading end of the succeeding sheet abuts against the nip position on the second conveying roller device, the roller pressure contact force is reduced to slip the sheet so as to prevent rebounding of the sheet.

17. The sheet post-processing apparatus according to claim 14, wherein the roller pair forming the first conveying roller device is configured to be able to select one of at least three positions corresponding to a separation state in which the rollers are separated from each other, a reduction state in which pressure contact forces of the rollers are reduced, and an increase state in which the pressure contact forces of the rollers are increased, and the control device controls such that the roller pair is positioned in the separation state to nip the succeeding sheet with the preceding sheet being held and is positioned in the reduction state to transfer the succeeding sheet to the second conveying roller device.

18. The sheet post-processing apparatus according to claim 14, wherein the control device controls the first conveying roller device and the second conveying roller device so that:

the first conveying roller device and the second conveying roller device convey and lay the succeeding sheet from the carry-in port on top of the preceding sheet fed through the carry-in port, the preceding sheet being temporarily stopped and held, then simultaneously convey the preceding sheet and the succeeding sheet downstream of the second conveying roller device so that the preceding sheet and the succeeding sheet are offset from each other, and subsequently convey all the sheets to be set, from the second conveying roller device to the processing position so that the sheets overlap and are offset from one another.

19. A sheet post-processing apparatus comprising:

a sheet carry-in path having a carry-in port and a first sheet discharge port;

a switch back conveying path for guiding along which sheets from the carry-in port of the sheet carry-in path are fed through the first sheet discharge port to a downstream post-processing position, a collecting guide device for setting and collecting the sheets into a bunch, the collecting guide device being located downstream of the sheet discharging port with a difference in level between the sheet discharging port and the collecting guide means;

a post-processing device for executing at least one of a stapling process and a folding process on the sheet bunch collected on the collecting guide device;

a sheet leading end regulating device for regulating a position of leading ends of the sheets collected on the collecting guide device, the sheet leading end regulating device being configured to be movable according to a sheet size so that trailing ends of the sheets supported on the collecting guide device are placed at a predetermined position below the second sheet discharge port; and a guide member provided at the second sheet discharge port of the sheet carry-in path to guide a carried-in sheet onto an uppermost sheet supported on the collecting guide device;

a sheet conveying device for conveying the sheet from the carry-in port to the post processing position of the post-processing device, the sheet conveying device being located on the second sheet conveying path; and a control device for controlling the sheet conveying device;

wherein the sheet conveying device has the first conveying roller device is located upstream of the sheet approaching path and the second conveying roller device is located away from and downstream of the first conveying roller device, a distance between the first conveying roller device and the second conveying roller device being shorter than a length of the sheet in a conveying direction, the first conveying roller device comprises a pair of rollers capable of releasing or reducing a roller pressure contact force so as to nip a preceding sheet and a succeeding sheet so that the preceding sheet and the succeeding sheet overlap, the roller pair being driven and coupled so as to apply a conveying force to the succeeding sheet, the control device controls the first conveying roller device and the second conveying roller device so that the first conveying roller device and the second conveying roller device convey and lay the succeeding sheet from the carry-in port on top of the preceding sheet fed through the carry-in port, the preceding sheet being temporarily stopped and held; then simultaneously convey the preceding sheet and the succeeding sheet downstream of the second conveying roller device so that the preceding sheet and the succeeding sheet are offset from each other by a predetermined amount; and subsequently convey all the sheets to be set, from the second conveying roller device to the processing position in a condition that the sheets overlap and are offset from one another by predetermined amounts, and the sheet conveying path between the first conveying roller device and the second conveying roller device is curved so that the preceding sheet is positioned inside a curve, while the succeeding sheet is positioned outside the curve.

* * * * *